US009993913B2

(12) United States Patent
McCardle et al.

(10) Patent No.: US 9,993,913 B2
(45) Date of Patent: Jun. 12, 2018

(54) CLENCHING ADAPTER FOR AUTOMATIC NAILERS

(71) Applicant: Senco Brands, Inc., Cincinnati, OH (US)

(72) Inventors: Thomas A. McCardle, Cincinnati, OH (US); Donald C. Ries, Loveland, OH (US); David Michael Young, Sardinia, OH (US); John T. Burke, Williamsburg, OH (US); Kory Adam Gunnerson, Cincinnati, OH (US)

(73) Assignee: Senco Brands, Inc., Cincinnati, OH (US)

( * ) Notice: Subject to any disclaimer, the term of this patent is extended or adjusted under 35 U.S.C. 154(b) by 719 days.

(21) Appl. No.: 14/512,602

(22) Filed: Oct. 13, 2014

(65) Prior Publication Data

US 2015/0102086 A1 Apr. 16, 2015

Related U.S. Application Data

(60) Provisional application No. 61/890,397, filed on Oct. 14, 2013.

(51) Int. Cl.
*B25C 7/00* (2006.01)
*B25C 5/02* (2006.01)

(52) U.S. Cl.
CPC ..... *B25C 7/00* (2013.01); *B25C 5/0207* (2013.01); *B25C 5/0271* (2013.01)

(58) Field of Classification Search
CPC ..... B25C 1/047; B25C 5/02; B25C 5/0207; B25C 5/0221; B25C 5/0278; B25C 5/10; B25C 5/13; B25C 7/00
USPC ..... 227/107, 120, 124, 129, 130, 140, 154, 227/155, 29, 8, 19, 28, 37, 147
See application file for complete search history.

(56) References Cited

U.S. PATENT DOCUMENTS 2,687,522 A * 8/1954 Juilfs ..... B25C 5/0292 227/124
2,772,415 A * 12/1956 Jenny ..... B25C 5/0292 227/124

(Continued)

OTHER PUBLICATIONS

Internet advertisement for CN-70CL pneumatic clinch nailer, four pages in all; Apach Industrial Co. Ltd. (Jun. 20, 2014).

*Primary Examiner* — Gloria R Weeks
*Assistant Examiner* — William A Weller
(74) *Attorney, Agent, or Firm* — Frederick H. Gribbell

(57) ABSTRACT

A clenching adapter for use with automatic nailers tools is provided, which mounts to a nailer tool, and which extends behind a two-layer workpiece and curls the tip of a driven nail on the opposite side of the multiple-layer workpiece. The adapter includes a movable extension link that pivots on a proximal end, due to the action of an air cylinder actuator, and that pivoting motion causes an anvil mounted on its distal end to grasp the opposite (bottom) side of the workpiece, while also positioning the anvil to a location where it intercepts the nail that will be fired through the workpiece by the nailer tool. The anvil mechanism rotates from a "relaxed" position that fits within a gap in the boards of a workpiece, to an actuated "ready" position that receives and curls the nail, for clenching a multi-substrate workpiece. The actuations are automatically sequenced, in one embodiment.

2 Claims, 41 Drawing Sheets

(56) References Cited

U.S. PATENT DOCUMENTS

| | | | | | |
|---|---|---|---|---|---|
| 2,943,327 | A * | 7/1960 | Juilfs | B25C 5/0285 | 227/124 |
| 3,397,828 | A * | 8/1968 | Volkmann | B25C 1/041 | 227/124 |
| 3,734,378 | A * | 5/1973 | Rice | B25C 5/13 | 227/124 |
| 3,900,144 | A * | 8/1975 | Hamilton | B25C 7/00 | 227/155 |
| 4,129,933 | A * | 12/1978 | Jureit | B27F 7/155 | 206/340 |
| 4,716,813 | A * | 1/1988 | Prudencio | B25C 5/13 | 227/130 |
| 4,726,504 | A * | 2/1988 | Halbert | B21J 15/10 | 227/130 |
| 6,237,827 | B1 * | 5/2001 | Reckelhoff | B25C 5/0292 | 227/130 |
| 8,998,056 | B2 * | 4/2015 | Huang | B27F 7/09 | 227/124 |
| 9,724,812 | B2 * | 8/2017 | Scabin | B25C 5/0207 | |
| 2014/0076954 | A1 * | 3/2014 | Miller | B27M 3/0073 | 227/155 |
| 2017/0297188 | A1 * | 10/2017 | Huang | B25C 1/04 | |

* cited by examiner

CLENCHING ADAPTER FOR AUTOMATIC NAILERS

CROSS-REFERENCE TO RELATED APPLICATIONS

The present application claims priority to provisional patent application Ser. No. 61/890,397, titled "CLENCHING ADAPTER FOR AUTOMATIC NAILERS," filed on Oct. 14, 2013.

TECHNICAL FIELD

The technology disclosed herein relates generally to automatic nailer tools and is particularly directed to an automatic adapter of the type which mounts to the tools, and which extends behind a two-layer workpiece so as to curl (bend) the tip of a driven nail behind a multiple-layer workpiece. Embodiments are specifically disclosed that provide a relatively large anvil that will curl the tip of the nail behind the workpiece, so that the nail itself clenches the two substrate layers of the workpiece together.

STATEMENT REGARDING FEDERALLY SPONSORED RESEARCH OR DEVELOPMENT

None.

BACKGROUND

Clenching a fastener is well known in the art when the fastener is a staple. The two prongs of the staple can be bent inward—the most standard method—or they can be bent outward to distribute the load to a greater area of the workpiece.

In general, placing a nail into a wood workpiece at a precise angle and position does not result in an exact position, as would be desired. Since wood products have a grain, the path the nail travels can be altered, and when that happens, the exit point of the tip of the nail often is changed from its original "planned" position. This indeterminate nail path is not repetitive, and it is a definite problem for manufacturing or construction applications in which the tip of the nail is to be curled, so that the two substrate layers of the workpiece become clenched together.

The manufacturers of wood pallets sometimes use a separate, stationary (non-portable) fixture that positions a type of target, or anvil, beneath the bottom wood frame during the initial assembly steps for making a pallet assembly, and then use a nail gun to shoot nails through the multiple-layer workpiece. The tip of the nail, after passing through the multiple layers of the workpiece, will then curl beneath the bottom surface of the workpiece to clench the multiple layers together. Such a process is expensive and slow, since it is unwieldy to provide such large target fixtures and to work with them for the large number of nail-driving positions that must be made in the workpieces.

One improvement in such nailing systems would be to attach a movable anvil to a portable nail driving tool, so that the anvil is always positioned that the correct location beneath the nail driving region, as determined by the human user of the portable nail driving tool. This allows the human user to "fire" as many, or as few, nails as he or she desires at a particular position on the workpiece (e.g., a pallet), and the user will easily be able to see the exact position where the nail is to be driven. By having a portable clenching anvil attached to the tool, the user is able to concentrate on a particular location for placing multiple nails while being assured that the anvil is securely gripping against the bottom of the pallet at that precise location where the nails are being driven.

SUMMARY

Accordingly, it is an advantage to provide a small, light-weight, clenching mechanism that directly mounts to a portable automatic nailer tool, so that a nail-curling anvil is always placed beneath the workpiece at an appropriate position as the nail is driven.

It is another advantage to provide a small, light-weight, clenching mechanism that directly mounts to a portable automatic nailer tool, in which the clenching mechanism automatically grasps the workpiece just before a nail is fired by the tool, by use of a single actuation of the tool's triggering mechanism.

It is yet another advantage to provide a small, light-weight, clenching mechanism that directly mounts to a portable automatic nailer tool, which includes an anvil of a sufficient size and shape that tends to re-direct the tip of a nail that impacts the anvil, thereby creating a curl in the nail to cause it to clench together at least two layers of substrate material that make up the workpiece.

It is a further advantage to provide a small, light-weight, clenching mechanism that directly mounts to a portable automatic nailer tool and which includes an anvil that tends to re-direct the tip of a nail that impacts the anvil, and for the anvil mechanism to be able to rotate from a non-extended "relaxed" position that is sufficiently small to fit within a gap in the boards of a target workpiece, to an actuated "ready" position that is sufficiently large to receive the nail for clenching a multi-substrate workpiece.

It is yet a further advantage to provide a small, light-weight, clenching mechanism that directly mounts to a portable automatic nailer tool and which includes an anvil of a sufficient size that tends to re-direct the tip of a nail that impacts the anvil, and for the anvil mechanism to be able to rotate from a non-extended "relaxed" position to an actuated "ready" position, such that the rotating mechanism causes the anvil to complete its rotation before the clenching mechanism physically contacts the workpiece at the anvil's location.

It is still a further advantage to provide a small, light-weight, clenching mechanism that directly mounts to a portable automatic nailer tool and which includes an anvil of a sufficient size that tends to re-direct the tip of a nail that impacts the anvil, and for the anvil mechanism to be able to rotate from a non-extended "relaxed" position to an actuated "ready" position, in which a flexible reach link is part of the clenching mechanism, to allow for variation in the thickness of the multi-substrate workpiece while still ensuring a good clenching action of the anvil against the workpiece.

It is still another advantage to provide a small, light-weight, clenching mechanism that directly mounts to a portable automatic nailer tool and which includes an anvil of a sufficient size that tends to re-direct the tip of a nail that impacts the anvil, and for the anvil mechanism to be able to rotate from a non-extended "relaxed" position to an actuated "ready" position, in which an extendable link without any rubber parts is part of the clenching mechanism, to allow for variation in the thickness of the multi-substrate workpiece while still ensuring a good clenching action of the anvil against the workpiece.

It is yet another advantage to provide a small, light-weight, clenching mechanism that directly mounts to a portable automatic nailer tool and which includes an anvil of a sufficient size that tends to re-direct the tip of a nail that impacts the anvil, and for the anvil mechanism to be able to rotate from a non-extended "relaxed" position to an actuated "ready" position, in which an extendable link that includes travel stops to prevent overtravel is part of the clenching mechanism, to allow for variation in the thickness of the multi-substrate workpiece while still ensuring a good clenching action of the anvil against the workpiece.

It is yet a further advantage to provide a small, lightweight, clenching mechanism that directly mounts to a portable automatic nailer tool and which includes an anvil of a sufficient size that tends to re-direct the tip of a nail that impacts the anvil, and for the anvil mechanism to be able to rotate from a non-extended "relaxed" position to an actuated "ready" position, in which there is an extension arm with an air-operated anvil actuation cylinder, and has internal air passages only throughout the "reach" members of the extension arm, with no external air lines or cable on the extension arm.

It is still a further advantage to provide a small, lightweight, clenching mechanism that directly mounts to a portable automatic nailer tool and which includes an anvil of a sufficient size that tends to re-direct the tip of a nail that impacts the anvil, and for the anvil mechanism to be able to rotate from a non-extended "relaxed" position to an actuated "ready" position, in which the sequencing of the major moving components is controlled automatically, so that the first event of a firing sequence will always be the rotation of the anvil, then the second event of a firing sequence will always be the actuation of the extending "clench arm," and the third event of a firing sequence will always be the actuation of the main driving components to drive a fastener.

Additional advantages and other novel features will be set forth in part in the description that follows and in part will become apparent to those skilled in the art upon examination of the following or may be learned with the practice of the technology disclosed herein.

To achieve the foregoing and other advantages, and in accordance with one aspect, a clenching adapter is provided for use with automatic portable nailer tools, which comprises: (a) a base support that mounts to a nailer tool; (b) an actuator that causes mechanical movement during a nail firing sequence, the actuator being attached to the base support, the actuator having a proximal mounting location, and the actuator having a first operating state and a second operating state; (c) a movable extension arm which extends from the proximal mounting location of the actuator to a distal end of the extension arm; and (d) an anvil that is mounted proximal to the distal end of the movable extension arm; (e) wherein: (i) the anvil is sized and shaped to not contact a workpiece, if the actuator is placed into the first operating state; (ii) the anvil is sized and shaped to contact a distal side of the workpiece, if the actuator is placed into the second operating state; (iii) the movable extension arm is sized and shaped so as to position the anvil at a nail receiving location on the distal side of the workpiece from where the nailer tool is positioned, such that when a nail is fired by the nailer tool, the nail will penetrate through the workpiece and then impact against the anvil; and (iv) the anvil is movable between a first orientation and a second orientation, such that: (A) if the actuator is in the first operating state, then the anvil is maintained in the first orientation and exhibits a first cross-section footprint that is relatively small and allows the anvil to pass through a gap between two adjacent members of the workpiece; and (B) if the actuator is in the second operating state, then the anvil is transitioned to the second orientation and now exhibits a second cross-section footprint that is significantly larger and will not allow the anvil to pass through the gap, but when in the second orientation the anvil is sized and shaped to receive the nail that is fired by the nailer tool, and to cause the nail to be curled, such that the workpiece becomes clenched after the nail becomes curled.

In accordance with another aspect, a clenching adapter for use with automatic portable nailer tools is provided, which comprises: (a) a base support that mounts to a nailer tool; (b) an actuator that causes mechanical movement during a nail firing sequence, the actuator being attached to the base support, the actuator having a proximal mounting location, and the actuator having a first operating state and a second operating state; (c) a movable extension arm which extends from the proximal mounting location of the actuator to a distal end of the extension arm; (d) an anvil that is mounted proximal to the distal end of the movable extension arm; and (e) a flexible reach link that is mounted proximal to the movable extension arm; (f) wherein: (i) the anvil is sized and shaped to not contact a workpiece, if the actuator is placed into the first operating state; (ii) the anvil is sized and shaped to contact a distal side of the workpiece, if the actuator is placed into the second operating state; (iii) the movable extension arm is sized and shaped so as to position the anvil at a nail receiving location on the distal side of the workpiece from where the nailer tool is positioned, such that when a nail is fired by the nailer tool, the nail will penetrate through the workpiece and then impact against the anvil; (iv) the anvil is movable between a first orientation and a second orientation, the first orientation occurring if the actuator is in the first operating state and the second orientation occurring if the actuator is in the second operating state; and (v) the flexible reach link provides a range of movement that allows the anvil to successfully contact a predetermined range of thicknesses of the workpiece.

In accordance with still another aspect, a clenching adapter for use with automatic portable nailer tools is provided, which comprises: (a) a base support that mounts to a nailer tool; (b) an actuator that causes mechanical movement during a nail firing sequence, the actuator being attached to the base support, the actuator having a proximal mounting location, and the actuator having a first operating state and a second operating state; (c) a movable extension arm which extends from the proximal mounting location of the actuator to a distal end of the extension arm; and (d) an anvil that is mounted proximal to the distal end of the movable extension arm; (e) wherein: (i) the anvil is sized and shaped to not contact a workpiece, if the actuator is placed into the first operating state; (ii) the anvil is sized and shaped to contact a distal side of the workpiece, if the actuator is placed into the second operating state; (iii) the movable extension arm is sized and shaped so as to position the anvil at a nail receiving location on the distal side of the workpiece from where the nailer tool is positioned, such that when a nail is fired by the nailer tool, the nail will penetrate through the workpiece and then impact against the anvil; and (iv) the anvil is movable between a first orientation and a second orientation, such that: (A) if the anvil is not in contact with the distal side of the workpiece, then the anvil is maintained in the first orientation and exhibits a first cross-section footprint that is relatively small and allows the anvil to pass through a gap between two adjacent members of the workpiece; and (B) if the anvil contacts the distal side of the workpiece, then the anvil is transitioned to the second orientation and now exhibits a second cross-section footprint that is significantly larger and will not allow the anvil to pass through the gap, but when in the second orientation the anvil is sized and shaped to receive the nail that is fired by the nailer tool, and to cause the nail to be curled, such that the workpiece becomes clenched after the nail becomes curled.

In accordance with a further aspect, a clenching adapter having a support structure for mounting to an external fastener driving tool is provided, the clenching adapter comprising: (a) a first actuator that causes mechanical movement during a fastener firing sequence, the first actuator having a mounting location proximal to a support structure, and the first actuator having a first operating state and a second operating state; (b) a movable extension arm which extends from the first actuator to a distal end of the extension arm; and (c) an anvil that is mounted proximal to the distal end of the movable extension arm; (d) wherein: (i) the anvil is sized and shaped to not contact a workpiece, if the first actuator is placed into the first operating state; (ii) the anvil is sized and shaped to contact a distal side of the workpiece, if the first actuator is placed into the second operating state; (iii) the movable extension arm is sized and shaped so as to position the anvil at a fastener receiving location on the distal side of the workpiece from where the support structure is positioned, such that when a fastener is fired by an external fastener driving tool, the fastener will penetrate through the workpiece and then impact against the anvil; and (iv) the anvil is movable between a first orientation and a second orientation, such that: (A) if the first actuator is in the first operating state, then the anvil is maintained in the first orientation and exhibits a first cross-section footprint that is relatively small and allows the anvil to pass through a gap between two adjacent members of the workpiece; and (B) if the first actuator is in the second operating state, then the anvil is transitioned to the second orientation and now exhibits a second cross-section footprint that is larger and will not allow the anvil to pass through the gap, but when in the second orientation the anvil is sized and shaped to receive the fastener that is fired by an external fastener driving tool, and to cause the fastener to be curled, such that the workpiece becomes clenched after the fastener becomes curled.

In accordance with a yet further aspect, a clenching adapter having a support structure for mounting to an external fastener driving tool is provided, the clenching adapter comprising: (a) a first actuator that causes mechanical movement during a fastener firing sequence, the first actuator having a mounting location proximal to a support structure, and the first actuator having a first operating state and a second operating state; (b) a movable extension arm which extends from the first actuator to a distal end of the extension arm; (c) an anvil that is mounted proximal to the distal end of the movable extension arm; and (d) an extendable link that is mounted proximal to the movable extension arm; (e) wherein: (i) the anvil is sized and shaped to not contact a workpiece, if the first actuator is placed into the first operating state; (ii) the anvil is sized and shaped to contact a distal side of the workpiece, if the first actuator is placed into the second operating state; (iii) the movable extension arm is sized and shaped so as to position the anvil at a fastener receiving location on the distal side of the workpiece from where an external fastener driving tool is positioned, such that when a fastener is fired by an external fastener driving tool, the fastener will penetrate through the workpiece and then impact against the anvil; (iv) the anvil is movable between a first orientation and a second orientation, the first orientation occurring if the first actuator is in the first operating state and the second orientation occurring if the first actuator is in the second operating state; and (v) the extendable link provides a range of movement that allows the anvil to successfully contact a predetermined range of thicknesses of the workpiece.

In accordance with a still further aspect, a clenching adapter having a support structure for mounting to an external fastener driving tool is provided, the clenching adapter comprising: (a) a first actuator that causes mechanical movement during a fastener firing sequence, the first actuator having a mounting location proximal to a support structure, and the first actuator having a first operating state and a second operating state; (b) a movable extension arm which extends from the first actuator to a distal end of the extension arm; and (c) an anvil that is mounted proximal to the distal end of the movable extension arm; (d) wherein: (i) the anvil is sized and shaped to not contact a workpiece, if the first actuator is placed into the first operating state; (ii) the anvil is sized and shaped to contact a distal side of the workpiece, if the first actuator is placed into the second operating state; (iii) the movable extension arm is sized and shaped so as to position the anvil at a fastener receiving location on the distal side of the workpiece from where an external fastener driving tool is positioned, such that when a fastener is fired by the an external fastener driving tool, the fastener will penetrate through the workpiece and then impact against the anvil; and (iv) the anvil is movable between a first orientation and a second orientation, such that: (A) if the anvil is not in contact with the distal side of the workpiece, then the anvil is maintained in the first orientation and exhibits a first cross-section footprint that is relatively small and allows the anvil to pass through a gap between two adjacent members of the workpiece; and (B) if the anvil contacts the distal side of the workpiece, then the anvil is transitioned to the second orientation and now exhibits a second cross-section footprint that is larger and will not allow the anvil to pass through the gap, but when in the second orientation the anvil is sized and shaped to receive the fastener that is fired by an external fastener driving tool, and to cause the fastener to be curled, such that the workpiece becomes clenched after the fastener becomes curled.

Still other advantages will become apparent to those skilled in this art from the following description and drawings wherein there is described and shown a preferred embodiment in one of the best modes contemplated for carrying out the technology. As will be realized, the technology disclosed herein is capable of other different embodiments, and its several details are capable of modification in various, obvious aspects all without departing from its principles. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the technology disclosed herein, and together with the description and claims serve to explain the principles of the technology. In the drawings:

DETAILED DESCRIPTION

Figure 1:
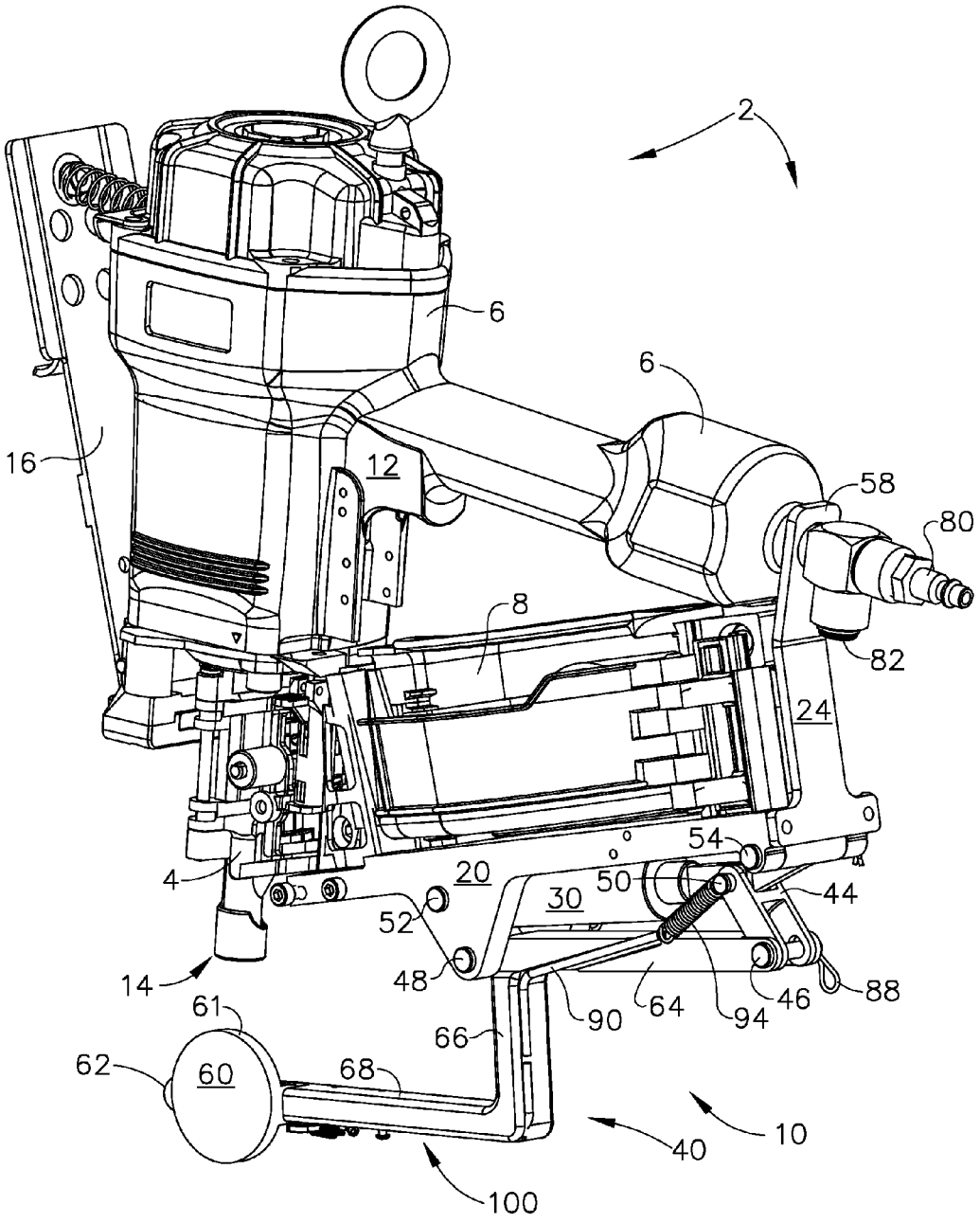
FIG. 1 is a perspective view of a portable automatic nailer having a clenching adapter mounted thereto for curling nails, as constructed according to the principles of the technology disclosed herein.

Reference will now be made in detail to the present preferred embodiment, an example of which is illustrated in the accompanying drawings, wherein like numerals indicate the same elements throughout the views.

It is to be understood that the technology disclosed herein is not limited in its application to the details of construction and the arrangement of components set forth in the following description or illustrated in the drawings. The technology disclosed herein is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

The terms "first" and "second" preceding an element name, e.g., first inlet, second inlet, etc., are used for identification purposes to distinguish between similar or related elements, results or concepts, and are not intended to necessarily imply order, nor are the terms "first" and "second" intended to preclude the inclusion of additional similar or related elements, results or concepts, unless otherwise indicated.

Referring now to FIG. 1, a coil nailer tool is illustrated, generally depicted by the reference numeral 2. Nailer tool 2 includes a guide body 4, a main body 6, and a canister portion 8 for holding a flexible strip of collated nails. (It will be understood that collated nails can be supplied either in a flexible strip, or in a rigid strip, depending on the manufacturer of the tool. Many such nail clusters are placed into a magazine in other tools; the words "magazine" and "canister" both refer to devices that hold collated nails.) With certain modifications, the nailer tool 2 is similar to one sold by Senco Brands, Inc. of Cincinnati, Ohio, under the model number SCN60. A clenching adapter is mounted to nailer tool 2, in which the adapter is generally depicted by the reference numeral 10.

The remaining description of the nailer tool 2 with adapter 10 applies to each drawing in the range FIGS. 1-5. A cylinder support base structure 20 is mounted to the "bottom" of the nailer, and has two attachment points: the point 56 mounts to the guide body 4, and the point (or bracket) 58 mounts to the main tool body 6. The support base 20 remains stationary with respect to the tool 2. Support base 20 also has pivotable mounting points at 52 and 54, for other members that are part of the adapter 10. There also is a support structure 22 that is attached to the base 20. The support base 20 is supported against the tool body by a mounting screw or bolt at 56, and by a rear support bracket 24 that extends up to the mounting bracket at 58.

There is a separate air-operated cylinder 30, which mounts to a rear clevis 32 at mounting point 52, and which mounts to a rod clevis 36 at a mounting point 50. The cylinder's extension rod 34 either pushes or pulls against a pair of toggle links 42 and 44, at the pivotable mounting point 50. Depending upon which operating state the nailer tool is in, the geometry of the two toggle links 42 and 44 will be a straight line (see FIG. 3) which is the extended state of the cylinder (and is the "clenching state" of the overall system), or the geometry will be angled (see FIG. 2) which is the retracted (non-clenching) state of the cylinder. An opening 38 is formed in the cylinder support base 20, to provide clearance that allows the second toggle link 44 to pivot, when the tool is in its retracted (non-clenching) state. The first toggle link 42 also pivots when the tool is in its retracted state. It will be understood that an air line (not shown) is connected to the clench cylinder 30, and that the actuation of cylinder 30 is controlled by a hand-operated safety arm 16 that is attached to the guide body 4.

Figure 4:
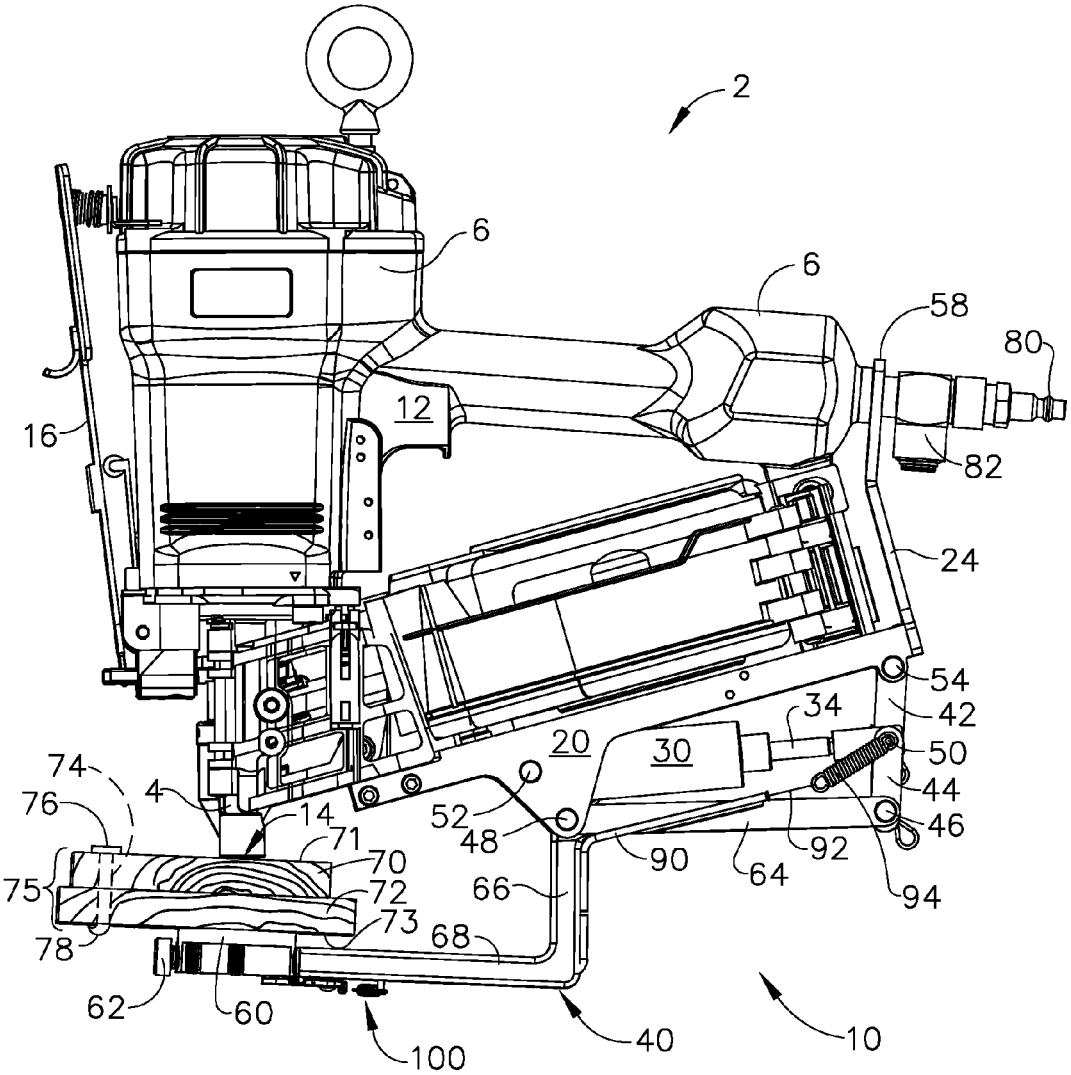
FIG. 4 is a side elevational view of the automatic nailer with clenching adapter of FIG. 1, in which the clenching adapter is in its extended (or "clenched") state, illustrating how the tool is positioned with respect to a workpiece.

The adapter 10 also has a clench extension arm subassembly 40 that extends from a pivot point 46 toward a second mounting (and pivotable) point at 48, and further extends toward a distal end 62. An anvil 60 is mounted to the clench extension arm 40, at its distal end 62. Essentially, the clench extension arm 40 runs from a proximal mounting location at 46 to the distal end at 62. The anvil 60 and its actuating mechanism is described below in greater detail, and is illustrated in FIGS. 6, 8, 9, and 10. The size and shape of the clench extension arm 40 allows a human user to position the anvil 60 directly under the workpiece, before firing the nail. When the nail is fired, it will first penetrate through the workpiece, and the nail's sharp tip will then strike the anvil 60, which receives the nail and tends to bend its tip portion into a curl shape. FIG. 4 illustrates some of this.

The combination of the cylinder support base 20, the cylinder 30, the two toggle links 42 and 44, and the clench extension arm 40 make up an "extending structure" that is relatively light weight, but yet is strong enough to withstand the mechanical grasping forces and shock forces that are encountered for this engineering application. It is important to make the clench link of a sufficient length from its proximal end at the pivot point 46 to its distal end 62, so that it extends below the workpiece without interfering with that workpiece, but at the same time it must extend to the correct location so as to have the anvil 60 positioned directly in the path of the nail when it is fired by the nailer tool 2. The anvil material should be hardened, since its upper surface (in these views) will be directly impacted by the sharp tips of the nails as they penetrate the (typically wood) substrates of the workpiece. In essence, the anvil will be subjected to the role of armor plate, attempting to deflect a bullet.

Referring now to FIG. 4, a two-layer workpiece is positioned between the bottom end of the guide body 4 and the top surface of the anvil 60. In FIG. 4, the workpiece 75 comprises two wood boards 70 and 72. The upper surface 71 of board 70 is held against the muzzle of the tubular guide body 4, and the lower surface 73 of board 72 is held against the upper surface of the anvil 60. The upper surface 71 can be referred to as the "proximal side" of the workpiece 75 (nearer to the main portion of the nailer tool 2), while the lower surface 73 can be referred to as the "distal side" of the workpiece 75. The nailer tool is designed so that a single actuation of the two-handed safety lever 16 will first actuate the clenching system's cylinder 30 before allowing the nail to be fired. When fully actuated by a human user, the clenching system 10 will hold the nailer tool in place against the workpiece while the nail is fired.

In FIG. 4, a previously-driven nail is depicted at 74, and has penetrated through both wood boards 70 and 72. The head 76 of the nail is flat against the upper surface 71 of board 70, while the tip of the nail has been curled (at 78) against the bottom surface 73 of board 72. This established a clenching action that is desired. If, for example, a nail is not properly curled, then its tip (perhaps blunted) will usually stick out straight from the bottom surface 73, while the nail's head will not be driven all the way to the top surface 71, thereby leaving the nail proud. Such a non-curled nail of course is an undesirable result, since there will be no clenching effect for holding the two boards together. When using chisel-tip nails, which are preferred in this embodiment, a non-curled nail should be a very rare result.

Figure 5:
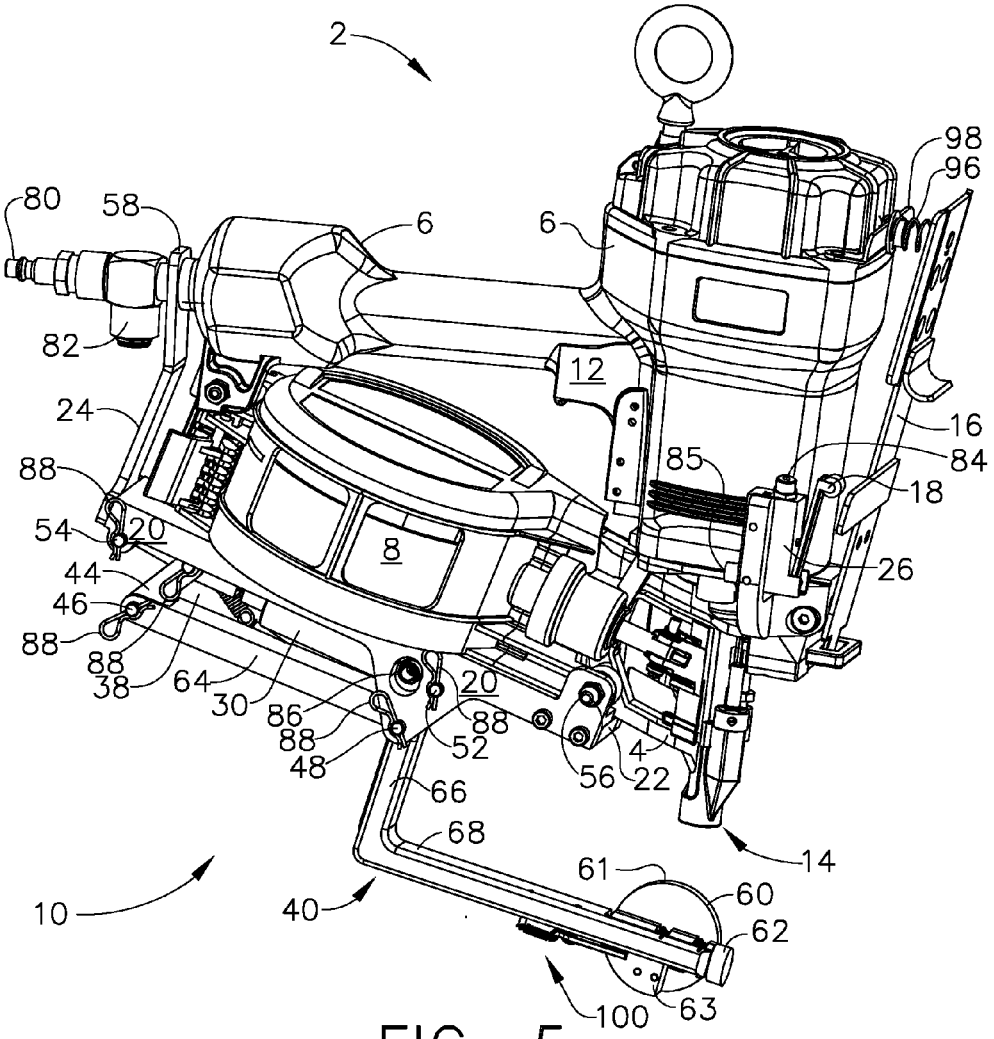
FIG. 5 is a side elevational view of the automatic nailer with clenching adapter of FIG. 1, showing the nailer from its right-hand side, in which the clenching adapter is in its retracted (or "relaxed") state.

Referring now to FIG. 5, the nailer tool 2 is depicted from the opposite side as that of FIG. 1. FIG. 1 was from the "left-hand side" while FIG. 5 is from its "right-hand side." In this view, the canister 8 is clearly visible, as well as some of the details of the safety arm 16. The safety arm 16 is provided to require the operator to use both hands (for a "two-handed operation"), and when safety arm 16 is actuated, it pushes against a clench valve actuation lever 18, which will change the state of a clench valve 26. Near the top of the tool at the safety arm is a safety spring 96 and its spring retainer 98, which is a post that holds the safety spring in place. Safety spring 96 provides an automatic spring return to reset the tool after the operator releases the safety arm 16.

The operator must use one hand on the trigger 12 and the other hand on the safety arm 16 to fire a fastener. Pressurized air is brought into the tool 2 via one of the air fittings 80 or 82. An air hose (not shown) takes this pressurized air over to the clench valve 26 at one of its input fittings, such as the air fitting 84. When the clench valve 26 changes state, pressurized air will travel through its output port (not shown) through another air hose (not shown) to an air fitting 86. The valve's vent is at port 85. The air port 86 then pressurizes the clenching air cylinder 30 and causes it to actuate. When that occurs, the clench extension arm subassembly 40 will then go into its extended mode to move the extension arm 40 to its clenching position.

In FIGS. 1-5, the overall shape of the clench extension arm 40 is easy to see. Its main shape is that of a large "Z" which is made up of three clench extension arm members 64, 66, and 68. The Z-shape of the extension arm 40 exhibits angles (approximately 90-degree right-angles) that provide a near-maximum extension reach. The first member 64 is at the proximal end of the clench extension arm, and mounts to the toggle link 44 at a pivot pin 46. The first (proximal) member 64 runs between that pivot point and another pivot pin at a point 48. Pivot pin 48 is fixed with respect to the support base 20, however, pivot pin 46 can move somewhat up or down, while rotating about the pivot point 48. The second member 66 is the middle member of the clench extension arm 40, and runs from the pivot pin 48 down to an "L" angle where the second member ends and the third member 68 begins. The third member 68 is the distal member of the clench extension arm and runs from the L-shaped angle to the distal end 62. The anvil 60 is located near or at the distal end 62.

In the opposite side view of FIG. 5, it can be seen that most of the pivot pins are held in place by cotter pins 88. These cotter pins are provided for ease of disassembly and re-assembly, as needed in the field. They can be replaced by other types of fasteners, such as shoulder bolts, if desired. There are cotter pins associated with pivot pins 46, 48, 50, 52, and 54, as can be seen on FIG. 5. FIG. 5 also shows the "back-side" portion near the anvil 60, which will be described in more detail below.

FIGS. 1-5 also show some of the details of an actuating cable 92 and a tubular housing 90 through which the actuating cable 92 runs. There also is a "high-load spring" 94 that the actuating cable 92 attaches to. In addition, there is an anvil actuator subassembly 100 located near the distal end 62 along the third (distal) member 68 of the extension arm 40. Anvil actuator subassembly 100 also includes a spring (see below). The "high-load spring" 94 has been given that name simply because it undergoes greater loading than the spring in the anvil actuator subassembly 100.

The actuating cable 92 in this embodiment is a "pull" cable, and is associated with a tensioning spring 94. (The spring 94 takes up excess travel of the air cylinder 30.) The cable 92 is a flexible mechanical cable, used only for producing a pulling motion. It will be understood that alternative embodiments could, for example, use a "push-pull" more rigid cable without a return spring (to induce both tension and compression movements), or perhaps an additional air cylinder to actuate the rotatable anvil 60. Yet another alternative embodiment could provide a rotary air valve having a rotational output that could cause the anvil to pivot, without need for a linear-to-rotary travel conversion device, such as a cam; however, it must be kept in mind that the clenching extension arm must be made to fairly small dimensions, or it will not be useful in reaching into and through relatively small gaps between top deckboards in pallets, for example.

Figure 2:
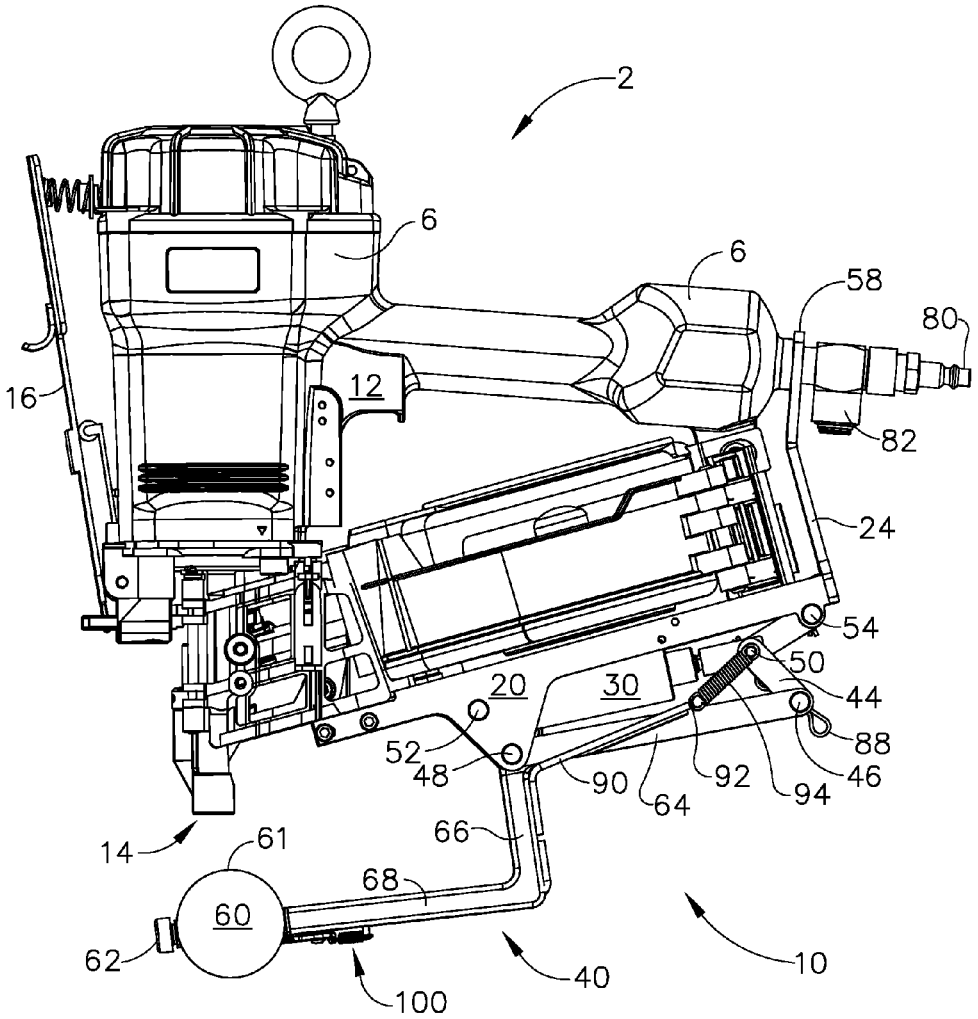
FIG. 2 is a side elevational view of the automatic nailer with clenching adapter of FIG. 1, showing the nailer from its left-hand side, in which the clenching adapter is in its retracted (or "relaxed") state.

Referring now to FIG. 2, it can be seen that the high-load spring 94 is in a relaxed state, and that the clenching mechanism as well as the clench extension arm 40 itself are all in a relaxed, non-clenching state. The actuating cable 92 is under its minimum tension load in this operating state.

Figure 3:
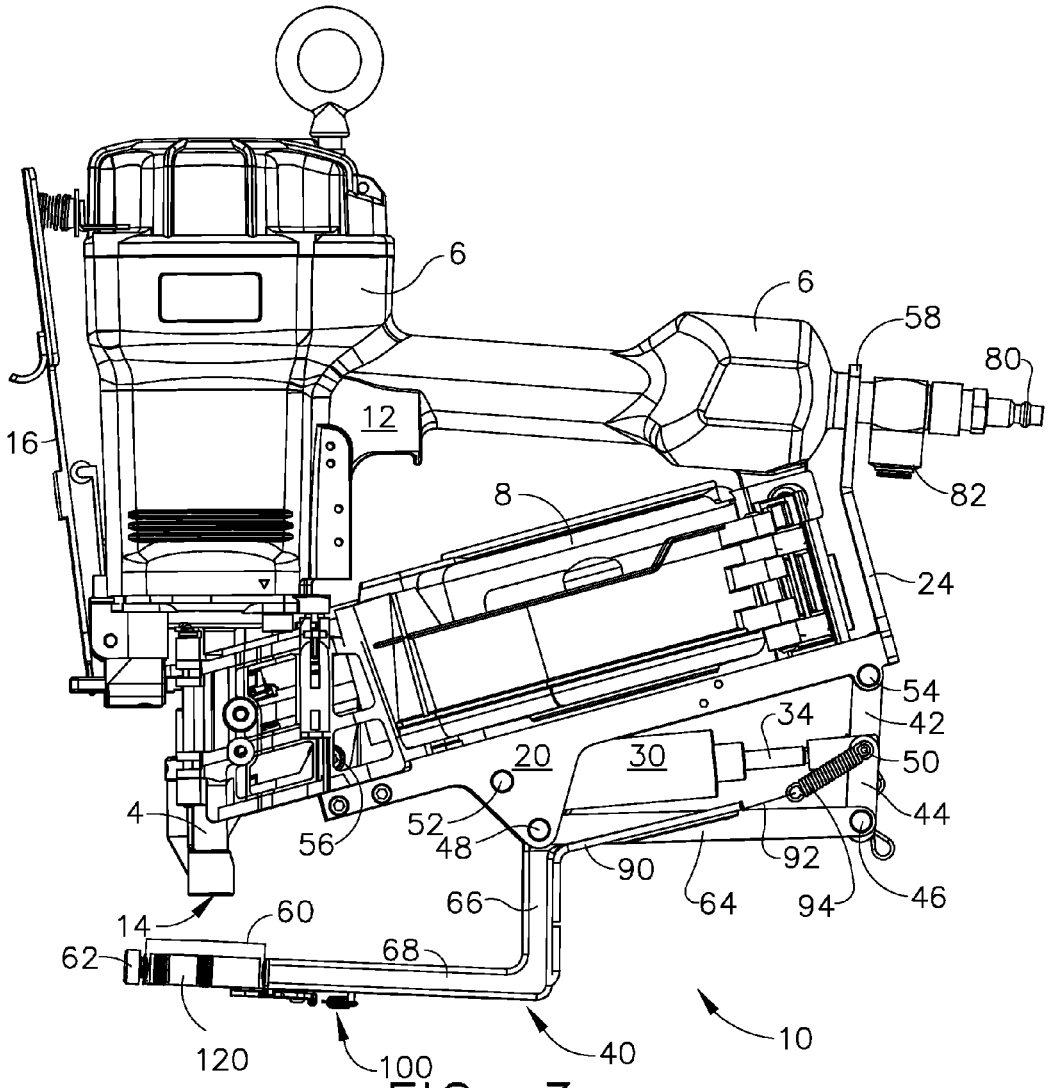
FIG. 3 is a side elevational view of the automatic nailer with clenching adapter of FIG. 1, in which the clenching adapter is in its extended (or "clenched") state, ready for firing a nail.

Referring now to FIG. 3, the high-load spring 94 is now being stretched because it is under a tension load, and the actuating cable 92 is more exposed from the end of the tubular housing 90, as compared to the view of FIG. 2 when the mechanism was relaxed. FIG. 3 is the clenching (or extended) operating state of the clench extension arm 40. The clench air cylinder 30 has been actuated, and the air cylinder rod 34 has extended, thereby pushing the pivot pin 50 away from the air cylinder 30. This causes the two toggle links 42 and 44 to now line up in a substantially co-linear geometry, as can be clearly seen on FIG. 3. When all of this occurs, the actuating cable 92 is pulled to the right (as viewed on FIG. 3) and that actuates the anvil actuator subassembly 100 and causes the anvil 60 to rotate 90 degrees.

The flat surface of anvil 60 is now facing the front end of the tool at 14, and is prepared to receive a nail that will be shot by the tool 2 through a target workpiece. That clenching effect is better seen FIG. 4, where the two wood boards 70 and 72 have been placed between the front end of the tool at 14 and the upper surface of the anvil 60. Of course, it is the anvil and the exit end (at the front end 14) where the fastener is fired that must be brought to the proper location of a target workpiece and then pressed against the surfaces 71 and 73 of these two pieces of wood. Once in the extended position, which is sometimes referred to herein as the "clenching position," then the nail will be fired by the tool 2.

There are two mechanisms in the clench adaptor 10 that provide some "play" in the mechanism to allow for variations in the thickness of the target boards. In general terms, these two expandable mechanisms involve the anvil actuator subassembly 100 and the toggle link 44. The devices will now be discussed in detail, in connection with FIGS. 6-13.

Figure 6:
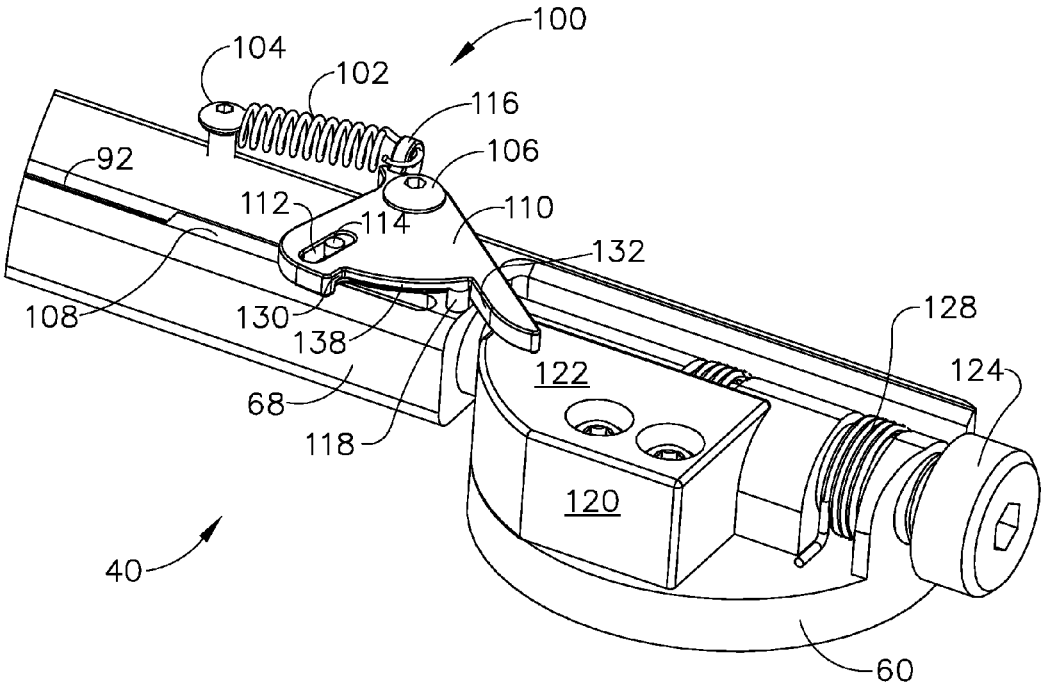
FIG. 6 is a magnified, perspective view showing the details of the cam operating mechanism that rotates the anvil for the nailer tool of FIG. 1.
Figure 7B:
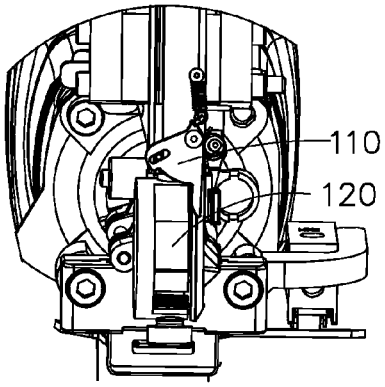
FIG. 7, consisting of four views, is a side, elevational view of the nailer tool of FIG. 1, showing: the entire tool with the clenching adapter in its retracted (relaxed) state in FIG. 7A; showing a magnified view of the distal end of the clenching adapter in its retracted (relaxed) state in FIG. 7B; showing the entire tool with the clenching adapter in its extended (clenched) state in FIG. 7C; and showing a magnified view of the distal end of the clenching adapter in its extended (clenched) state in FIG. 7D.
Figure 7D:
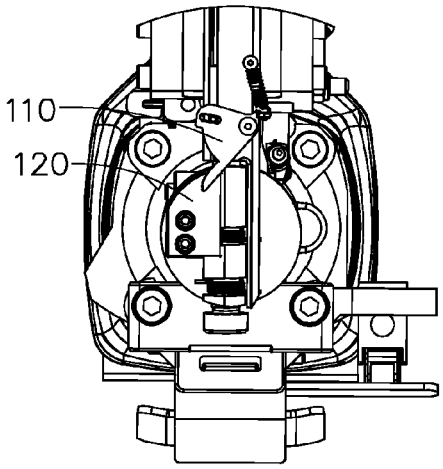
Figure 7A:
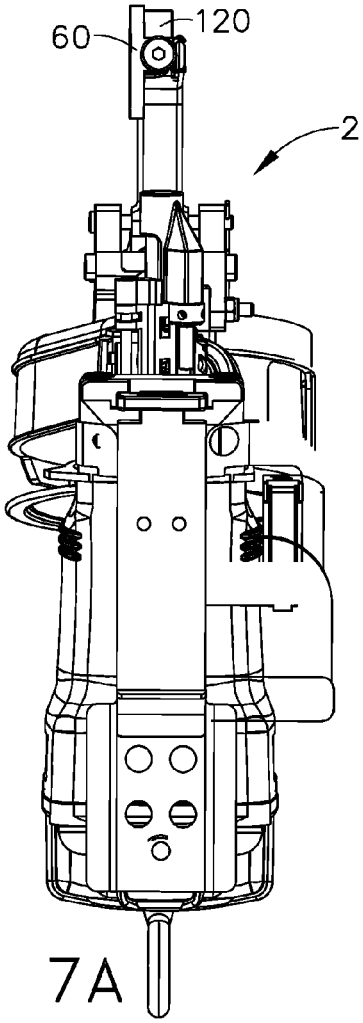
Figure 7C:
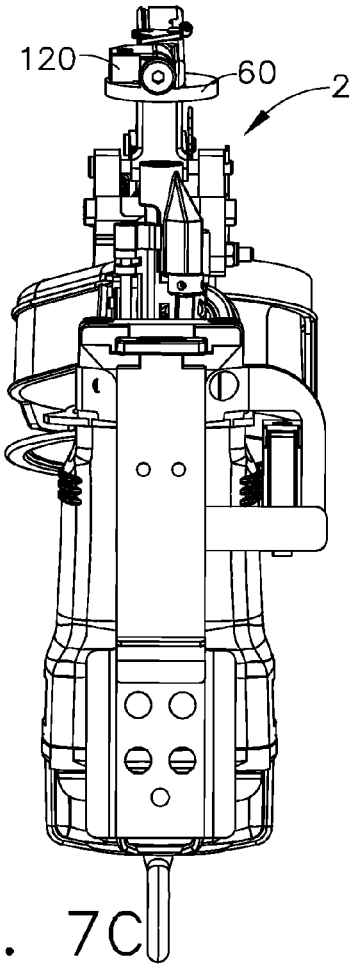

Referring now to FIG. 6, a back-side view of the anvil portion of the clench extension arm 40 is seen in greater detail. In FIG. 6, the anvil actuator subassembly 100 is illustrated in its actuated (or "clenching") operating position. The anvil actuator subassembly includes a cam return spring 102, a spring anchor 104, a mounting screw 106 which also acts as the pivot point for a pivotable cam 110. There is a slideable control member 108 that is made from a metallic material such as bronze for durability and strength, and this control member 108 slides along a longitudinal slot in the distal third member 68 of the clench extension arm 40. The control member 108 also has an L-angle shape that extends upward (in this view of FIG. 6) and creates an extension cam actuator 114. This has the effect of a "pin" that is movable within a radial cam slot 112. The actuating cable 92 is attached to control member 108, and when in the clenching (actuated) operating state, the extension pin 114 tends to pull the pivotable cam 110 toward the proximal end of the clench extension arm 40. Because of the pivoting action about the pivot point 106, and because of a cam limiter pin 118 (which rides in a hidden groove or slot—see below), the cam 110 rotates and ends up in the position depicted in FIG. 6 when the clench mechanism is in its extended, clenching operating state.

The rotational movement of the cam 110 causes the anvil 60 to rotate 90 degrees, as will be discussed immediately below. The cam limiter pin 118 acts as a guide pin in a curved, blind slot 136 (see FIG. 9). This blind slot is open from below, as viewed in FIG. 6, so it cannot be seen in this view. However, it is shaped along the curved surface 138; see FIG. 9. Therefore, the curved groove (or slot) 136 is blind on FIG. 6, but it should be noted that the cam limiter pin 118 fits within that curved groove. A first cam surface 130 acts as a "rest" surface, while a second cam surface at 132 acts as the "full travel" surface. These are the two minimum and maximum positions of travel for the cam 110 with respect to the cam limiter pin 118.

On the back side of the anvil 60 is a cam block 120, which in one mode of this embodiment is made of a nylon material. The cam block 120 has a "sliding cam surface" at 122, which will contact another sliding surface on the cam 110 to create an actuating area or interface at 134 (see FIGS. 8 and 9 for the locations of this interface area 134). It is this interface 134 that causes the anvil 60 to rotate 90 degrees when the cam 110 is rotated by the movement of the actuating cable 92.

Other details depicted on FIG. 6 include a torsion spring 128 and a mounting bolt 124 that hold the anvil 60 in its rotatable (or pivotable) position with respect to the distal member 68 of the clench extension arm. The cam return spring 102 is anchored on one end by a spring anchor 104, and by a second spring anchor 116 on its opposite end.

Figure 10:
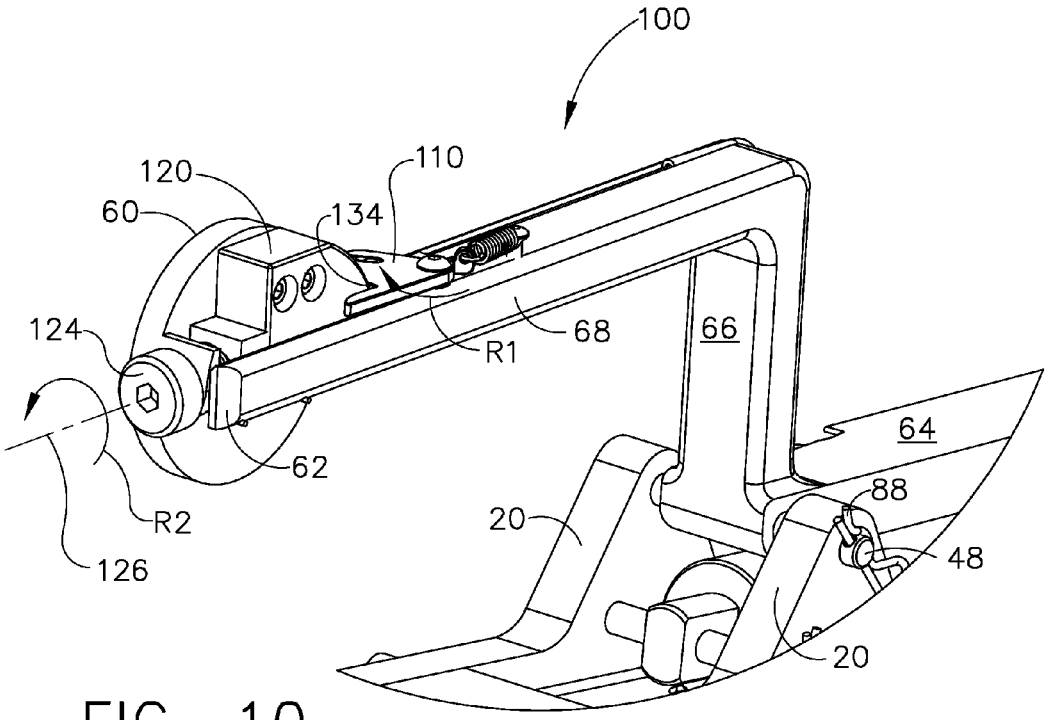
FIG. 10 is a perspective view of the distal end of the clenching extension arm for the nailer tool of FIG. 1 from above and from its end, showing the geometric relationship between the centerline of the distal link (of the extension arm subassembly) and the pivotable cam block, and the pivotable cam.

Referring now to FIG. 10, the geometry of the anvil rotational system can now be seen. The cam at 110 contacts the cam block 120 at the actuation interface 134, as noted above. In FIG. 10, the cam is at its relaxed or non-clenching operating state. When the cam 110 is actuated, it will be forced to rotate in the direction of the arrow "R1" which forces the cam block 120 to "move" to the left (as seen in the view of FIG. 10). However, cam block 120 cannot simply displace to the left, but because of its geometric position above (in FIG. 10) the bolt 124, it can be rotated about the centerline 126 of the mounting bolt 124. The entire anvil 60 and cam block 120 subassembly is pivotable about this rotation axis 126 and can rotate in the direction depicted by "R2", which is counter-clockwise in this view of FIG. 10.

Figure 8:
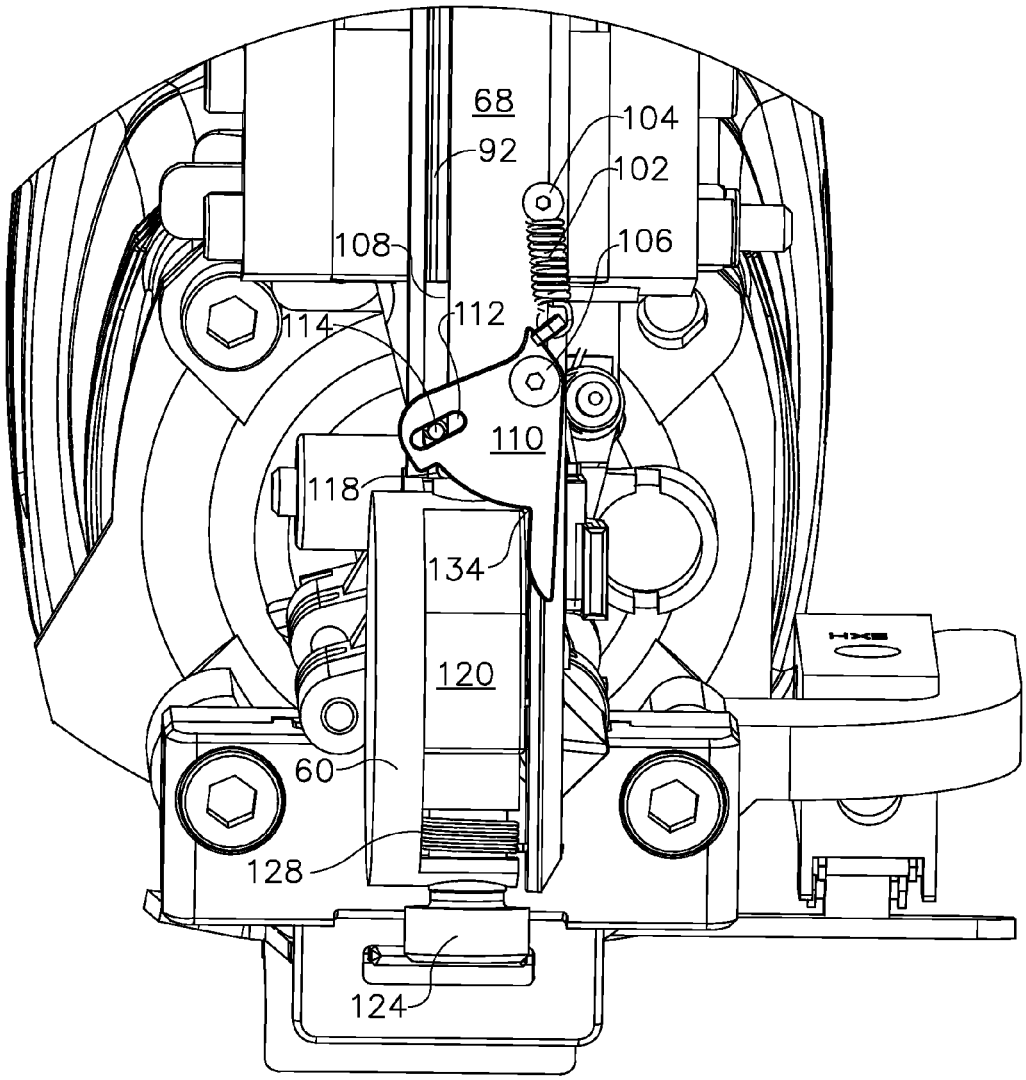
FIG. 8 is a magnified side, elevational view of the distal end of the clenching extension arm for the nailer tool of FIG. 1, showing the anvil and its cam operated rotating mechanism in its retracted (relaxed) state.
Figure 9:
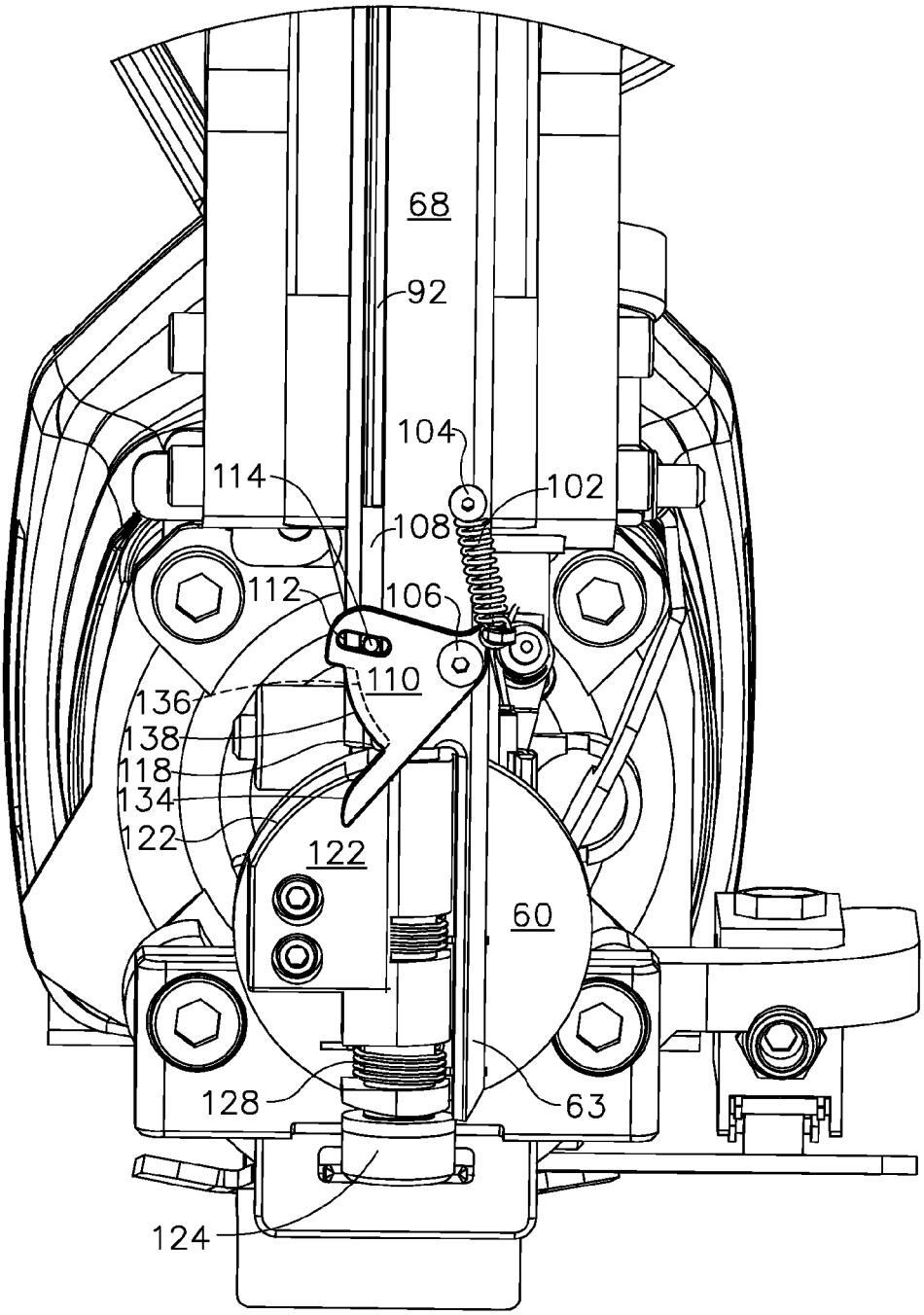
FIG. 9 is a magnified side, elevational view of the distal end of the clenching extension arm for the nailer tool of FIG. 1, showing the anvil and its cam operated rotating mechanism in its extended (clenched) state.

FIGS. 7, 8, and 9 show additional details of the two operating states of the tool 2 and the clench adaptor 10. FIG. 8 shows the location of the actuation interface 134 when the clench mechanism is in its relaxed state, and in this operating state, the cam 110 has not been rotated because the cable 92 has not been pulled toward the proximal end of the extension arm. Therefore, the pin 114 (which is part of the control member 108) is also in its relaxed state within the slot 112 of the cam 110. The anvil 60 is depicted showing its circumference along its side (or edge) facing the viewer on FIG. 8, and it is in its relaxed state except for the spring force provided by the torsion spring 128, which acts as a return spring for the pivotable anvil 60. Now compare this drawing to FIG. 9, in which the actuation cable 92 has been actuated, thereby pulling the control member 108 upward (on this view of FIG. 9) and causing the extension or cam actuator pin 114 to pull the cam 110 into its rotatable position as seen on FIG. 9. The blind curved groove 136 is viewed in FIG. 9, and the cam limiter pin 118 is now forced against the full travel surface or "stop" at 132. The location of the cam actuation interface 134 has now moved and has forced the cam block 120 to be displaced to the left on FIG. 9, which means that it has been rotated. Therefore, the anvil flat surface is now facing away from the viewer of FIG. 9, and is facing toward the nail that now can be fired by the tool.

Figure 11:
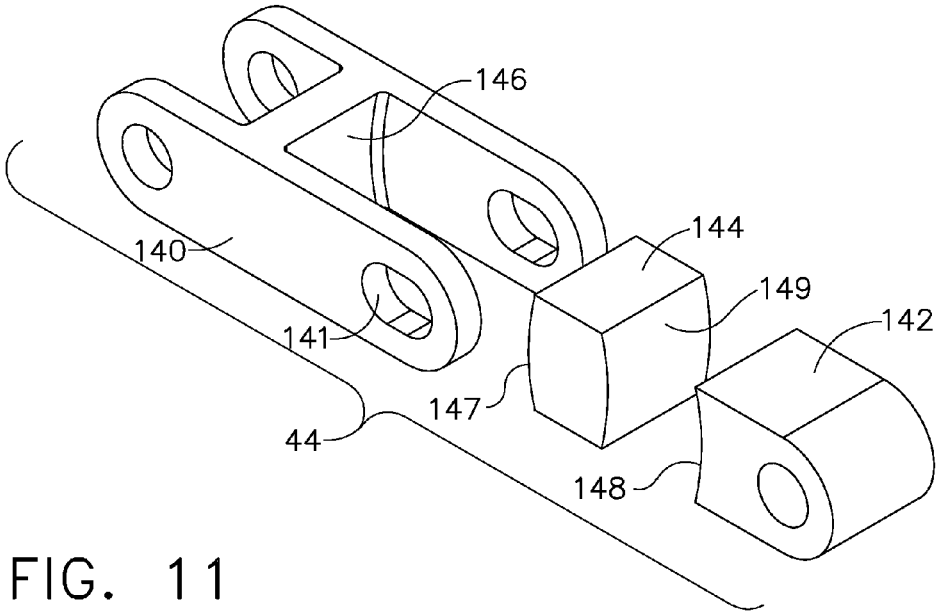
FIG. 11 is an exploded view of the major components of an expandable link member that can adjust dimensionally, used in the clenching adapter of FIG. 1.

Referring now to FIG. 11, the three major components of the expandable toggle link 44 are illustrated. There is an outer link 140, a sliding link 142, and a compression member 144. The compression member in one embodiment is made of a rubber block material. There is a first contoured surface 146 in the outer link 140, that mates against a similar contoured surface 147 of the compression member. There is a second contoured surface 148 in the sliding link 142, that mates against a second contoured surface 149 of the compression member 144. The contoured surfaces 146, 147 and 148, 149 are designed to allow this toggle link subassembly to work linearly, and these curved surfaces 146, 147, 148, 149 tend to prevent the compression member 144 from kicking out during operation.

Figure 12:
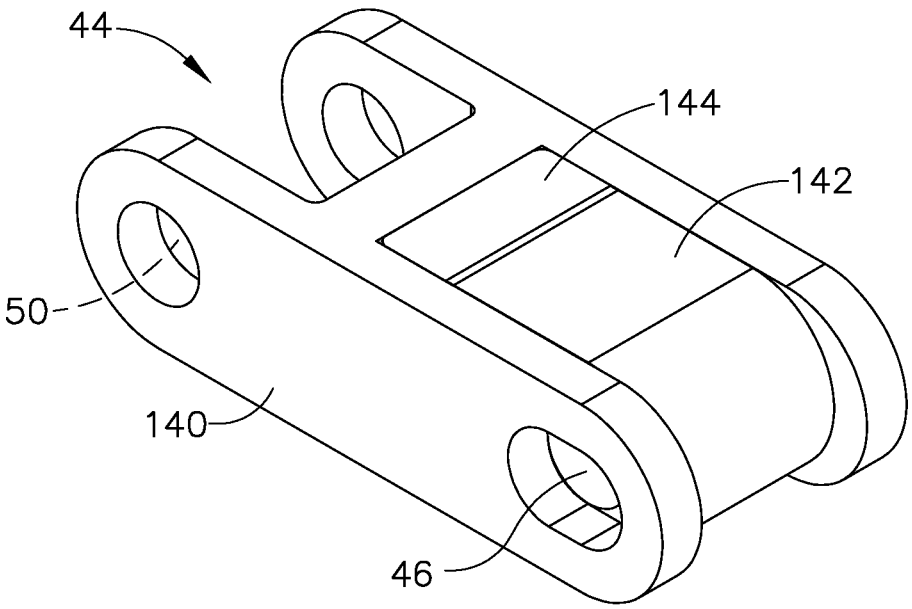
FIG. 12 is a perspective view of the expandable link member of FIG. 11, in its compressed (loaded) state (while clenching a "thickest target").

FIG. 12 illustrates these three components in a subassembly, which comprises the toggle link 44. FIG. 12 illustrates the toggle link in its compressed state, which is the state while the clenching adaptor 10 is being used to clench a target having a maximum thickness for this design. The pivot pin 46 is illustrated on FIG. 12, and an opening at 50 is shown on FIG. 12 which is where the pivot pin 50 would mount. This allows some additional play in case the wood boards are not of the exact thickness that night be desired. This will, of course, be a common operating condition, and hence the expandable toggle link 44 will have great utility for this overall device.

Figure 13:
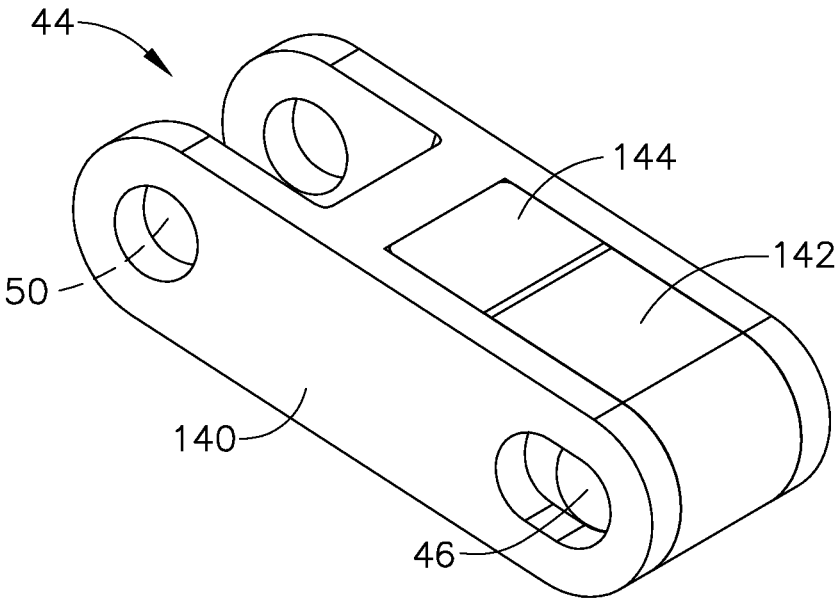
FIG. 13 is a perspective view of the expandable link member of FIG. 11, in its extended (unloaded) state.

FIG. 13 illustrates the same toggle link 44, but in this view, it is in its extended state. In this state, the toggle link 44 could be in a completely unloaded mechanical state, or it could be at least partially loaded (i.e., while the tool 2 in a clenched state) while being used with a target that is quite thin. The extendable link 44 can also be referred to as a "flexible reach link." The movement of the sliding link 142 along the slot 141 provides additional clamp thickness tolerance according to the available travel (limited by the slot's length) and the ratio of the lever extension arms 64 and 68.

The overall operation of the extending mechanism that causes the anvil to be pressed against the bottom of the target workpiece is actuated in two phases. The first phase rotates the anvil about 90 degrees. The second phase forces the (already rotated) anvil to be moved upward until it contacts the workpiece. This operating cycle could be performed by two separate manual movements, if desired. However, it is desired to have only a single manual movement be the impetus for both phases. The illustrated embodiment requires only a single manual impetus, although both hands are required, one for the trigger 12 and one for the safety lever 16. Both must be actuated before anything happens on the tool 2; once both are actuated together, the anvil is completely rotated automatically before the clench extension arm is fully moved to force the anvil upward and into contact with the workpiece. This preferably is a function of tool operation, not because of any particular actuation sequence or timing by the human operator.

Figure 14:
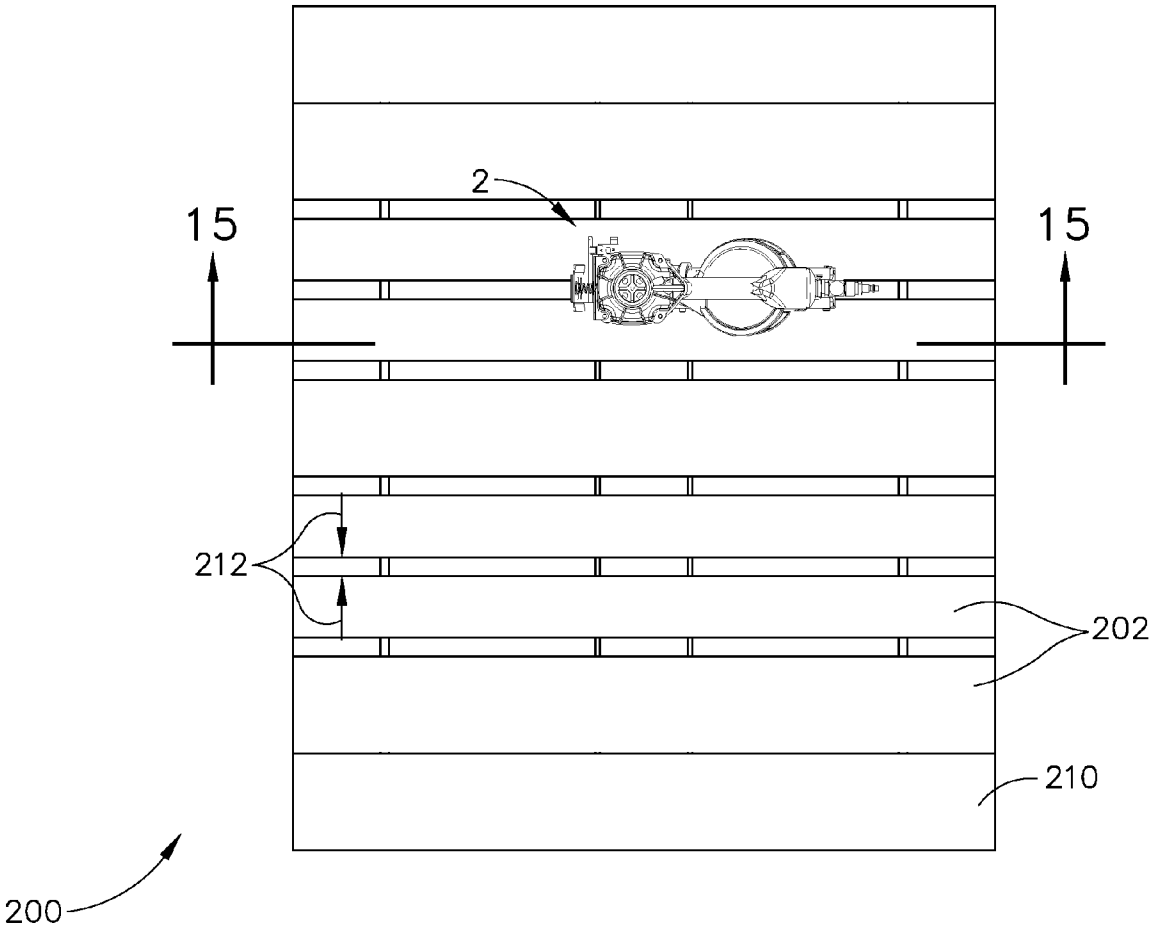
FIG. 14 is a top, plan view of a pallet with the portable automatic nailer and clenching adapter of FIG. 1 being held above the pallet in a position to allow the clenching extension arm to fit between two of the top deckboards, before an actuation sequence.

Referring now to FIG. 14, the nailer tool 2 is shown in an initial position above a pallet, which is generally designated by the reference numeral 200. This pallet is of normal construction, and includes a lead board 210, several top deckboards 202, and with some type of deck spacing at 212 between each pair of adjacent deckboards 202.

Figure 15:
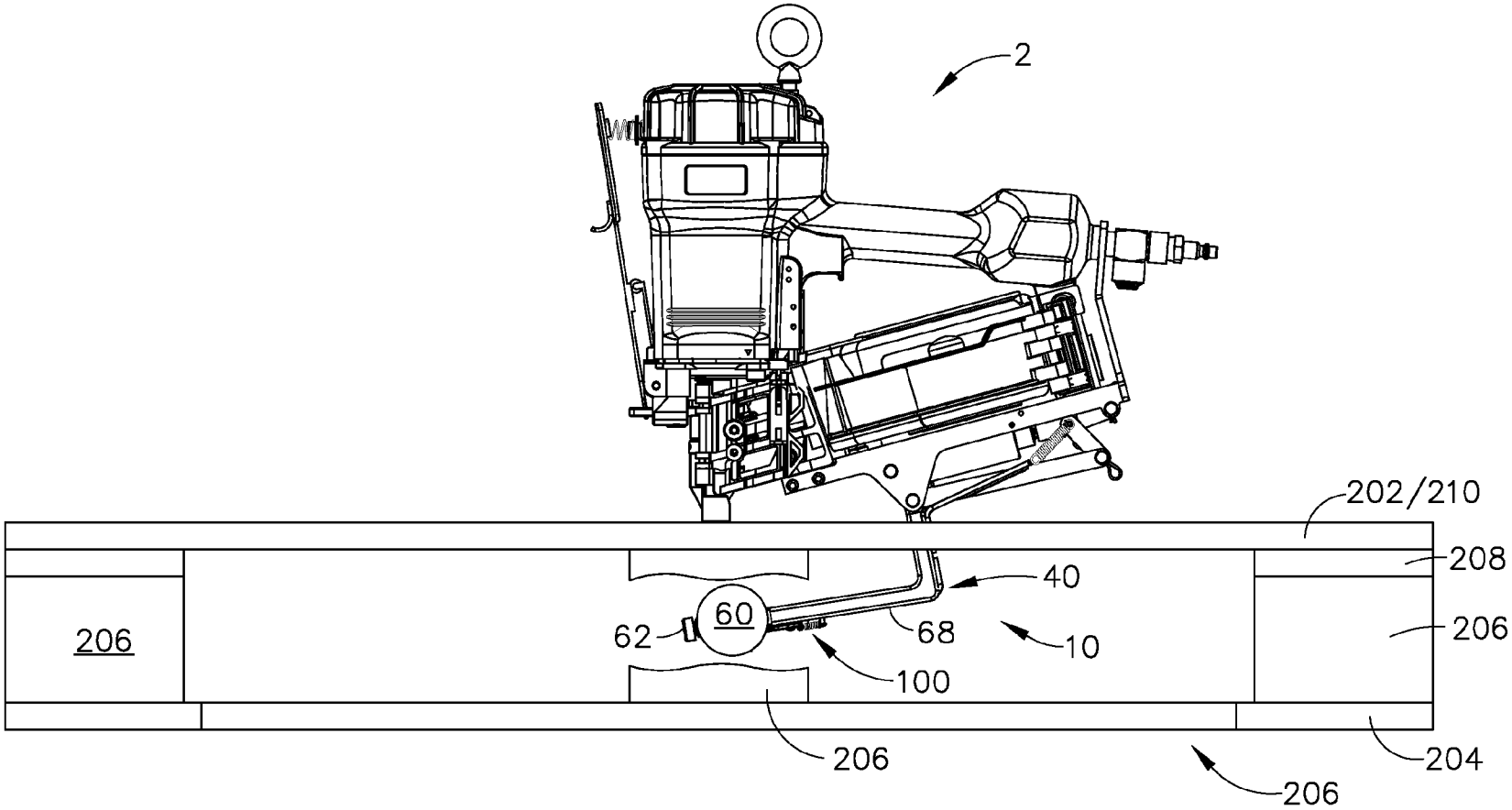
FIG. 15 is a side, elevational view in partial cross-section (taken along the line 15-15 in FIG. 14) of the pallet and portable automatic nailer with clenching adapter of FIG. 14, with the clenching extension arm in its relaxed (non-clenching) state.

Referring now to FIG. 15, this is the same orientation of the tool 2 with respect to the pallet 200 as was seen in FIG. 14, but from a side elevational view instead of from a top plan view. The view of FIG. 15 is in partial cross-section with respect to the pallet 200.

In FIG. 15, the top deckboard 202 and lead board 210 are at approximately the same physical height along the horizontal. (One is behind the other in this view.) There are vertical members in this side view, including a block 206, and a stringer board 208. The middle block member 206 is partially cut-away so as to make visible the clench extension arm 40 in its orientation beneath the top deckboard 202. As can be seen in this view, the clench arm is not in its extended (or "clenched") position, but instead has the anvil 60 facing the viewer. The distal member 68 is oriented so as to be sloped slightly downward (from right-to-left in this view), and its distal end 62 is at a lower elevation than the L-shaped elbow at the other end of the distal member 68. In this orientation, as shown on both FIGS. 14 and 15, the anvil 60 is much larger in diameter than the spacing dimension 212 between two of the top deckboards 202, yet it can fit within that deck spacing dimension 212. The anvil 60 is substantially circular in shape, and in one mode of this embodiment, it is approximately two inches in diameter. Once the anvil, and the distal portion of the clench extension arm 40, are moved below the top deckboard elevation, then the tool 2 can be rotated to the orientation seen in FIG. 16.

Figure 16:
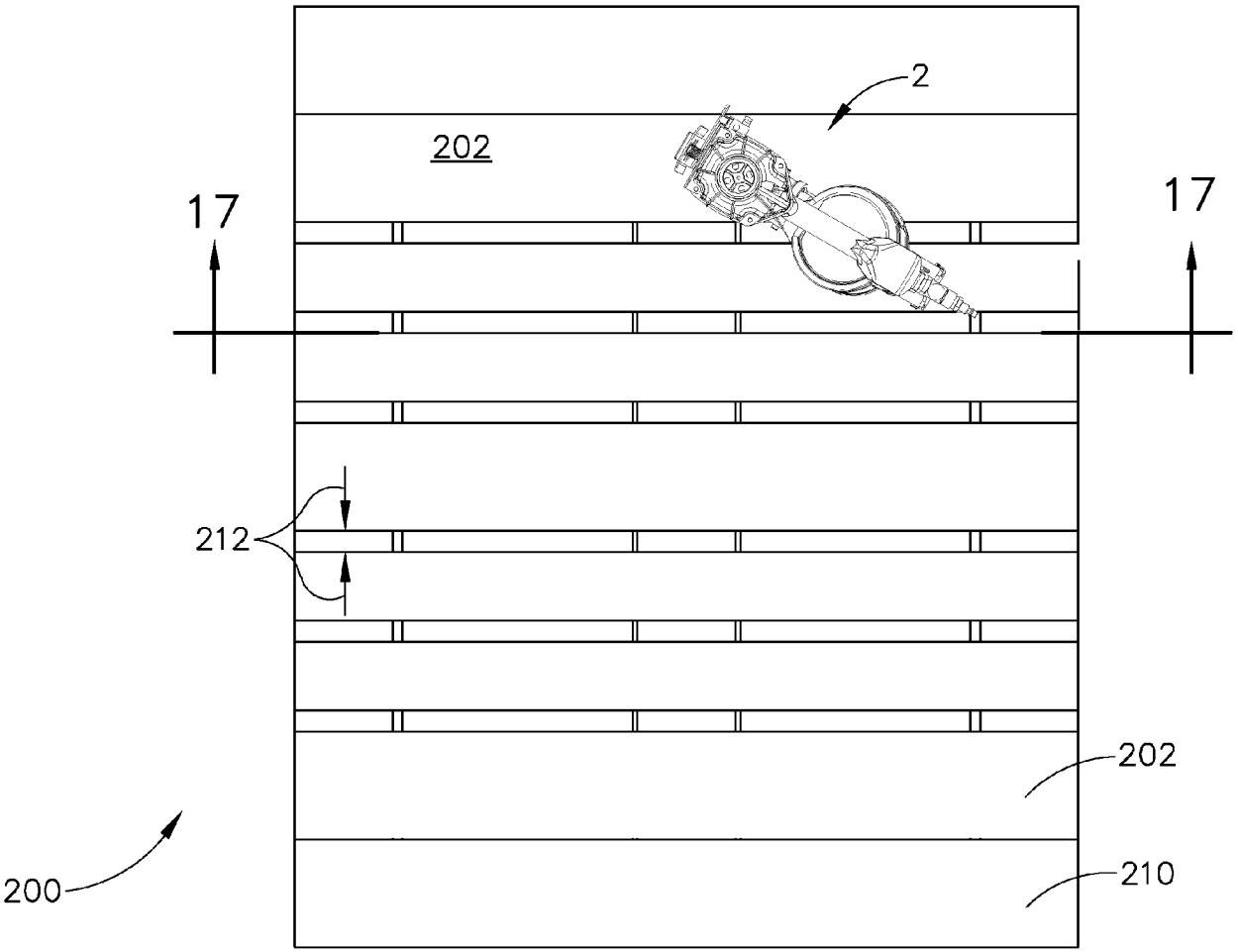
FIG. 16 is a top, plan view of a pallet with the portable automatic nailer and clenching adapter of FIG. 1 being held above the pallet in a position to allow the clenching extension arm to fit between two of the top deckboards, and in position to undergo an actuation sequence.

Referring now to FIG. 16, the tool has been rotated somewhat so that its distal end 62 of the clench extension arm 40 is directly beneath one of the top deckboards 202. This can be accomplished because the outer dimensions of the middle member 66 of the clench extension arm is smaller than the gap distance, which is the deck spacing dimension 212.

Figure 17:
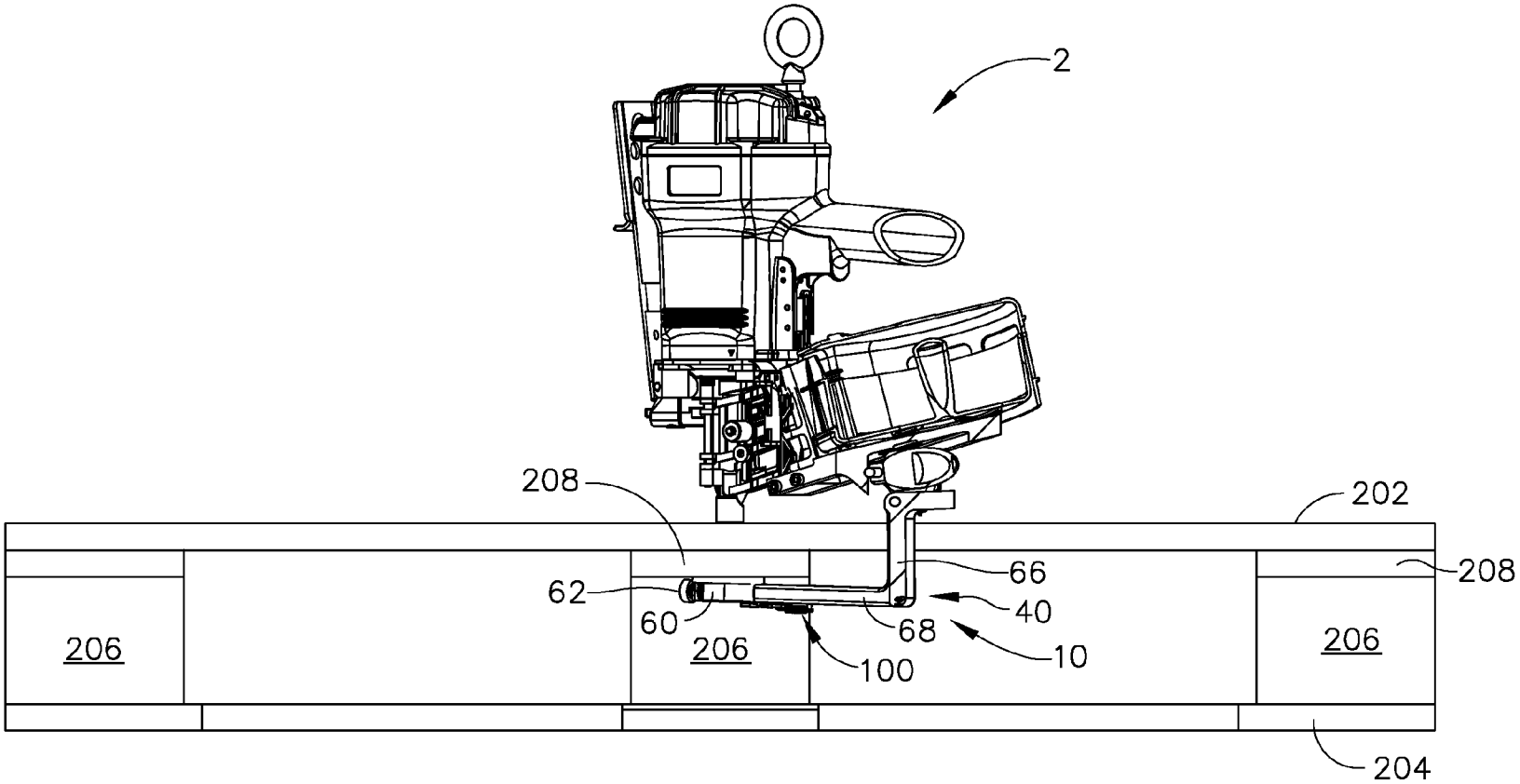
FIG. 17 is a side, elevational view in partial cross-section (taken along the line 17-17 in FIG. 16) of the pallet and portable automatic nailer with clenching adapter of FIG. 16, with the clenching extension arm in its actuated (clenching) state.
Figure 18:
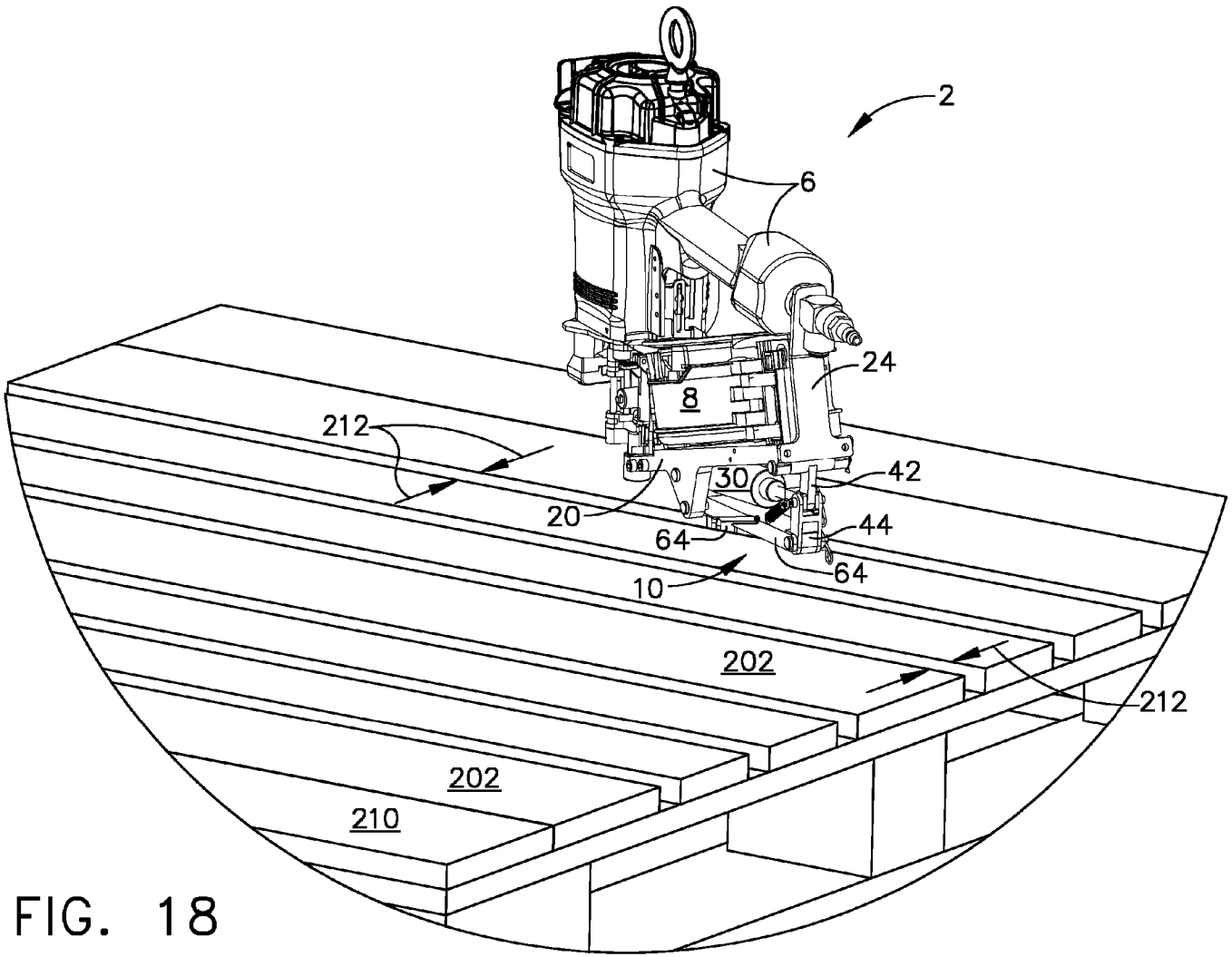
FIG. 18 is a perspective view from above, and to the side, of a pallet with the portable automatic nailer and clenching adapter in the position depicted in FIG. 16.

Referring now to FIG. 17, the tool 2 is again shown in its orientation of FIG. 16, but from a side elevational view instead of the top plan view of FIG. 16. In FIG. 17, the clench extension arm 40 is now in its extended and clenched state, and the distal member 68 is essentially parallel (i.e., horizontal in this view) to the top deckboard 202. The anvil 60 is now pressed against the bottom of one of the stringer boards 208, and a nail can now be driven through the top deckboard 202 and the stringer board 208 to impact against the anvil 60. It can be seen that the middle member 66 is passing through one of the deck spacing gaps 212, which allows this tool to be positioned in this manner. A perspective view, FIG. 18, shows this orientation with the proximal end member 64 running from the toggle link 44, toward the middle member 66 of the extension arm 40. This middle member 66 passes through the gap that is the deck spacing 212.

It will be understood that the nailer tool 2 and the anvil 60, described above, are both designed for use with rather large nails in mind. In addition, the preferred nails are not standard diamond tip nails; instead, they exhibit a chisel tip at about a 45-degree angle. Other types of nails also might work well with the nailer tool 2 with clenching adapter 10.

The cross-section footprint of the anvil 60 and its associated actuator subassembly components must be small enough to fit within the gap 212 while in its first orientation, i.e., when the anvil has not yet been pivoted, such as that viewed in FIG. 2. However, the cross-section footprint of the anvil 60, after it has been pivoted to its second orientation (e.g., see FIG. 3), needs to be large enough to intercept the nail that is being driven by the nailer tool 2, out its exit end 14. And one cannot depend on the moving nail always coming out through the wood substrates that make up the target workpiece at a specific angle, or even at a particular X-Y position, due to the variances in wood grain, etc., as discussed above. Therefore, in a way, the larger the "second orientation" cross-section footprint, the better. Of course, keeping the weight to a minimum is always important for a portable hand-operated power tool, so that factor must be kept in mind by the tool's designer.

In one mode of this technology disclosed herein, the smaller cross-section footprint (the "first footprint") of the anvil 60 is about one inch in size; and the larger cross-section footprint (the "second footprint") of the anvil 60 is about two inches in outer diameter. Note that this smaller cross-section footprint does not necessarily create a circular perimeter; it is more of a longitudinal shape—it includes the anvil itself, in its non-pivoted (first) orientation, but also includes the distal member 68, which also must pass through the gap 212. It will be understood that the sizes for the first and second footprints are completely driven by the size of the expected gaps in the target workpieces, and such cross-section footprint sizes of the nailer tool's clenching adapter can be significantly changed to be larger or smaller, if desired. For designing with the one-inch and two-inch footprint sizes for the illustrated embodiment described above, the anticipated dimension for the gap 212 is about 1.08 inches in size.

An alternative embodiment for a clenching extension arm, generally designated by the reference numeral 150, is illustrated in FIGS. 19-29. This alternative extension arm 150 performs essentially the same function as the clenching extension arm 40, described above. However, alternative extension arm 150 uses a separate air-operated cylinder 152 to rotate the anvil, rather than using a cable and spring system.

Figure 19:
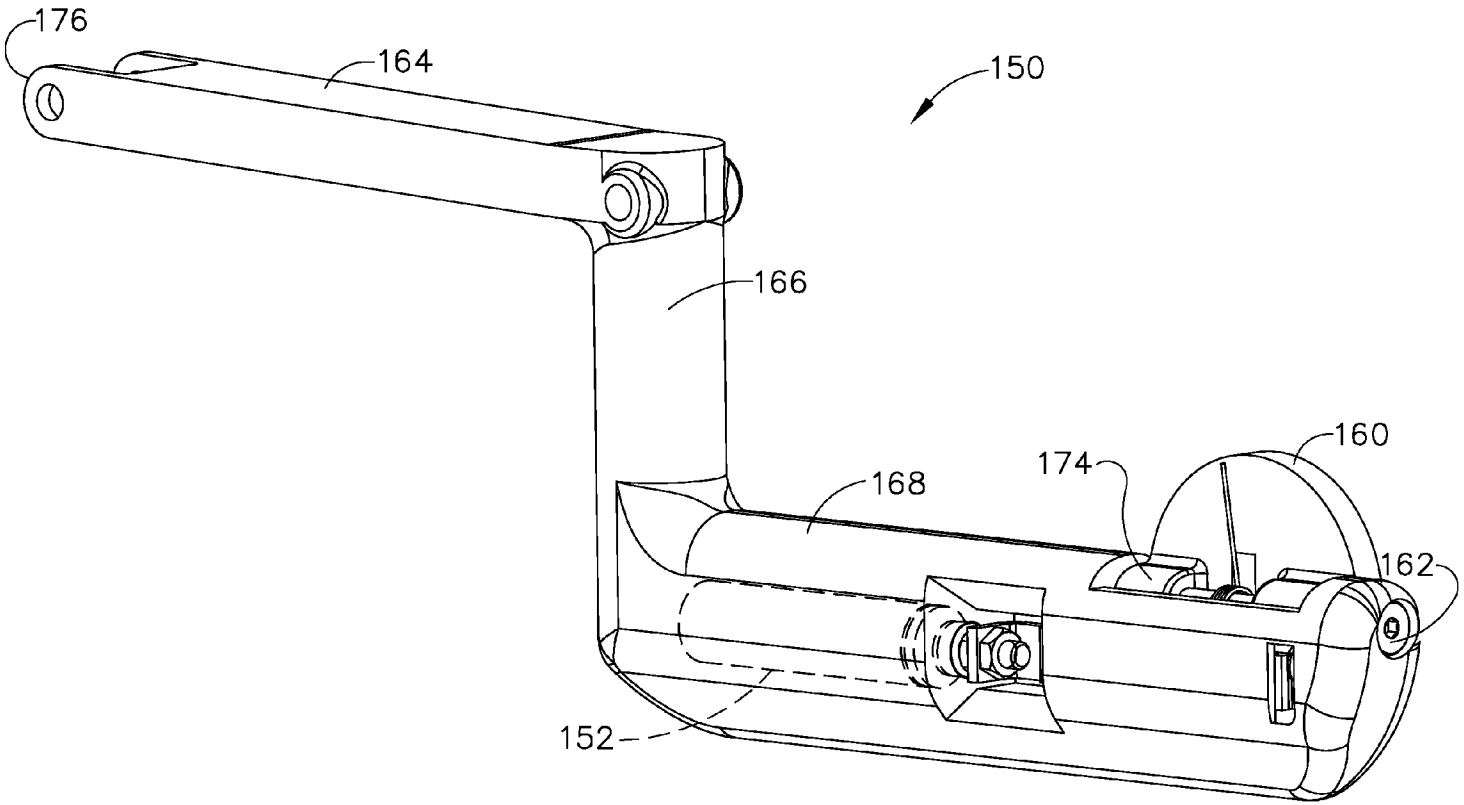
FIG. 19 is a perspective view from the "right side" of an alternative embodiment clenching extension arm that can be used with the nailer tool of FIG. 1, showing some of the internal components with the outer skin having a transparent appearance; the pivoting action of the anvil is produced by a separate air cylinder.
Figure 20:
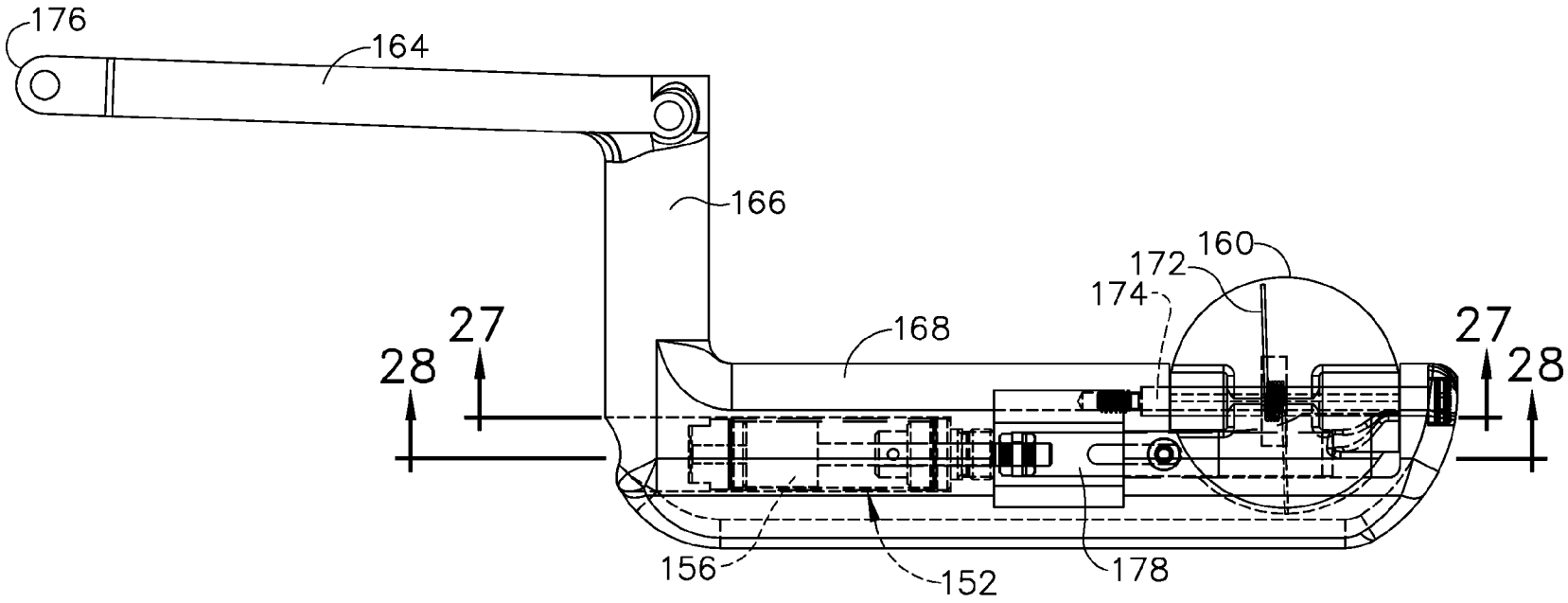
FIG. 20 is a "right side" elevational view of the alternative embodiment clenching extension arm of FIG. 19, showing some of the internal components in hidden lines.
Figure 21:
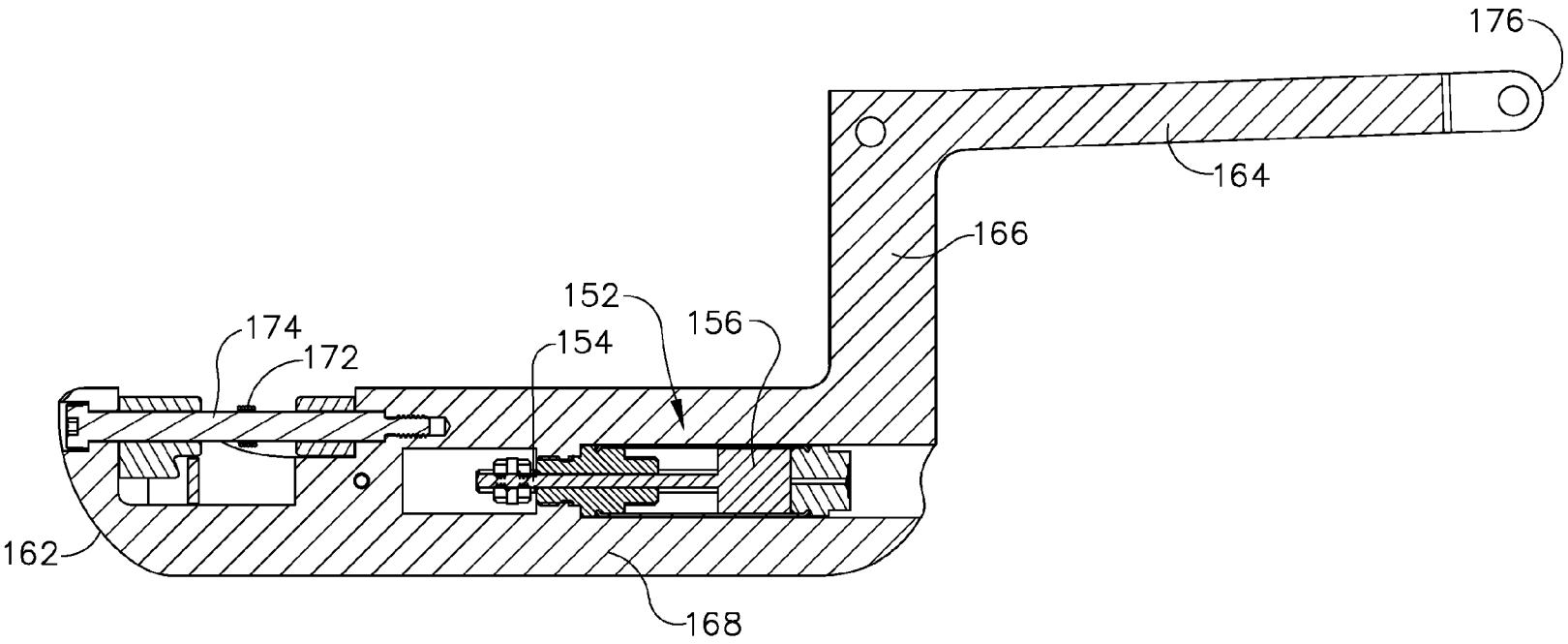
FIG. 21 is a "left side" elevational view, in cross-section, of the alternative embodiment clenching extension arm of FIG. 19, again showing some of the internal components.
Figure 22:
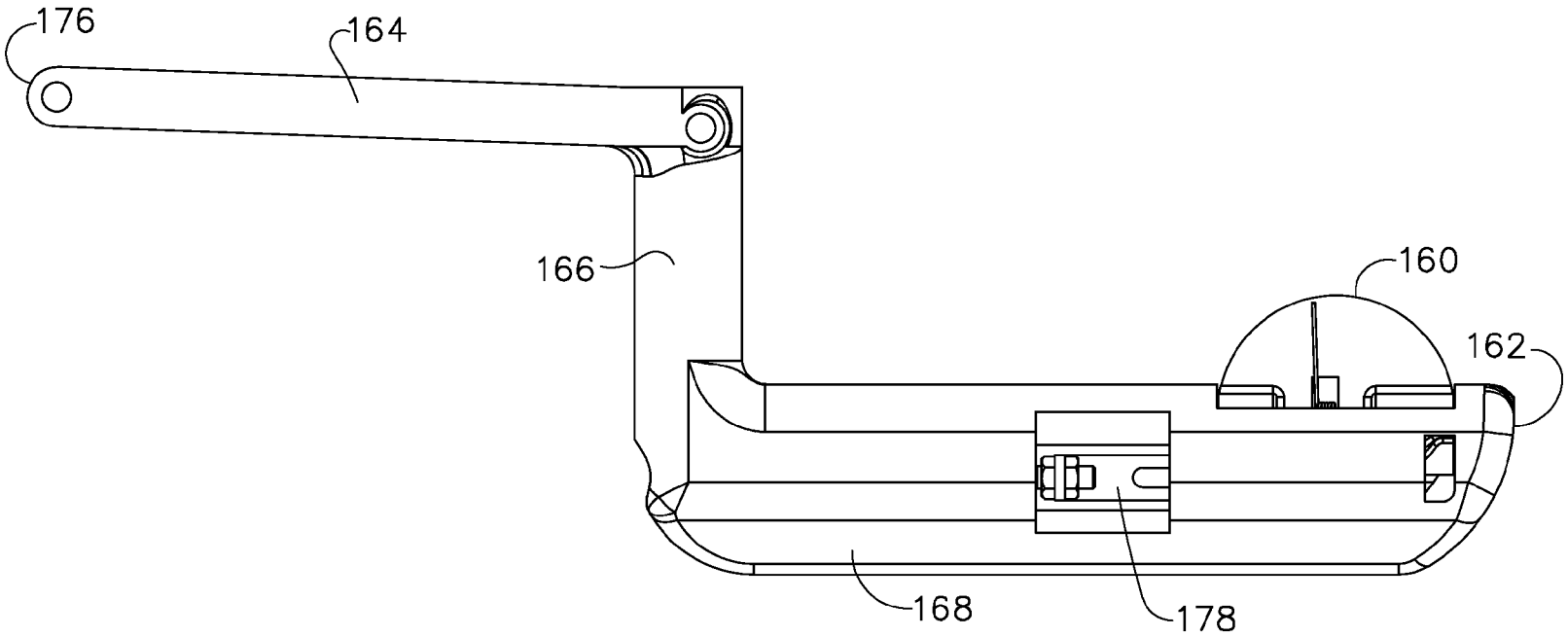
FIG. 22 is a "right side" elevational view of the alternative embodiment clenching extension arm of FIG. 19, with the anvil non-actuated.
Figure 23:
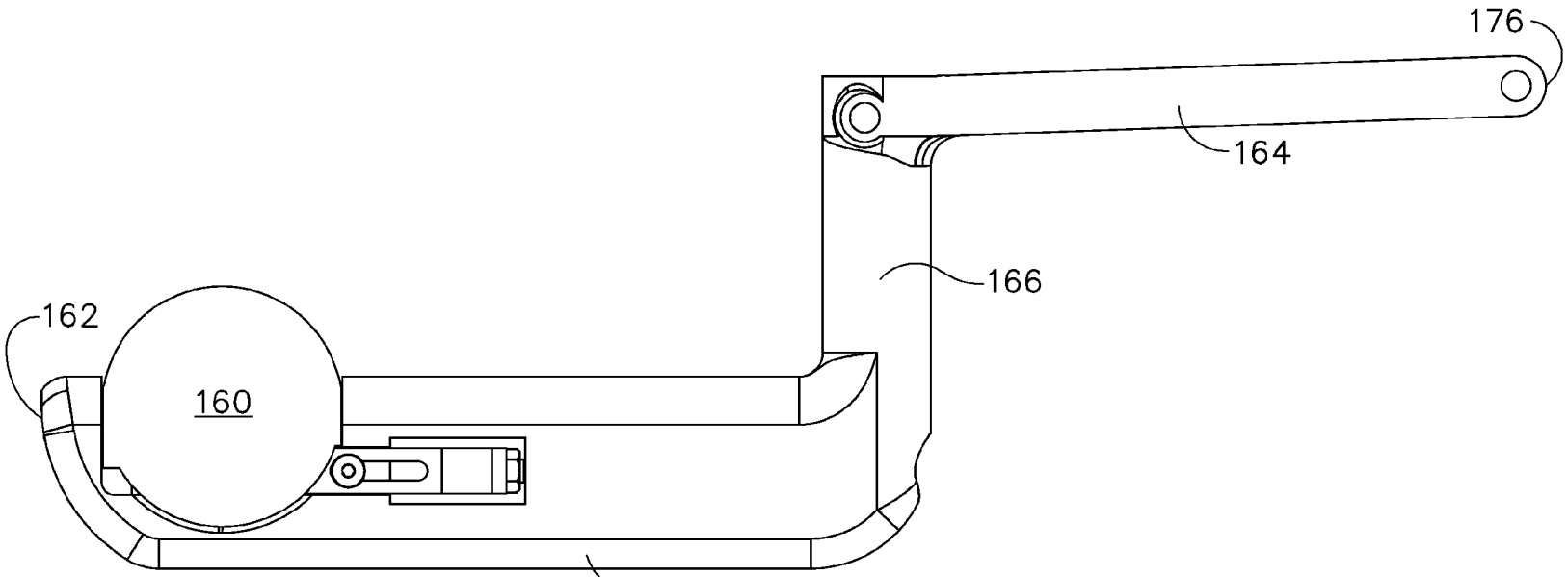
FIG. 23 is a "left side" elevational view of the alternative embodiment clenching extension arm of FIG. 19, with the anvil non-actuated.
Figure 24:
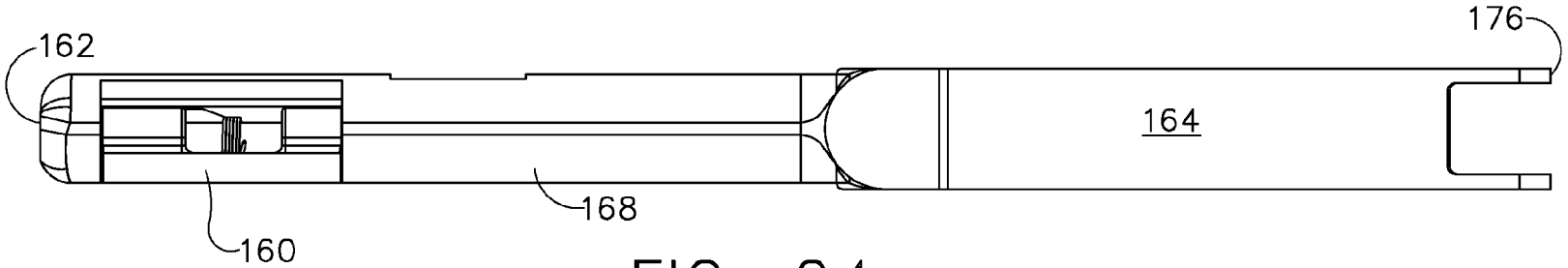
FIG. 24 is a top plan view of the alternative embodiment clenching extension arm of FIG. 19, with the anvil non-actuated.
Figure 25:
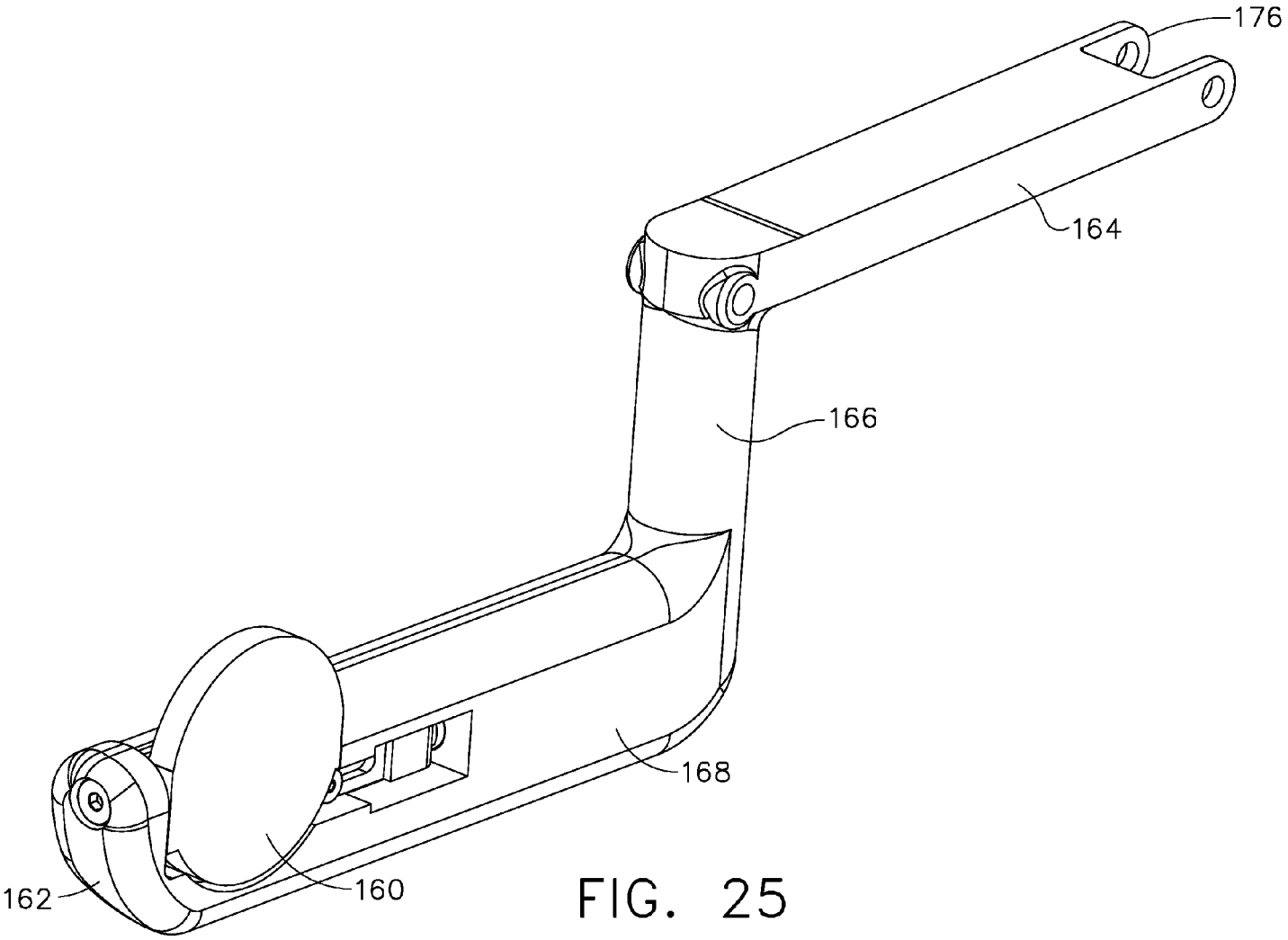
FIG. 25 is a perspective view from the "left side" of the alternative embodiment clenching extension arm of FIG. 19, with the anvil non-actuated.
Figure 26:
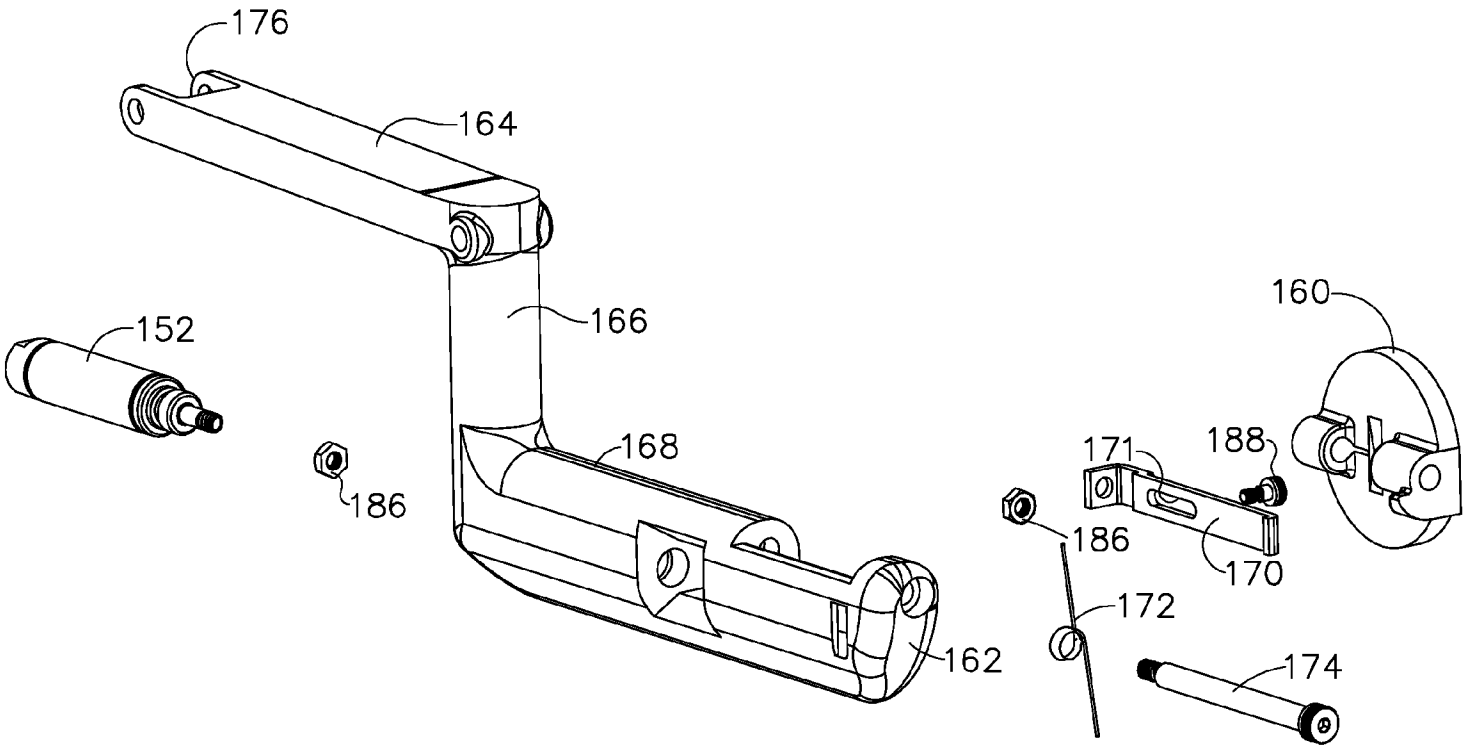
FIG. 26 is an exploded view of the alternative embodiment clenching extension arm of FIG. 19, showing some of its major components.
Figure 27:
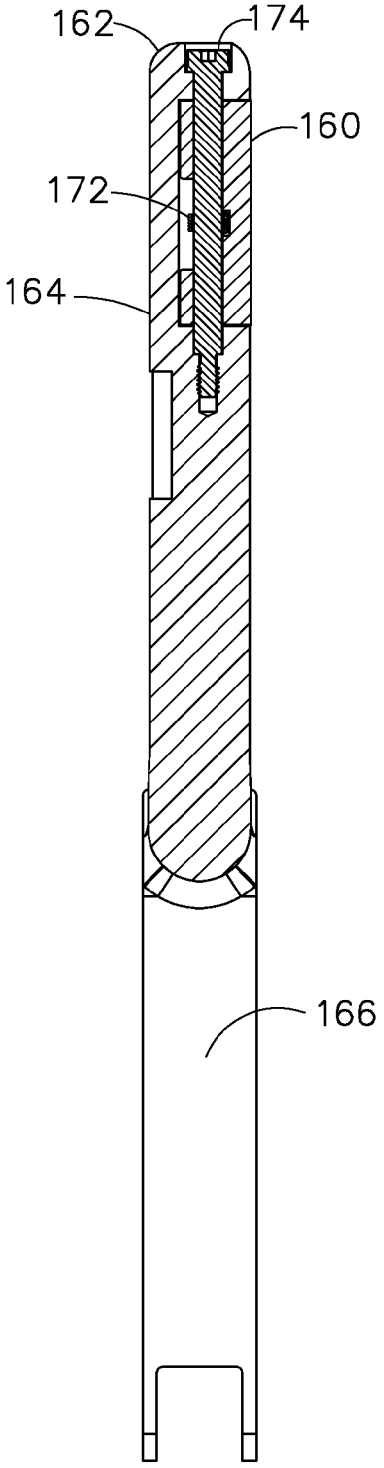
FIG. 27 is a cross-section view of the alternative embodiment clenching extension arm of FIG. 19, taken along the line 27-27 on FIG. 20.
Figure 28:
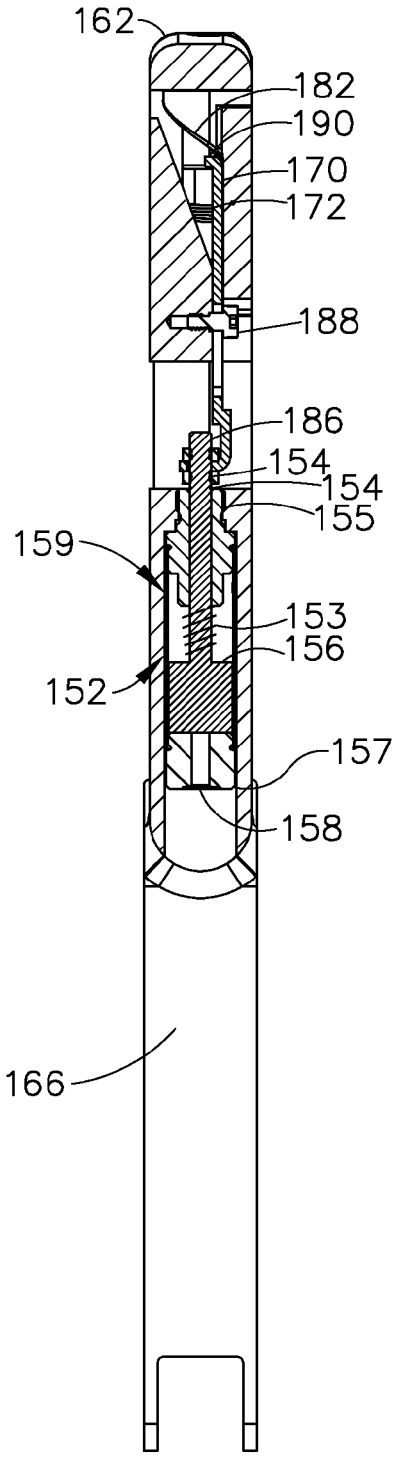
FIG. 28 is a cross-section view of the alternative embodiment clenching extension arm of FIG. 19, taken along the line 28-28 on FIG. 20.

FIG. 19 shows some of the major components of the clenching extension arm 150, including a proximal end 176 and a distal end 162. The proximal end 176 is to be attached to the support base/actuating cylinder structure at the pivot pin 46; there are mounting holes for that purpose at proximal end 176. Extension arm 150 includes three major extension arm members 164, 166, and 168; the proximal member is 164, the middle member is 166, and the proximal member is 168. Also viewed on FIG. 19 are the separate air cylinder 152, a pivotable anvil 160, and a shoulder bolt 174. Note that the air hose (or air tube) that brings supply air to the cylinder 152 is not shown, for purposes of clarity.

FIGS. 20-28 show many more details of the alternative embodiment clenching extension arm 150. The air cylinder 152, as a subassembly, includes a return spring 153, a cylinder rod 154, a threaded mounting face 155, an internal piston 156, and a rear cap 157. There is a rod "slide area" at 178. The air cylinder 152 is supplied with pressurized air though an inlet air passage at 158, and it exhausts outlet air at vents 159 during the pressure stroke of the piston 156. The piston 156 extends when air cylinder 152 is supplied with pressurized air, and it retracts due to the return spring 153.

The pivotable anvil 160, as a subassembly, includes a translation link 170, a biasing spring 172, the shoulder bolt 174, and a cam ramp structure at 182; there are also some through-holes at 184 for the shoulder bolt. There are hex nuts 186 for adjusting the translation link 170, for proper actuation of the cam ramp 182. There is a bolt 188 that limits the translation link 170 to two-dimensional travel; it lightly clamps the link 170 to the face of the arm 168, allowing only travel axially with the cylinder 152, when combined with other limiting features cut into the clench arm member 168, and the slotted through hole 171 in the link 170.

The translation link 170 contacts the cam ramp 182 at an interface area 190. When the translation link 170 is moved by action of the piston rod 154, it forces the anvil 160 to pivot because of the shape of the cam ramp 182, at the interface 190. After the nail has been driven, the human user releases the tool's trigger 12, and the air cylinder 152 becomes de-actuated. The return spring 153 moves the air cylinder's piston 156 away from the cam interface 190, and the biasing spring 172 then returns the anvil 160 to its "vertical" (non-clenching) orientation.

Figure 29:
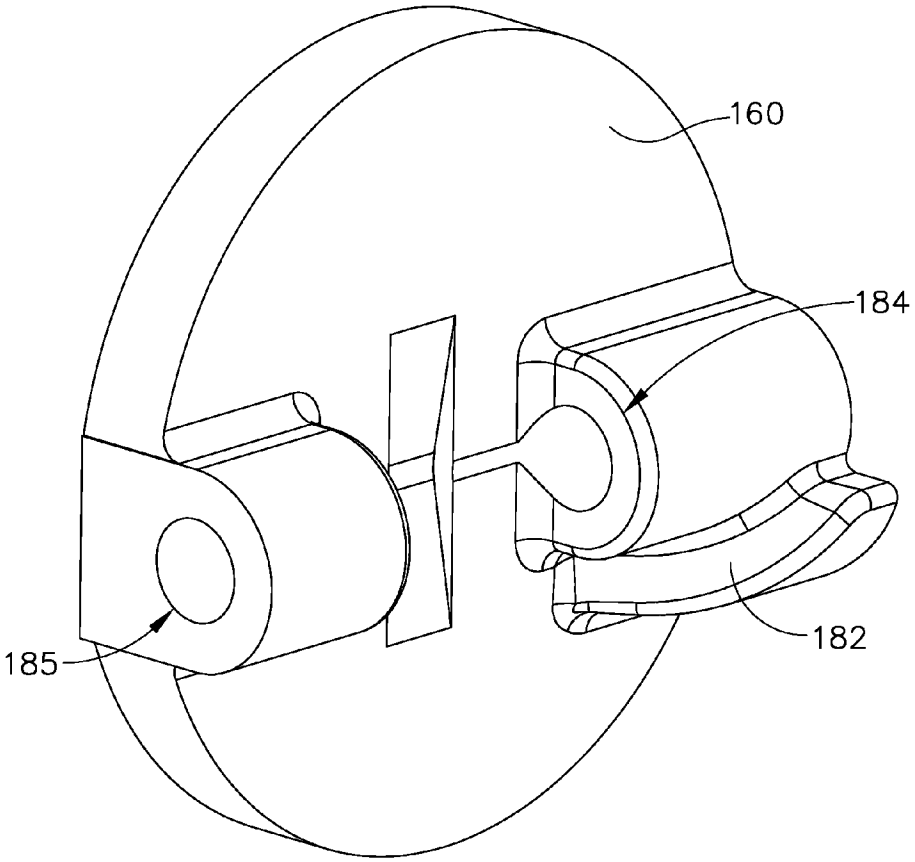
FIG. 29 is a perspective view of the anvil member, used in the alternative embodiment clenching extension arm of FIG. 19.

Referring now to FIG. 29, the shape of the cam ramp 182 is illustrated in some detail. The curved shape of this ramp 182 converts the linear motion of the translation link 170 into a rotational force that causes the anvil 160 to pivot to its "clenching orientation," where it now is ready to receive the tip of a nail that will be quickly driven through a workpiece and against the hard surface of the anvil. When in this orientation, anvil 160 works just like the first embodiment anvil 60, described in detail above, and with reference to the earlier drawings, including FIG. 4 in particular.

In yet another alternative embodiment for the clenching extension arm 40, the anvil 60 can be caused to rotate without a separate "driving" mechanism. The anvil would be spring-loaded to automatically be maintained in its first orientation, which is the non-actuated position. The distal end 62 of the clenching extension arm 40 first is inserted through the gap 212 in the pallet workpiece. Then, to rotate the anvil 60, the upper portion 61 of the anvil 60 is dragged by the operator across the underside of the board to be fastened (i.e., at the distal side 73 of the workpiece). This dragging action causes friction between the board and the upper face 61 of the anvil when it is in the (non-rotated) position as shown in FIG. 5, and this friction force creates an overturning action that rotates the anvil 60 to its second orientation.

In this alternative embodiment, there would be no need for the pull cable 92, its tubular housing 90, or the spring 94. The cam mechanism 100 would also not be needed. Some type of spring-loading mechanism would still be required, as noted above, which could be supplied by the return spring 128.

It is to be noted that anvil 60 will rotate in one direction only, because the anvil 60 is constrained by the confines of the geometry of the support structure, the distal end 62 of the clench extension arm 40. This may most clearly be seen in FIG. 9; note that the anvil 60 is resting upon a portion of the clench extension arm at 63, in the vicinity of its distal end 62. This support implies lack of rotation in one direction. A tool operator may have a preference for such an embodiment because the mechanism is simpler overall, and therefore lighter, and requires less maintenance.

Figure 30:
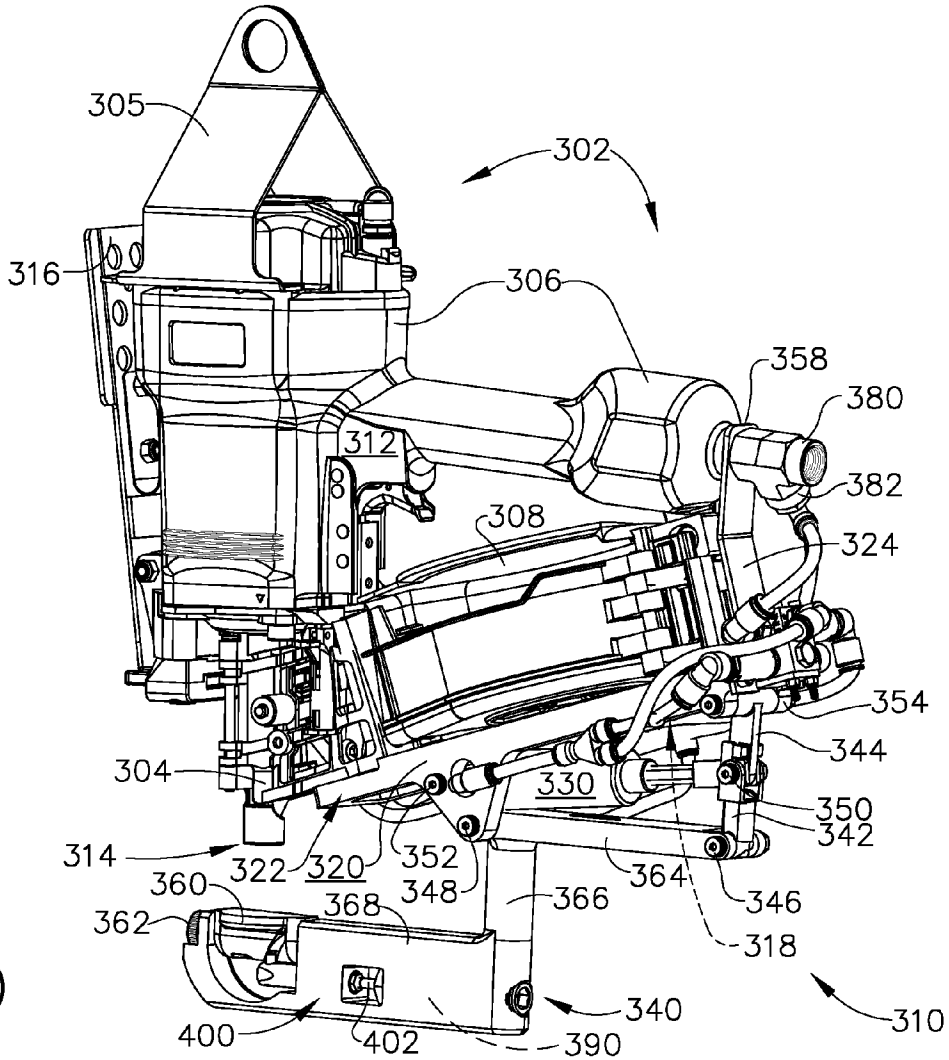
FIG. 30 is a perspective view of an alternative embodiment portable automatic nailer having a clenching adapter mounted thereto for curling nails, as constructed according to the principles of the technology disclosed herein.
Figure 31:
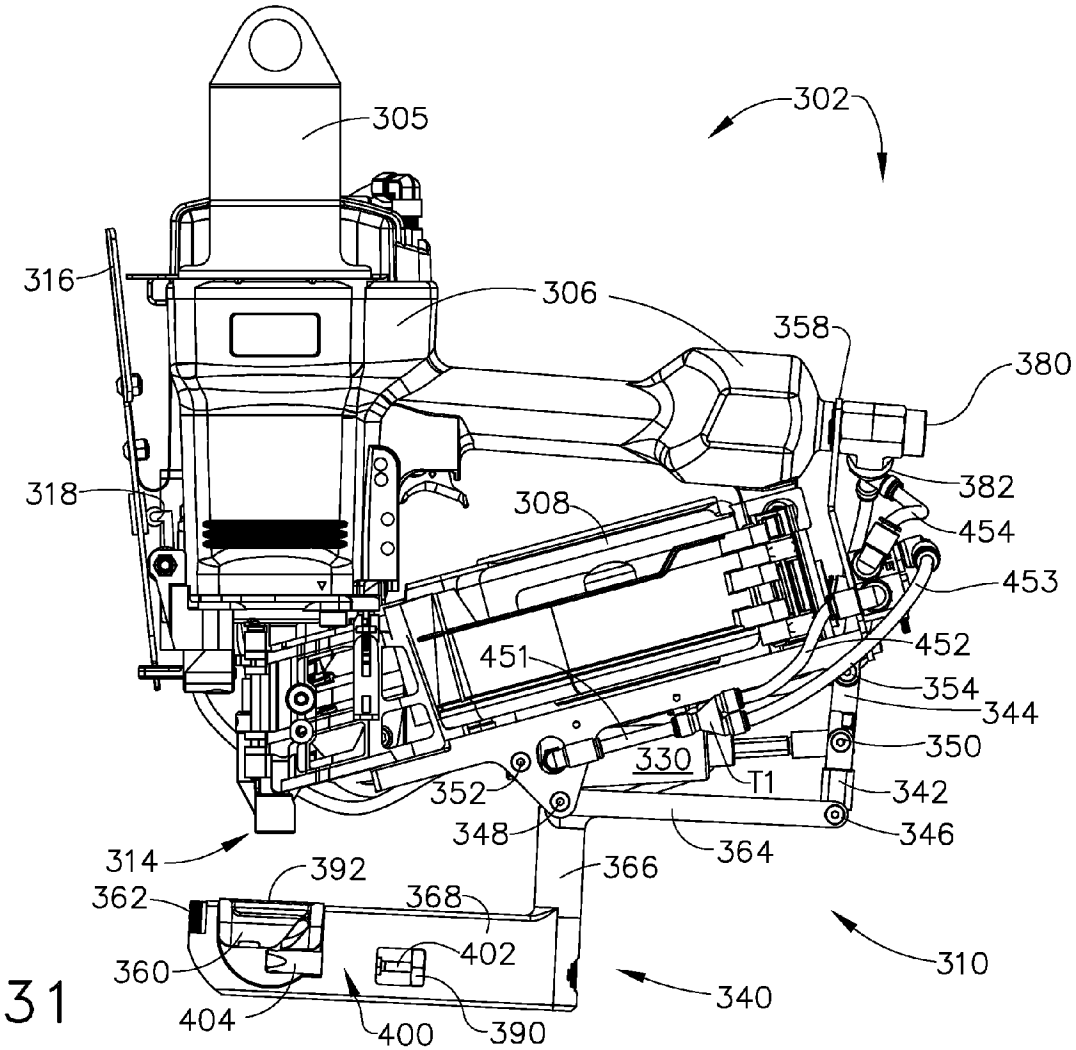
FIG. 31 is a side elevational view of the automatic nailer of the alternative embodiment of FIG. 30, showing the nailer from its left-hand side, in which the clenching adapter is in its extended (or "clenched") state, ready for firing a nail.
Figure 32:
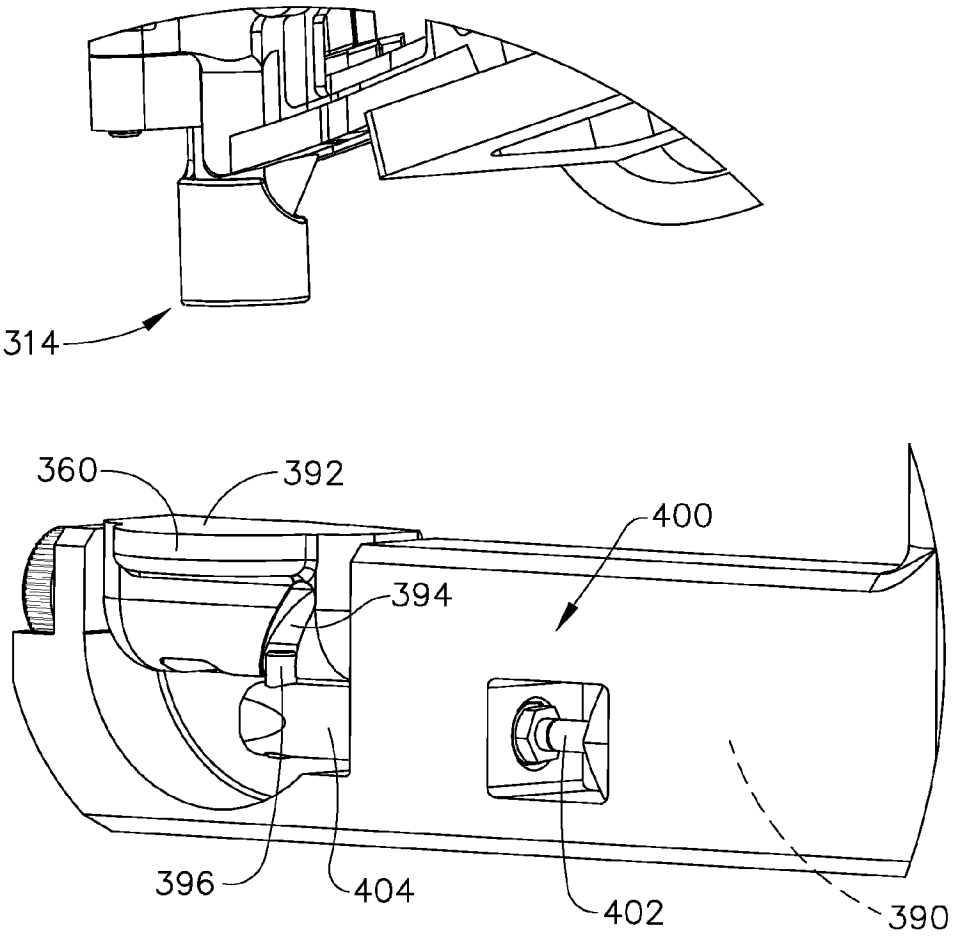
FIG. 32 is a magnified view of a portion of FIG. 30, showing details of the anvil cylinder subassembly, including its push rod and the anvil contoured cam operating path.

Referring now to FIG. 30, another alternative embodiment of a coil nailer tool is illustrated, generally depicted by the reference numeral 302. Nailer tool 302 includes a guide body 304, a lifting lug 305, a main body 306, and a canister 308 for holding a flexible strip of collated nails. (It will be understood again that collated nails can be supplied either in a flexible strip, or in a rigid strip, depending on the manufacturer of the tool. Many such nail clusters are placed into a magazine in other tools; the words "magazine" and "canister" both refer to devices that hold collated nails.) With certain modifications, the nailer tool 302 is similar to one sold by Senco Brands, Inc. of Cincinnati, Ohio, under the model number SCN60. A clenching adapter is mounted to nailer tool 302, in which the adapter is generally depicted by the reference numeral 310.

The remaining description of the nailer tool 302 with adapter 310 applies to each drawing in the range FIGS. 30-33. A cylinder support base structure 320 is mounted to the "bottom" of the nailer, and has two attachment points: the point 356 mounts to the guide body 304, and the point (or bracket) 358 mounts to the main tool body 306. The support base 320 remains stationary with respect to the tool 302. Support base 320 also has pivotable mounting points at 352 and 354, for other members that are part of the adapter 310. There also is a support structure 322 that is part of the base 320. The support base 320 is supported against the tool body by a mounting screw or bolt at 356, and by a rear support bracket 324 that extends up to the mounting bracket at 358.

There is a separate "clenching extension arm" air-operated cylinder 330, which mounts to a rear clevis 332 at mounting point 352, and which mounts to a rod clevis 336 at a mounting point 350. The cylinder's extension rod 334 either pushes or pulls against a pair of toggle links 342 and 344, at the pivotable mounting point 350. Depending upon which operating state the nailer tool is in, the geometry of the two toggle links 342 and 344 will be a straight line (see FIG. 30—also see FIGS. 42-44) which is the extended state of the cylinder (and is the "clenching state" of the overall system), or the geometry will be angled (see FIG. 33—also see FIGS. 39-41) which is the retracted (non-clenching) state of the cylinder. An opening 338 (not visible) is formed in the cylinder support base 320, to provide clearance that allows the toggle links 342 and 344 to pivot, when the tool is in its retracted (non-clenching) state. The first toggle link 342 also pivots when the tool is in its retracted state.

An air line 451 is connected to the clench cylinder 430. The actuation of cylinder 430 is controlled by certain pneumatic control valves, and that actuation is initiated by a hand-operated safety arm 316 that is attached to the guide body 304. The sequencing of events is controlled by the pneumatic control devices (sometimes referred to herein as the "air logic"), which will be discussed below in greater detail.

The adapter 310 also has a clench extension arm subassembly 340 that extends from a pivot point 346 toward a second mounting (and pivotable) point at 348, and further extends toward a distal end 362. An anvil 360 is mounted to the clench extension arm 340, at its distal end 362. Essentially, the clench extension arm 340 runs from a proximal mounting location at 346 to the distal end at 362. The anvil 360 and its actuating mechanism are described below in greater detail, and is illustrated in FIGS. 34-38. The size and shape of the clench extension arm 340 allows a human user to position the anvil 360 directly under the workpiece, before firing the nail. When the nail is fired, it will first penetrate through the workpiece, and the nail's sharp tip will then strike the anvil 360, which receives the nail and tends to bend its tip portion into a curl shape. The illustration of FIG. 4 is exemplary for this action; anvil 360 works much in the same way as anvil 60 in the above-described embodiments.

The combination of the cylinder support base 320, the cylinder 330, the two toggle links 342 and 344, and the clench extension arm 340 make up an "extending structure" that is relatively light weight, but yet is strong enough to withstand the mechanical grasping forces and shock forces that are encountered for this engineering application. It is important to make the clench link of a sufficient length from its proximal end at the pivot point 346 to its distal end 362, so that it extends below the workpiece without interfering with that workpiece, but at the same time it must extend to the correct location so as to have the anvil 360 positioned directly in the path of the nail when it is fired by the nailer tool 302. The anvil material should be hardened, since its upper surface (in these views) will be directly impacted by the sharp tips of the nails as they penetrate the (typically wood) substrates of the workpiece, as described hereinabove.

Figure 33:
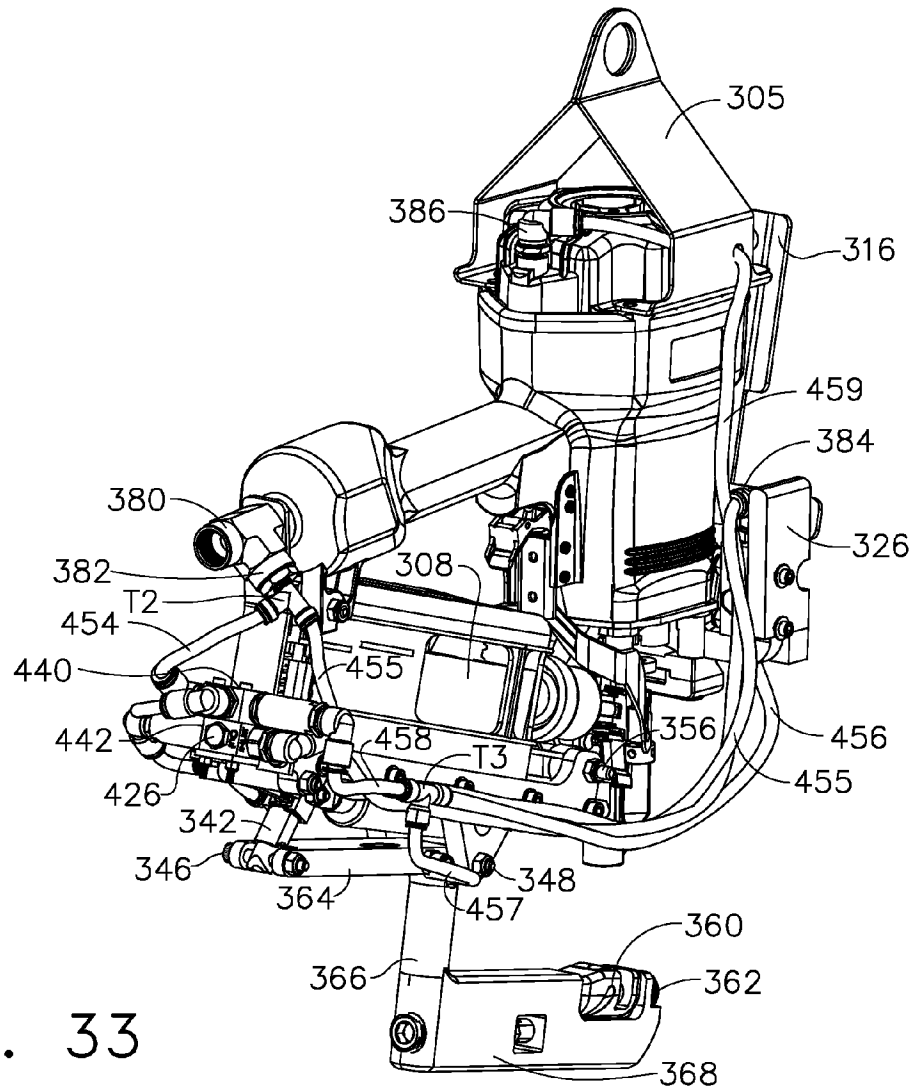
FIG. 33 is a side elevational view of the alternative embodiment automatic nailer of FIG. 30, showing the nailer from its right-hand side, in which the clenching adapter is in its retracted (or "relaxed") state.

Referring now to FIG. 33, the nailer tool 302 is depicted from the opposite side as that of FIG. 30. FIG. 30 was from the "left-hand side" while FIG. 33 is from its "right-hand side." In this view, the canister 308 is clearly visible. The safety arm 316 is provided to require the operator to use both hands (for a "two-handed operation"), and when safety arm 316 is actuated, it pushes against a clench valve actuation lever 318 (see FIG. 30) which, in combination with the air logic, will change the state of a clench valve 326. There is an automatic spring return to reset the tool after the operator releases the safety arm 316.

The operator must use one hand on the trigger 312 and the other hand on the safety arm 316 to fire a fastener. Pressurized air is brought into the tool 302 via the air fittings 380. An air hose 455 takes this pressurized air over to the clench valve 326 at one of its input fittings, such as the air fitting 384. When the clench valve 326 changes state, pressurized air will travel through its output port through other air hoses (and air logic control devices) to an air fitting 387. The air port 387 then pressurizes the clenching air cylinder 330 and causes it to actuate. When that occurs, the clench extension arm subassembly 340 will then go into its extended mode to move the extension arm 340 to its clenching position.

In FIGS. 30-33, the overall shape of the clench extension arm 340 is easy to see. Its main shape is that of a large "Z" which is made up of three clench extension arm members 364, 366, and 368. The Z-shape of the extension arm 340 exhibits angles (approximately 90-degree right-angles) that provide a near-maximum extension reach. The first member 364 is at the proximal end of the clench extension arm, and mounts to the toggle link 344 at a pivot pin 346. The first (proximal) member 364 runs between that pivot point and another pivot pin at a point 348. Pivot pin 348 is fixed with respect to the support base 320, however, pivot pin 346 can move somewhat up or down, while rotating about the pivot point 348. The second member 366 is the middle member of the clench extension arm 340, and runs from the pivot pin 348 down to an "L" angle where the second member ends and the third member 368 begins. The third member 368 is the distal member of the clench extension arm and runs from the L-shaped angle to the distal end 362. The anvil 360 is located near or at the distal end 362.

There is an anvil actuator subassembly 400 located near the distal end 362 along the third (distal) member 368 of the extension arm 340. Anvil actuator subassembly 400 includes another air cylinder 390, which operates to rotate the anvil 360 at the appropriate time during an actuation cycle that ultimately fires a nail or other type of fastener from the tool 302.

Figure 34:
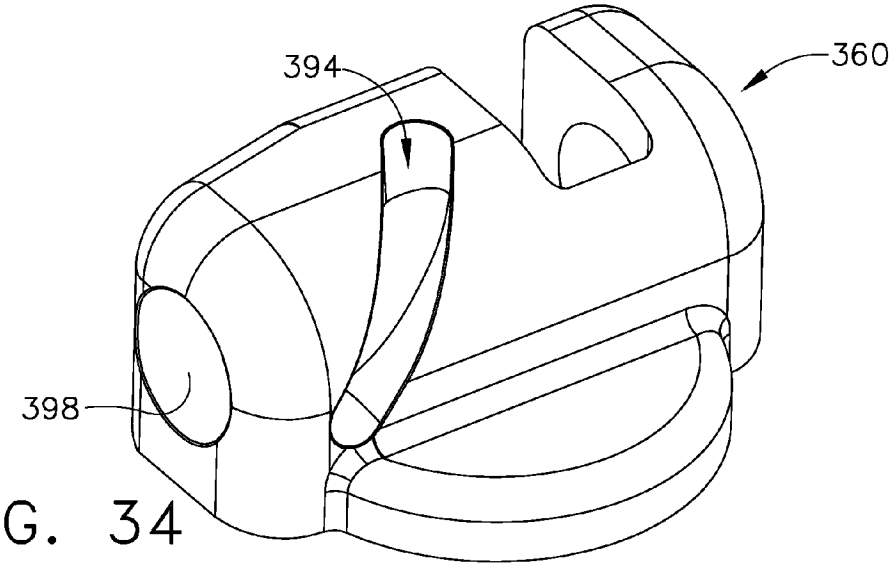
FIG. 34 is a perspective view of the anvil used in the nailer tool of FIG. 30, in perspective from the underside (bottom), back end, and right side of the anvil.

Referring now to FIG. 34, the anvil actuator subassembly 400 includes the anvil itself, which is generally designated by the reference numeral 360. FIG. 34 is a perspective view that shows details of the anvil cam ramp structure at 394, which is contoured so as to have the cam actuator (not shown on this view) rotate the anvil 360 by approximately 90 degrees, when the anvil has been actuated. FIG. 34 also shows an opening 398 which is for a shoulder bolt 416 (see FIGS. 40 and 43) that holds the anvil in place on the extension arm subassembly 340.

Figure 36:
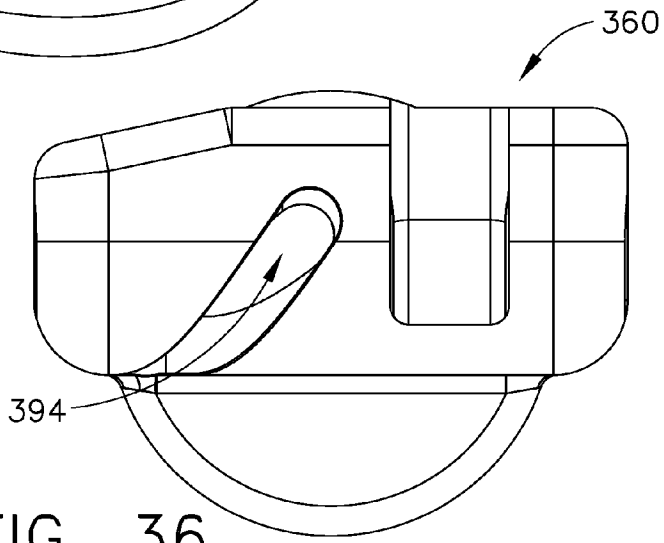
FIG. 36 is a "bottom" view of the anvil of FIG. 34, taken from the opposite side from that viewed in FIG. 35.
Figure 35:
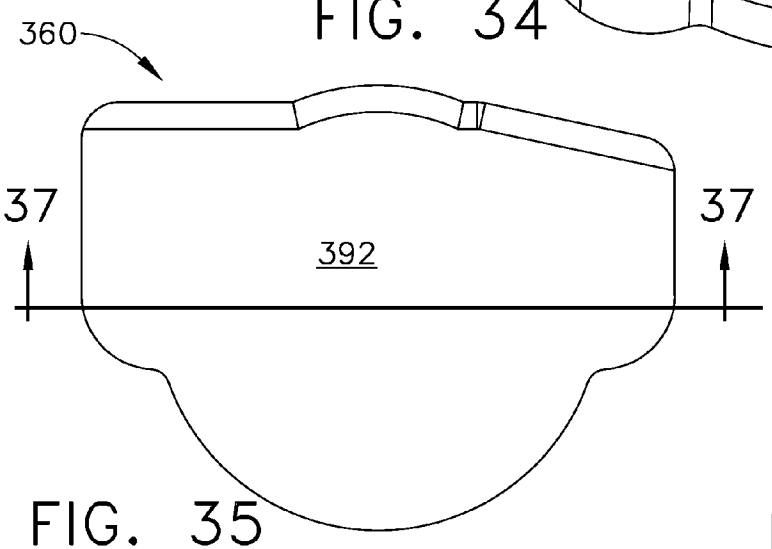
FIG. 35 is a "top" view of the anvil of FIG. 34, looking at a flat surface.

FIG. 35 is a top view showing the flat surface 392 of the anvil 360. This flat surface is the face that will receive the impact of the nails as they are shot by the coil nailer tool 302. FIG. 36 is a bottom view that shows the opposite surfaces from that of FIG. 35. In this view of FIG. 36, the contoured surfaces of the anvil cam ramp structure 394 are again evident.

Figure 37:
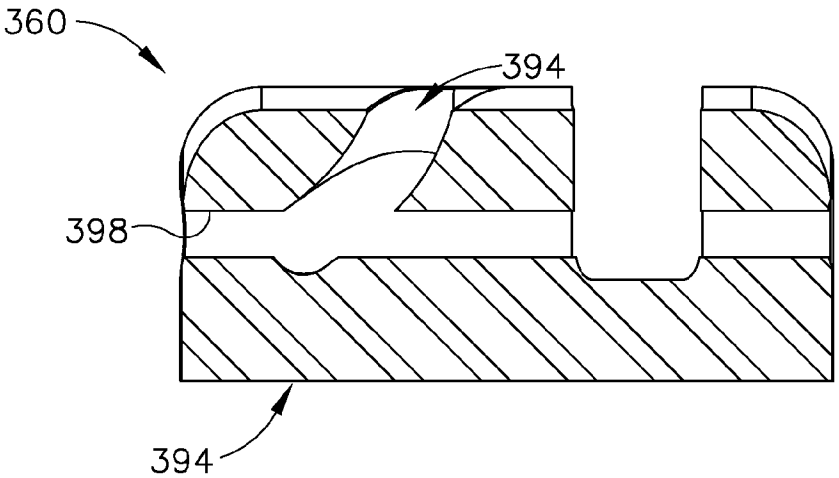
FIG. 37 is a "right" section view of the anvil of FIG. 34.
Figure 38:
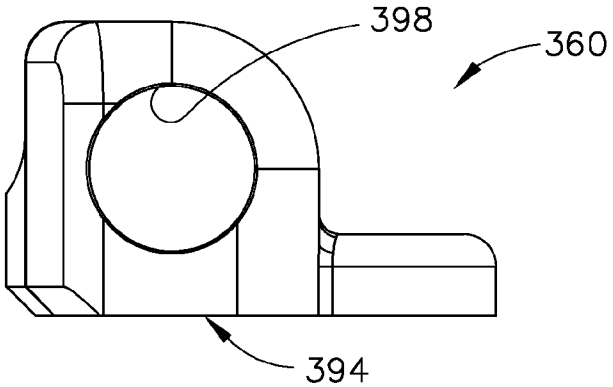
FIG. 38 is a "back" end view of the anvil of FIG. 34.

FIG. 37 is a right section view of the anvil 360, and shows a portion of the opening 398 as well as a portion of the anvil cam ramp structure 394. FIG. 38 is a back end view of the anvil 360, and again shows the opening 398 for the shoulder bolt. This end view is looking right through the centerline of where the shoulder bolt will be installed in the anvil.

The alternative embodiment tool 302 and clench adapter 310 includes an alternative clenching extension arm design, generally designated by the reference numeral 340, illustrated in FIGS. 39-44. This alternative extension arm 340 performs essentially the same overall function as the above-described clenching extension arm embodiments, and this alternative extension arm 340 uses a separate air-operated cylinder 390 to rotate the anvil.

Figure 39:
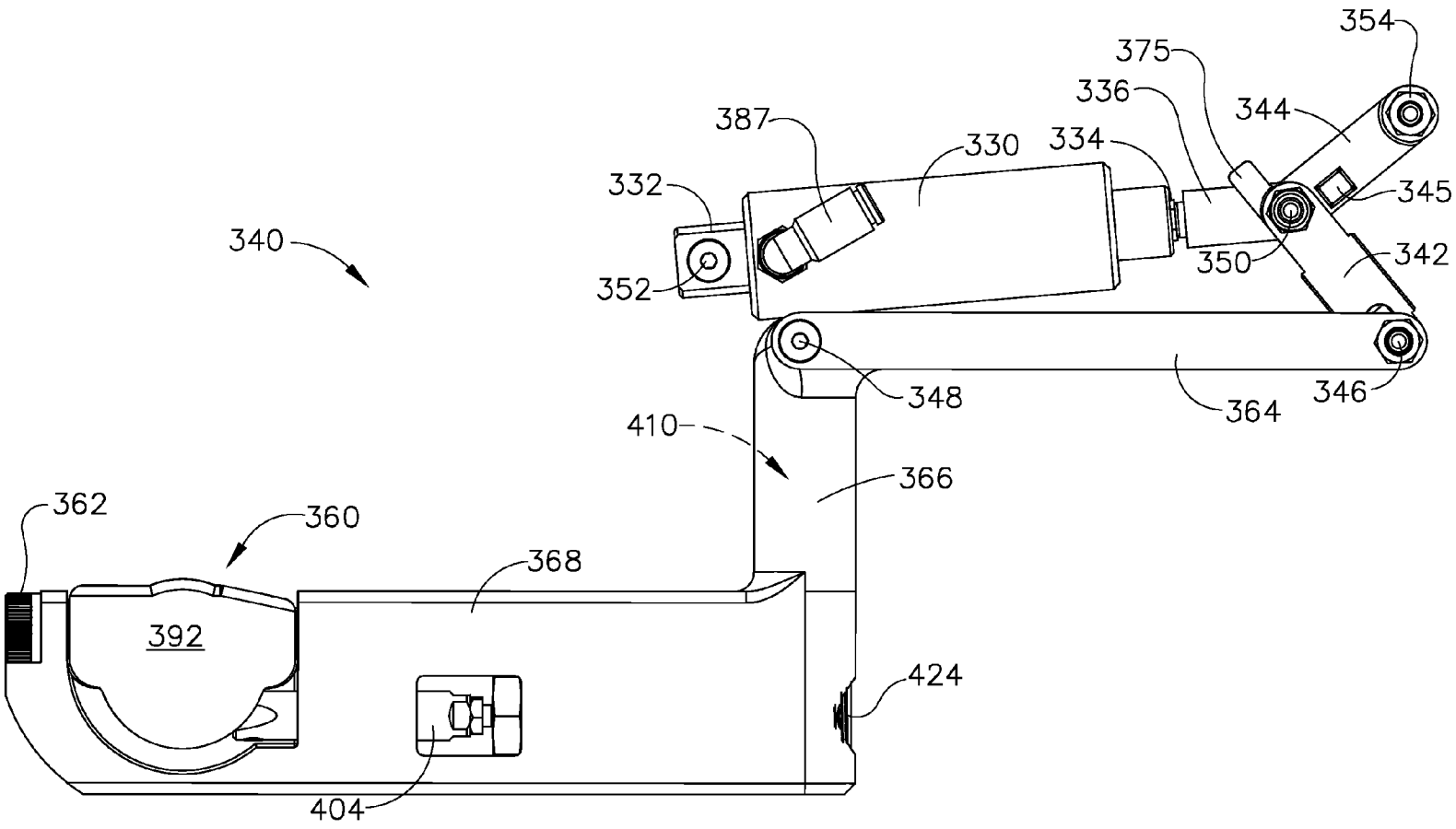
FIG. 39 is a "left side" elevational view of the alternative embodiment clenching extension arm of the tool of FIG. 30, in which the anvil is non-actuated and the clench arm is in its relaxed state.

Referring now to FIG. 39, the clenching extension arm 340, which is shown in its non-actuated position (also referred to as its "rest" position), includes a clench arm air cylinder at 330. The clench arm subassembly 340 has a pivot point 348 between the proximal member 364 and the mid member 366. There are also two other pivot points at 346 and 354, where the clench arm is attached to the toggle links 342 and 344. As discussed below in further detail, there is another pivot point 350 between those toggle links 342 and 344. The pivot point 354 is the main attachment point of the toggle link 344 to the rest of the adapter 310, while the pivot point 348 is the main attachment point of the two closest clench arm members 364 and 366 to the remainder of the adapter 310.

The clench arm air cylinder 330 has two attachment points at 350 and 352, and a rear clevis at 332, a rod clevis at 336, and a cylinder extension rod 334 that attaches to the rod clevis 336. The pivot point 350 also acts as a mounting point for the rod clevis of the clench arm cylinder, and additionally is the pivot point between the two toggle links 342 and 344. The point 352 is also the mounting point for the rear clevis of the clench cylinder, while the point 354 is the mounting point for the toggle link to the housing, as noted above.

FIG. 39 also illustrates a travel stop 345, which is a protrusion on the toggle link 344. In addition, FIG. 39 illustrates a mating travel stop 375 that extends outward from the toggle link 342. These travel stops will be discussed in greater detail, below.

Finally, FIG. 39 illustrates a few other items, such as an air fitting 387 that brings pressurized air to the clench arm cylinder 330, and it shows an extension shaft 404 that is part of the anvil cylinder rod actuating subassembly, which is contained in the distal member 368. FIG. 39 also shows the distal end 362 of the entire extension arm subassembly, and it shows an air plug 424, of which the significance will be described below. FIG. 39 also indicates a location of an internal air pathway at 410, which extends through the mid extension arm member 366. This will be described in greater detail below.

As noted above, FIG. 39 shows some of the major components of the clenching extension arm 340, including a proximal end (at a pivot point 346) and a distal end 362. The proximal end is to be attached to the support base/actuating cylinder structure at the pivot pin 346. Extension arm 340 includes three major extension arm members 364, 366, and 368; the proximal member is 364, the middle member is 366, and the proximal member is 368. Also viewed on FIG. 40 (a section view) are the separate anvil actuating air cylinder 390, the pivotable anvil 360, and a shoulder bolt 416.

Figure 40:
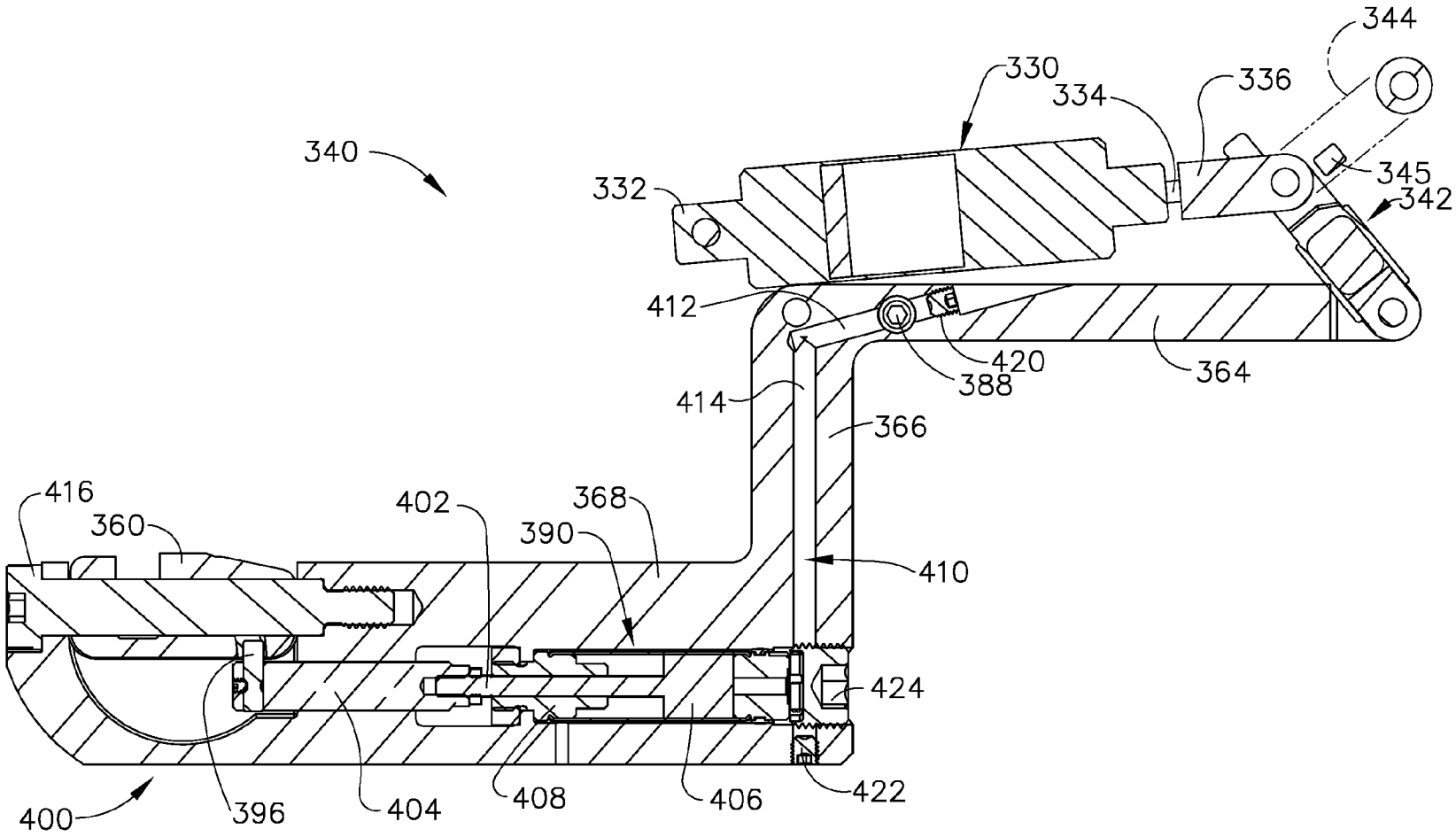
FIG. 40 is a "left side" elevational view in cross-section of the clenching extension arm of FIG. 39, in which the anvil is non-actuated and the clench arm is in its relaxed state.

Referring now to FIG. 40, the same components that were seen on FIG. 39 are again illustrated on FIG. 40, which is a section view of the clench extension arm subassembly 340. Additional details against the anvil cylinder 390 can be seen in this view, as well as details of the internal air passage 410. Starting with the anvil air cylinder 390, there is an anvil cylinder rod 402, its connecting extension shaft 404, its piston 406, and its internal linear bearing 408. When the anvil cylinder 390 is actuated, its extension shaft 404 will extend and force a push rod 396 to actuate the rotating cam structure (which is the contoured ramp structure 394), and when that occurs, the anvil 360 will be rotated about 90 degrees, as mentioned above. The shoulder bolt 416 is clearly illustrated in FIG. 40, and the anvil 360 rotates about its centerline.

The anvil cylinder 390 is actuated by air pressure, and that air pressure arrives from an external source through an air fitting 388. This air pressure, when it arrives, is directed down a first air passage 412, and then a second air passage 414, which are both part of the overall internal air pathway 410. When these passageways are pressurized, the piston 406 of anvil cylinder 390 will be actuated, which will then extend and force the push rod 396 to actuate the rotation of the anvil 360. There are several air plugs in this system, as illustrated at 420, 422, and 424.

Figure 41:
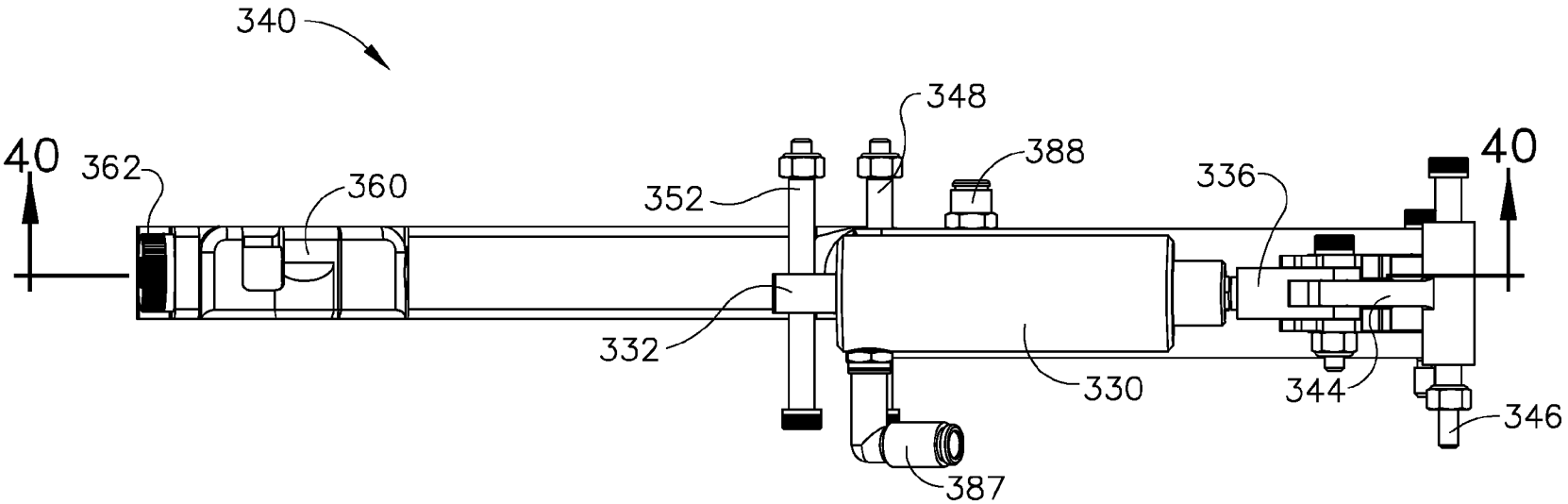
FIG. 41 is a top plan view of the clenching extension arm of FIG. 39, with the anvil non-actuated.

In the view of FIG. 40, the clench arm subassembly 340 is in its rest position, and therefore, the anvil 360 is not actuated. In other words, the anvil 360 typically is also in its rest position at the same time the clench extension arm 340 is in its rest position. This can be seen by inspecting FIG. 41, which is a top view of the clench extension arm subassembly 340. In FIG. 41, the anvil 360 has not been rotated, and its overall profile fits within the overall width of the third or distal member 368 of the clench extension arm subassembly 340. This is by design, because, as in the previous embodiments disclosed above, it is desired for the clench extension arm and its anvil to fit between the various wood boards of the pallet, which means that the clench extension arm must fit within the gaps between those boards. Later, when the third or distal member 368 has been successfully placed beneath the pallet, the anvil can then be rotated when it is time for the clench arm to be actuated.

Figure 42:
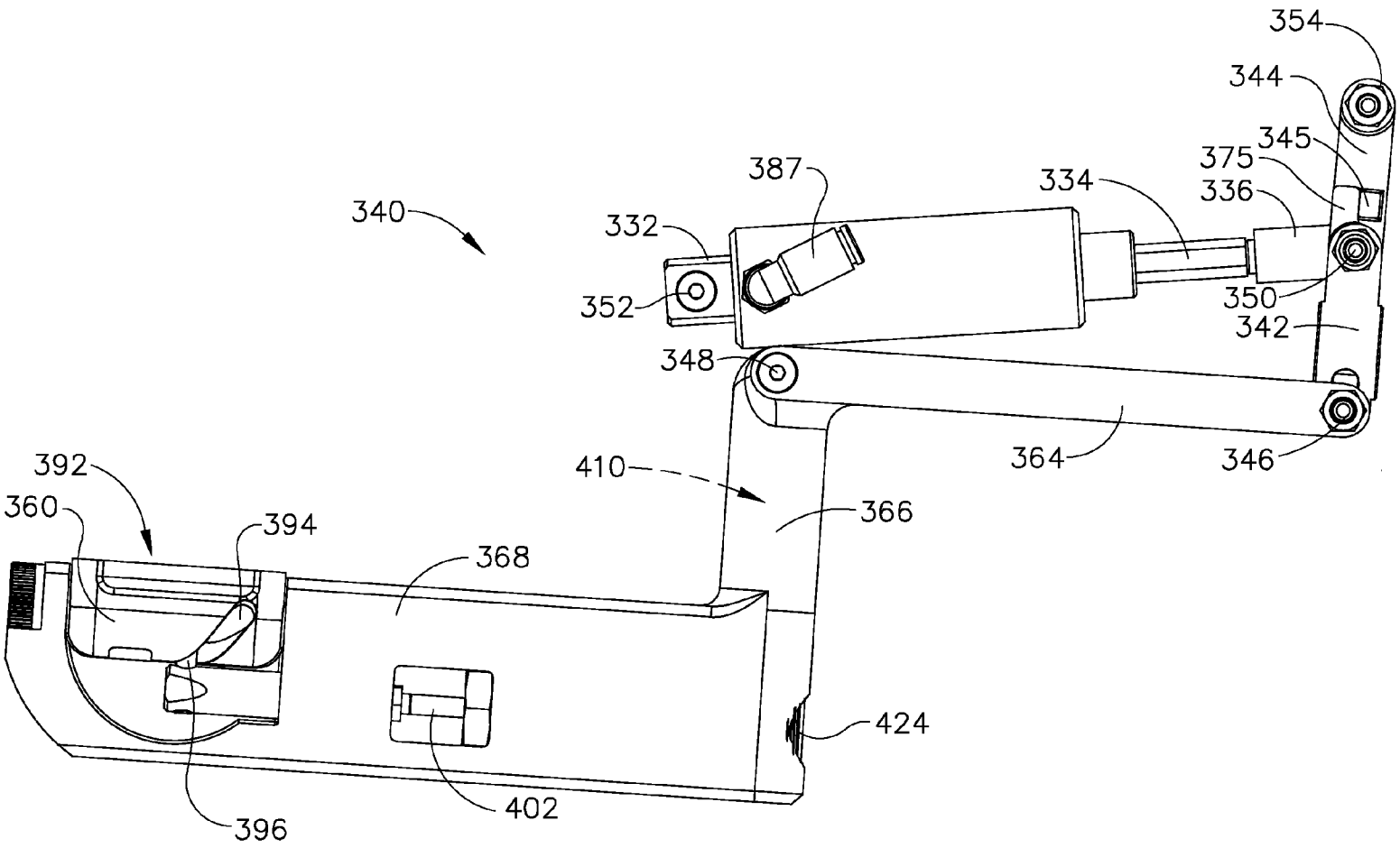
FIG. 42 is a "left side" elevational view of the alternative embodiment clenching extension arm of the tool of FIG. 30, in which the anvil is actuated and the extension arm is in its extended (clenched) state.

In FIG. 39, the clenching mechanism was depicted in a relaxed state, while FIG. 42 shows the clenching (or extended) operating state of the clench extension arm 340. In FIG. 42, the clench air cylinder 330 has been actuated, and the air cylinder rod 334 has extended, thereby pushing the pivot pin 350 away from the air cylinder 330. This causes the two toggle links 342 and 344 to now line up in a substantially co-linear geometry, as can be clearly seen on FIG. 42. Before all of this occurs, the actuating cylinder 390 causes the anvil 60 to rotate 90 degrees. The shape of the contoured cam ramp 394 is illustrated in FIG. 36 in some detail. The curved shape of this ramp 394 converts the linear motion of the push rod 396 into a rotational force that causes the anvil 360 to pivot to its "clenching orientation," where it becomes ready to receive the tip of a nail that will be quickly driven through a workpiece and against the hard surface of the anvil.

Figure 43:
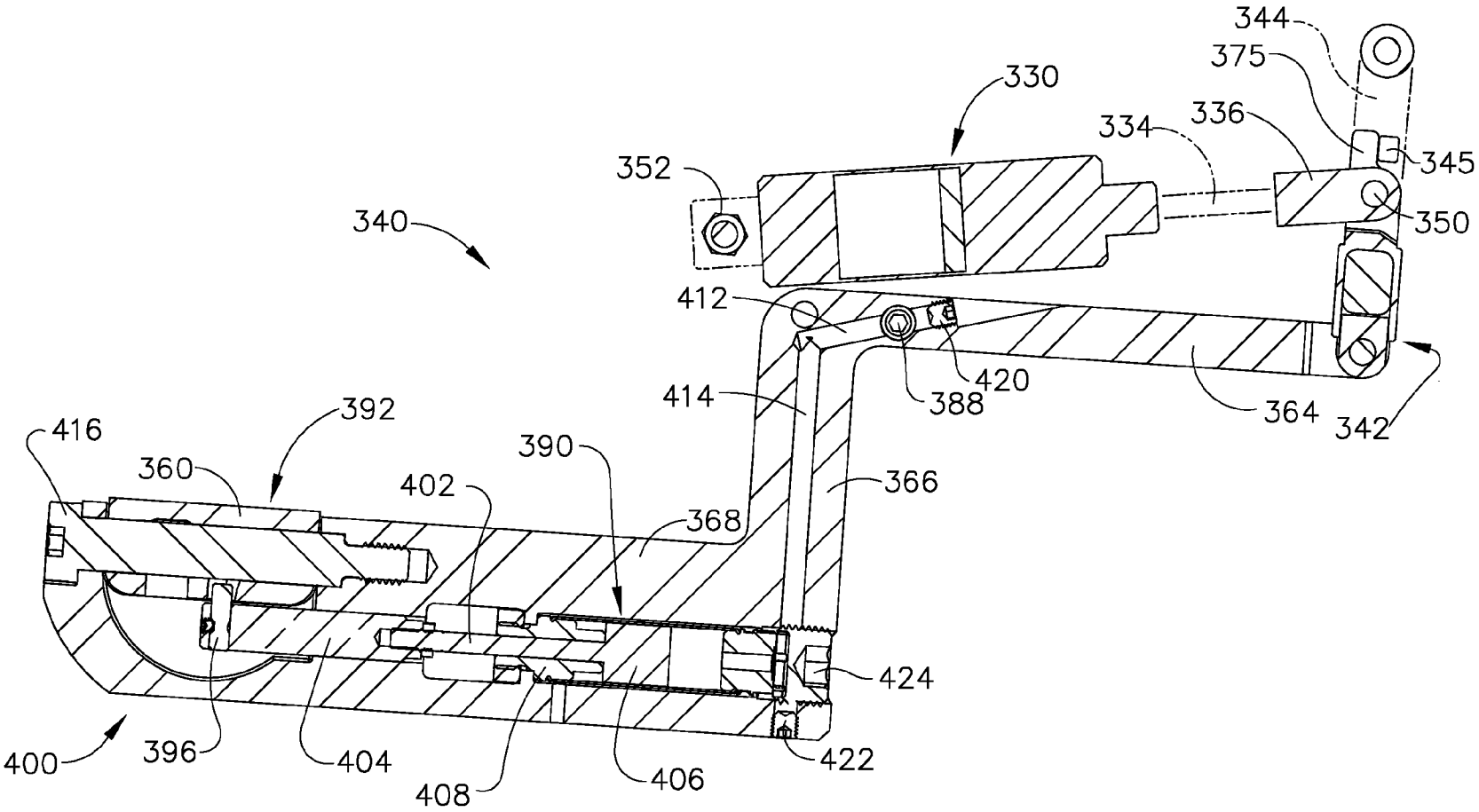
FIG. 43 is a "left side" elevational view in cross-section of the clenching extension arm of FIG. 42, in which the anvil is actuated and the clench arm is in its extended (clenched) state.
Figure 44:
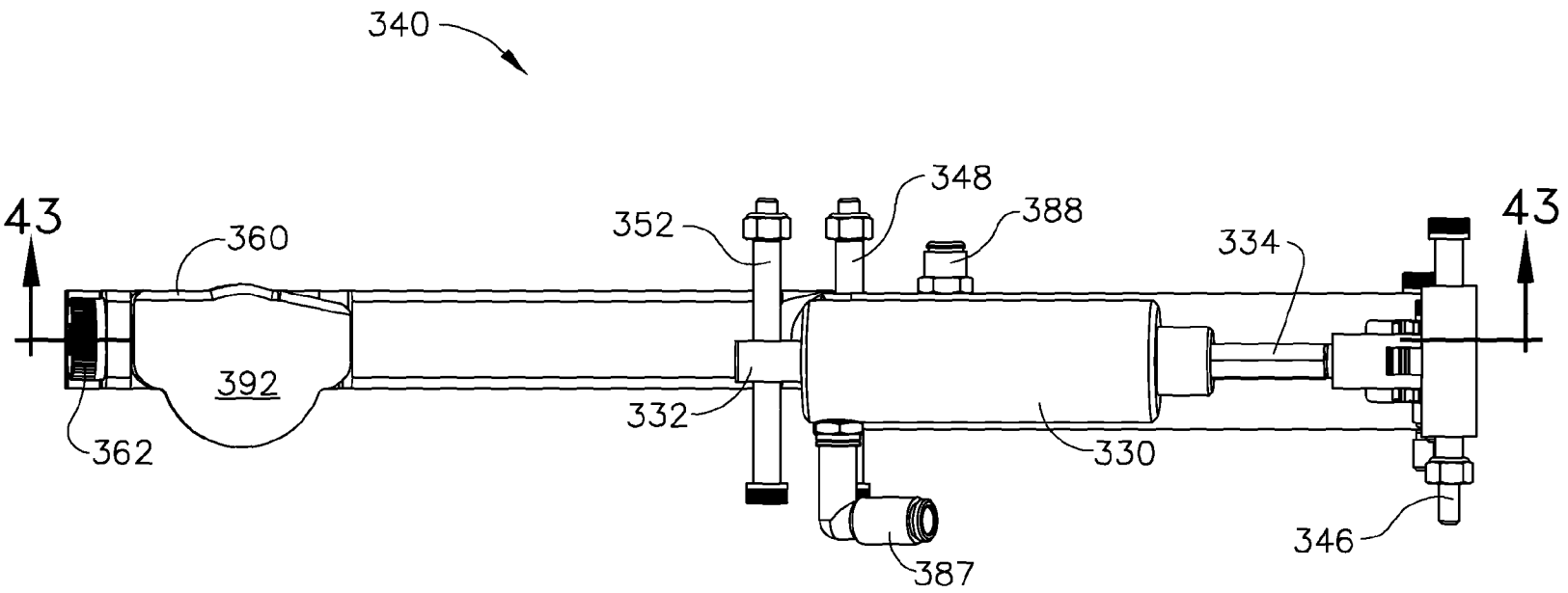
FIG. 44 is a top plan view of the clenching extension arm of FIG. 42, with the anvil actuated.

As discussed above, FIGS. 39, 40, and 41 illustrate the clench extension arm subassembly in its rest position; now three more illustrations will depict the extension arm subassembly 340 in its actuated position. Referring now to FIGS. 42, 43, and 44, it will be seen that the clench arm air cylinder 330 has been actuated, and therefore, its cylinder extension arm 334 will have extended and pushed the rod clevis 336 to a point that forces the two toggle links 342 and 344 to become essentially co-linear in orientation. This is viewed on FIGS. 42 and 43.

In FIGS. 42 and 43, the same structure is again illustrated as was seen on FIGS. 39 and 40; however, in FIGS. 42 and 43 the clench extension arm subassembly 340 has been actuated by the clench arm air cylinder 330. The toggle links 342 and 344 now have essentially a co-linear relationship with one another as mentioned above, and the two travel stops 345 and 375 now come into play to prevent the extension links and the rod clevis 336 from over traveling. As can be seen on FIG. 42, the travel stops 345 and 375 come into contact with one another, thereby preventing the two toggle links 432 and 344 from exhibiting an angle greater than 180 degrees, which could otherwise lead to an undesirable operating situation for this adapter.

Referring to FIG. 43, the air pressure in the first and second air passages 412 and 414 has actuated the anvil cylinder 390, and this figure shows the anvil cylinder rod 402 forcing the extension shaft 404 to move the push rod 396, and thereby rotate the anvil 360. The shape of the rotated anvil 360 in this position can be readily seen in FIG. 44. In this position, the anvil's more rounded side can be seen to extend past the overall width of the third (distal) extension arm 368, and thereby become a larger target for the nails that are being driven by the air tool 302.

By this arrangement, as illustrated in FIGS. 39-44, it can be seen that there is no external air line or cable on the extension arm subassembly 340. This is generally considered an improvement with regard to operating the overall air tool in a situation involving actual workpiece production parts. Extension arm subassembly 340 uses two separate air cylinders, the first of which operates the clench arm, and is the cylinder 330, and the second of which operates the anvil rotation, which is the cylinder 390. These two cylinders should be operated in a predetermined sequence, which will be discussed in greater detail, hereinbelow.

In FIG. 44, the flat surface of anvil 360 is facing the front end of the tool at 314, and is prepared to receive a nail that will be shot by the tool 302 through a target workpiece. That clenching effect is better seen FIG. 4, where the two wood boards 70 and 72 have been placed between the front end of the above-described tool at 14 and the upper surface of the above-described anvil 60. Of course, it is the anvil and the exit end (at the front end 314) where the fastener is fired that must be brought to the proper location of a target workpiece and then pressed against the surfaces the two pieces of wood. Once in the extended position, which is sometimes referred to herein as the "clenching position," then the nail will be fired by the tool 302.

As noted above, it must be kept in mind that the clenching extension arm must be made to fairly small dimensions, or it will not be useful in reaching into and through relatively small gaps between top deckboards in pallets, for example. These fairly small dimensions are mainly in the transverse direction of the extension arm, in a horizontal plane. In other words, it is allowable for the extension arm 340 to be larger in the vertical direction than in the horizontal direction, and this alternative embodiment extension arm 340 takes advantage of that fact. For example, the distal member 368 is larger in the vertical direction than in the horizontal direction, which can be seen by viewing FIGS. 39 and 41. Of course, the vertical thickness of the extension arm does not literally have to be larger in the vertical direction; this is up to the tool's designer.

There is a mechanism in the clench adaptor 310 that provides some "play" to allow for variations in the thickness of the target boards. In general terms, the extendable mechanism involves the toggle link 344, which will now be discussed in detail. Referring now to FIGS. 45-49, the two toggle links 342 and 344 are important with respect to the distance between the top surface of the anvil 360 when it is in its clench (rotated) position and the bottom edge of the firing end of the air tool 302, which is at a point 314, commonly referred to as the "tool front end." Since the pallets themselves (which are the workpieces for this coil nailer tool 302) do not always have an exact thickness, it is desired to allow the extension arm subassembly 340 to operate with a range of different thicknesses of such pallets. Accordingly, toggle link 342 is designed to be extendable, and FIGS. 45-49 show the details of this extendable toggle link 342.

Figure 46:
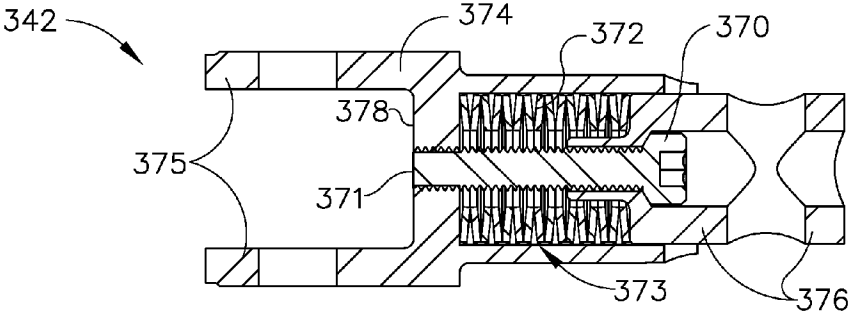
FIG. 46 is a top view in cross-section of the extendable toggle link of FIG. 45.

Toggle link 342 is actually made of a few different pieces: there is an outer link 374, a moveable link 376, a pre-load screw 370, and a spring 372. FIG. 46 is a section view that shows the internal details of these four important parts. The screw 370 holds the two links 374 and 376 in place with respect to one another; however, these two links are not fixed to one another, but can travel a variable distance within a space 373. This space is mostly taken up by the spring 372, which comprises a Belleville stack. As will be seen when comparing FIG. 46 to FIG. 48, if the Belleville stack spring 372 is uncompressed, then the actuating space 373 is larger, as compared to when the Belleville stack 372 is compressed (as viewed in FIG. 48). Before discussing these relative movements between the two links 374 and 376, the pre-loading of the links will be discussed.

The pre-load screw 370 does not necessarily need to be tightened within its tapped hole, however, for this design, it is intentionally tightened until the distal end of the screw (which is indicated by reference numeral 371) becomes flush with a wall face 378 of the outer link 374. This can be readily seen in FIG. 46. It should be noted, however, that this relative positioning of the screw's surface at distal end 371 and the wall face 378 hold the same "flush" relationship whether the toggle links have been actuated or not, which can be seen by looking at FIG. 46 and FIG. 48. A more definitive view of the wall face 378 is provided in a perspective view, given in FIG. 49.

Figure 45:
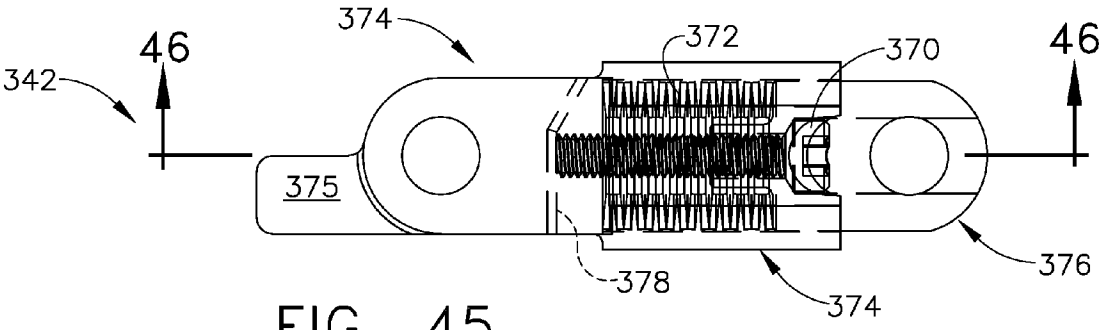
FIG. 45 is a side view of the extendable toggle link of the coil nailer tool and clenching adapter of FIG. 30, in its extended, but pre-loaded, state.

In essence, the views shown in FIGS. 45 and 46 are an "at rest" position, which is a pre-loaded situation for the two links 374 and 376. In this state, the overall length from one end to the other along a longitudinal axis (i.e., horizontally in the view of FIG. 45) is at its maximum distance.

Figure 47:
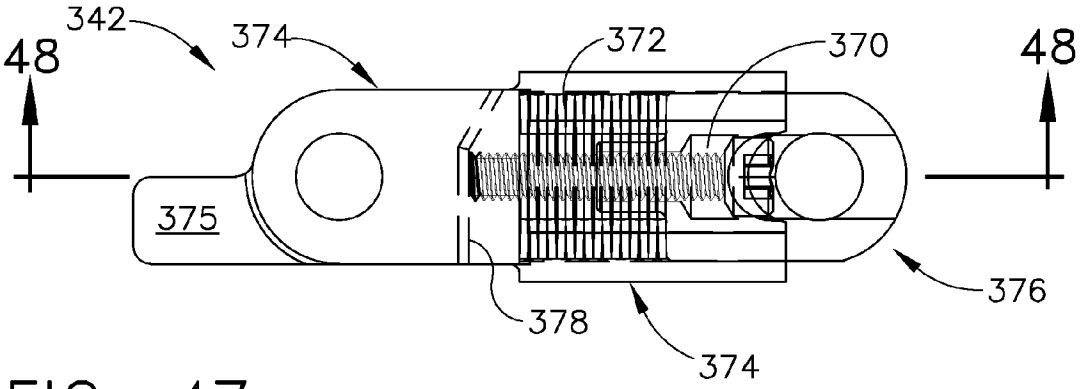
FIG. 47 is a side view of the extendable toggle link of the coil nailer tool and clenching adapter of FIG. 30, in its compressed (loaded) state.
Figure 48:
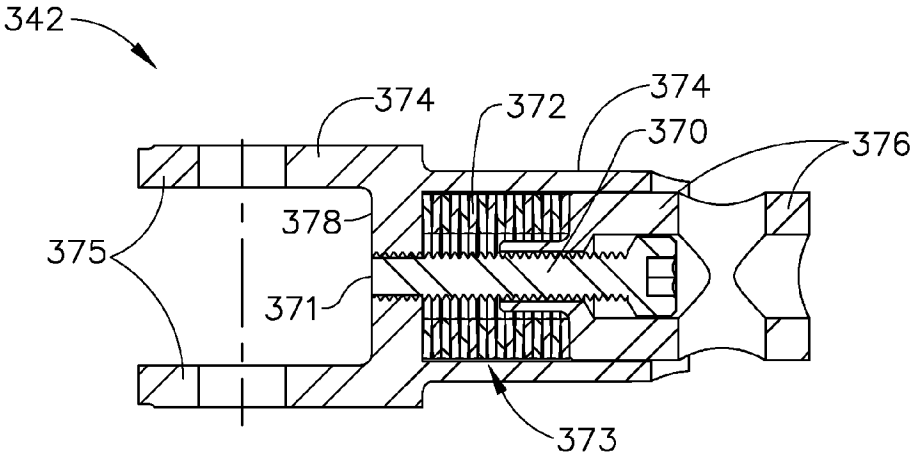
FIG. 48 a top view in cross-section of the extendable toggle link of FIG. 47.
Figure 49:
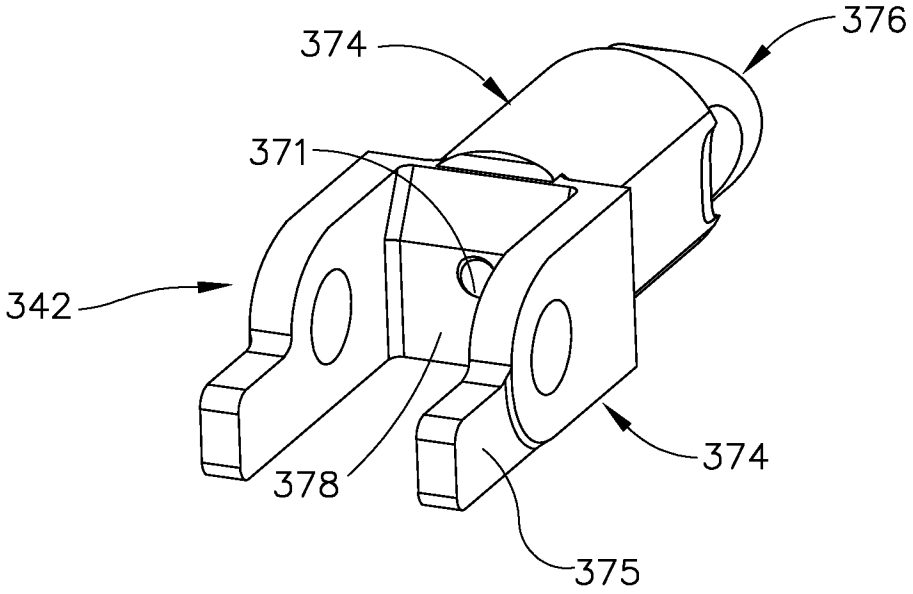
FIG. 49 is a perspective view of the extendable toggle link of FIGS. 45-48.

On the other hand, the views of FIGS. 47 and 48 show the Belleville stack 372 to be fully compressed. In this state, the overall length of this extendable toggle link 342 is at its minimum longitudinal distance, which is the horizontal distance as seen in FIG. 47. It should also be noted that the travel stop 375 is prominently viewed in these figures of FIGS. 45-49.

The extendable toggle link 342 is considered to be an improvement over the earlier version described above because it has no wearing rubber parts, and therefore, should be more robust and also probably stronger in overall mechanical tension and compression capabilities. And it can be seen that virtually any range of distances could be accommodated in this design, merely by making the pre-load screw 370 to a different length, and also by either expanding or contracting the size of the internal space 373 and the overall length of the Belleville stack 372.

The overall operation of the extending mechanism that causes the anvil to be pressed against the bottom of the target workpiece is actuated in two phases. The first phase rotates the anvil about 90 degrees. The second phase forces the (already rotated) anvil to be moved upward until it contacts the workpiece. This operating cycle could be performed by two separate manual movements, if desired. However, it is desired to have only a single manual movement be the impetus for both phases. The illustrated embodiment requires only a single manual impetus, although both hands are required, one for the trigger 312 and one for the safety lever 316. Both must be actuated before anything happens on the tool 302; once both are actuated together, the anvil is completely rotated automatically before the clench extension arm is fully moved to force the anvil upward and into contact with the workpiece. This preferably is a function of tool operation, not because of any particular actuation sequence or timing by the human operator.

In more general terms, the outer link 374 can be referred to as a "first link member," the movable link 376 can be referred to as a "second link member," the screw 370 can be referred to as an "alignment member" or a "tightenable fastener," and the Belleville stack 372 can be referred to as a "spring member" that is mechanically compressible. The first link member 374 has a first open area at one end (e.g., the space 373) that is larger in size than the facing end of the second link member 376, and the second link member also has a second open area at one end, which receives the alignment member 370. The facing end of the second link member 376 is smaller than the first open area 373 of the first link member 374. Each link 374 and 376 has its own longitudinal axis and, once assembled, the alignment member 370 is positioned along the longitudinal axis of the first link member 374 and is attached thereto, and protrudes through an opening in the spring member 372, and protrudes through an opening in the second link member 376, and thereby causes longitudinal axes of the first and second link members to become substantially co-linear.

As discussed above, the safety lever 316 is actuated manually to first rotate the anvil and then actuate the clenching arm mechanism. The coil nailer tool 302 also has a trigger 312 that is manually operated, and once the trigger is pulled, a nail or other type of fastener will be driven from the canister 308 out the front end of the tool at 314. Driving the fastener is a third phase of operation of the coil nailer tool 302. However, this third phase could potentially take place before the first and second phases if the trigger 312 is pulled before the safety lever 316 is actuated. Therefore, in this alternative embodiment, the actuation of the fastener to be driven is also performed in an automatic sequencing operation, which will not allow the fastener to be driven until after the anvil has been rotated and the clench arm has been actuated. This sequential operation is performed by pneumatic logic, using pilot operated directional valves, which will also be referred to herein as "pilot operated valves" or "POVs". The pneumatic logic of the tool 302 is provided schematically on FIG. 50. (Note: The pneumatic logic will also sometimes be referred to herein as "air logic.")

Figure 50:
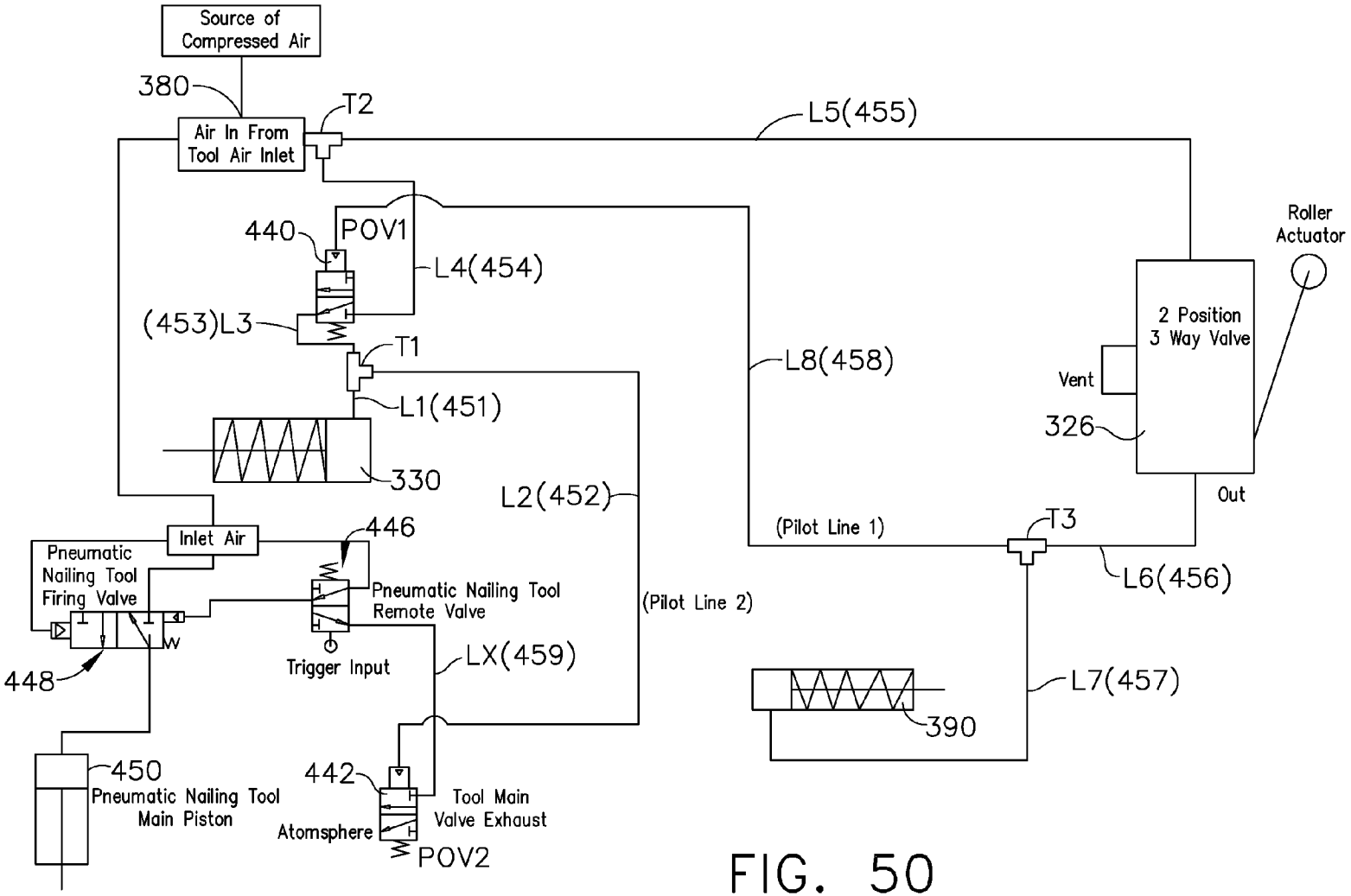
FIG. 50 is a schematic diagram of the pneumatic logic system for the coil nailer tool and clenching adapter of FIG. 30.

Referring now to FIG. 50, the main control elements are the two pilot operated valves 440 and 442 (also referred to, respectively, as "POV1" and "POV2".) There is a clench valve 326, which is a two position, 3-way valve in this embodiment, which controls actuation of POV1, and also controls actuation of the anvil cylinder 390. Once POV1 has been actuated, it controls the actuation of the clench arm air cylinder 330. There is an inherent, and intentional, time delay between the initiation of the actuation of POV1 and the pressurized air leaving its output port before arriving at the clench arm air cylinder 330. Therefore, the anvil turn cylinder 390 will always be fully actuated before the clench arm air cylinder 330 begins to be actuated.

POV1, when actuated, also controls the downstream actuation of POV2, and when POV2 is actuated, it controls the operation of a nailer remote valve 446. Once that has occurred, a pneumatic firing valve 448 is actuated, and that in turn actuates the nailing tool main piston 450.

On FIG. 50, these components are laid out schematically, along with air connecting air lines. A source of compressed air is required, which is brought into an air fitting for "supply air," which is at reference numeral 380 on FIG. 50. A "tee" fitting designated T2 now splits the supply air into two pathways, one along an air line L5 (reference numeral 455) and an air line L4 (reference numeral 454). Line L5 supplies pressurized air to the 3-way valve 326, which is the clench valve that is operated by a roller actuator, which in turn is actuated by the safety arm 316. Line L4 is directed to the first pilot operated valve, POV1. Supply air is also directed to the remote valve 446 and the firing valve 448, as shown schematically on FIG. 50.

At the beginning of a firing sequence, the roller actuator drives the 3-way valve into actuation, and then output pressurized air travels along an air line L6 (456) to another tee (T3), and that pressurized air is then directed along two separate air lines, L7 (457) and L8 (458). The line L7 actuates the anvil turn cylinder 390, while the line L8 acts as a "pilot line 1," which is directed to the POV1 pilot operated valve. Once pressurized air arrives along pilot line 1, then POV1 will be actuated and will then send pressurized air through an air line L3 (453) to yet another tee, designated T1. This now provides pressurized air along two separate air lines, L1 (451) and L2 (452).

Once pressurized air reaches line L1, that pressurized air will drive the clench arm air cylinder 330 into actuation, thereby tightening the clenching arm mechanism. At the same time, an air signal will be directed down L2 until it arrives at the second pilot valve, POV2. Once that occurs, the second pilot operated valve, POV2, will actuate, which will ultimately allow the nailing tool main piston 450 to actuate. This actuation is performed in a clever manner, taking advantage of the physical realities of the main air valves and other valves used in most coil nailer tools.

The physical orientation of the nailing tool's firing valve 448 and the nailing tool's main valve (with its piston 450) is such that there is a pressure chamber above the firing valve which must be exhausted before the tool will fire a fastener. The "output" air line from POV2 is a line designated LX (also reference numeral 459) on FIG. 50. This line LX is connected into this pressure chamber above the firing valve, and therefore POV2 will now control whether or not the pressure chamber can be exhausted to atmosphere, which in turn controls whether or not the main valve will fire a fastener. Since POV2 is controlled by air pressure that will not begin to rise until the clench valve mechanism has actuated, there will be a brief time delay between the clench arm air cylinder 330 actuating and the main firing valve or piston 450 being allowed to fire. This provides the desired sequencing, entirely with air logic and no electronics. The line LX will be allowed to reach an exhaust port 426 by a change of state for POV2, so that the pressurized air in the pressure chamber above the firing valve can then be exhausted to atmosphere.

In an exemplary embodiment of the tool 302, using the air logic depicted on the schematic of FIG. 50, it takes about 20 milliseconds (at a supply pressure of 100 psi) for the anvil to rotate, once the safety arm has been actuated. It then takes about 23 milliseconds (at 100 psi supply pressure) for the clench arm to clamp, once POV1 is actuated. (Please note that the threshold pressure at the air line to the anvil rotation valve was designed for about 80 psi, before POV1 will actuate. That threshold pressure could be lowered to decrease the overall actuation time, if desired.) When the clamp cylinder achieves 80 psi (using the above threshold), that threshold air pressure will then actuate POV2, which allows the tool to fire using its main valve.

The drawings of FIGS. 30-33 illustrate the positions of these main pneumatic logic components, and they also show where some of the air fittings are located on the tool. For example, there is an air fitting 382 for air lines L4 and L5, an air fitting 384 for the clench valve 326, an air fitting 386 for the main firing valve, an air fitting 387 for the clench arm cylinder 330, and an air fitting 388 for the anvil cylinder 390. These components can be located at other physical positions on the tool/adapter, if desired, without departing from the principles of the present technology.

It will be understood that the precise logical operations depicted in the schematic diagram of FIG. 50, and discussed above, could be somewhat modified to perform similar, perhaps exact, functions without departing from the principles of the technology disclosed herein. The exact nature of some of the hardware components disclosed herein are directed toward specific future models of automatic fastener driving tools (those involving Senco nailers, for example) and certainly similar, but somewhat different, components and functions would be taken for use with other models or brands of fastener driving tools in many instances, with the overall inventive results being the same. As an example, other types of "air logic" components could be used to perform the sequencing functions described above. For example, fluidic flow restrictors could be used instead of pilot operated valves to create time delays between the first, second, and third important events in the sequence of operations described above. Other types of proportional hydraulic (or pneumatic) valves also could be used, instead.

It will be further understood that, if desired by the system designer, electronic controls could partially, or entirely, replace the pneumatic logic system components depicted in FIG. 50 to perform the sequencing functions (or similar functions) without departing from the principles of the technology disclosed herein. In that type of alternative device, an electrical power supply (such as a battery) and an electronic controller (such as a microprocessor) would be used. The logic components themselves could comprise electrically-controlled solenoids to control certain fluidic flows involving the firing valve of the fastener driver, and thus replace air control valves. Timers and pressure sensors also could be used to replace any type of flow restrictor functions, i.e., to sense operating pressure conditions, and to delay or prevent the initiation of certain functions to create the proper sequence of operation, for example.

As used herein, the term "proximal" can have a meaning of closely positioning one physical object with a second physical object, such that the two objects are perhaps adjacent to one another, although it is not necessarily required that there be no third object positioned therebetween. In the technology disclosed herein, there may be instances in which a "male locating structure" is to be positioned "proximal" to a "female locating structure." In general, this could mean that the two male and female structures are to be physically abutting one another, or this could mean that they are "mated" to one another by way of a particular size and shape that essentially keeps one structure oriented in a predetermined direction and at an X-Y (e.g., horizontal and vertical) position with respect to one another, regardless as to whether the two male and female structures actually touch one another along a continuous surface. Or, two structures of any size and shape (whether male, female, or otherwise in shape) may be located somewhat near one another, regardless if they physically abut one another or not; such a relationship could still be termed "proximal." Or, two or more possible locations for a particular point can be specified in relation to a precise attribute of a physical object, such as being "near" or "at" the end of a stick; all of those possible near/at locations could be deemed "proximal" to the end of that stick. Moreover, the term "proximal" can also have a meaning that relates strictly to a single object, in which the single object may have two ends, and the "distal end" is the end that is positioned somewhat farther away from a subject point (or area) of reference, and the "proximal end" is the other end, which would be positioned somewhat closer to that same subject point (or area) of reference.

It will be understood that the various components that are described and/or illustrated herein can be fabricated in various ways, including in multiple parts or as a unitary part for each of these components, without departing from the principles of the technology disclosed herein. For example, a component that is included as a recited element of a claim hereinbelow may be fabricated as a unitary part; or that component may be fabricated as a combined structure of several individual parts that are assembled together. But that "multi-part component" will still fall within the scope of the claimed, recited element for infringement purposes of claim interpretation, even if it appears that the claimed, recited element is described and illustrated herein only as a unitary structure.

It will be further understood that the term "fastener" applies to nails and other types of fastening devices, such as brads and staples, for example. Moreover, the term "nail" is used in a generic sense herein, and a "nail-driving tool" can also be used to drive other types of fasteners (such as brads and staples). In general, the clenching adapter embodiments described herein are mainly designed to drive fairly large nails, because (today) that is what commonly is used to build and repair pallets. Naturally, if the target workpiece is scaled down, then smaller types of fasteners (such as brads) can instead be used with the adapters described herein, without departing from the principles of the technology disclosed herein. And, in the opposite sense, if the target workpiece is scaled up, then larger types of fasteners (such as spikes) can instead be used with the adapters described herein, without departing from the principles of the technology disclosed herein. There will, of course, ultimately be a size that becomes too large to be handled easily by human beings—the lifting lug 305 depicted on FIG. 30 already indicates that the tool and adapter combination 302, 310 is becoming something less than "portable," since the lug is typically attached to an overhead cable that holds the main weight of the tool/adapter combination.

All documents cited in the Background and in the Detailed Description are, in relevant part, incorporated herein by reference; the citation of any document is not to be construed as an admission that it is prior art with respect to the technology disclosed herein.

The foregoing description of a preferred embodiment has been presented for purposes of illustration and description. It is not intended to be exhaustive or to limit the technology disclosed herein to the precise form disclosed, and the technology disclosed herein may be further modified within the spirit and scope of this disclosure. Any examples described or illustrated herein are intended as non-limiting examples, and many modifications or variations of the examples, or of the preferred embodiment(s), are possible in light of the above teachings, without departing from the spirit and scope of the technology disclosed herein. The embodiment(s) was chosen and described in order to illustrate the principles of the technology disclosed herein and its practical application to thereby enable one of ordinary skill in the art to utilize the technology disclosed herein in various embodiments and with various modifications as are suited to particular uses contemplated. This application is therefore intended to cover any variations, uses, or adaptations of the technology disclosed herein using its general principles. Further, this application is intended to cover such departures from the present disclosure as come within known or customary practice in the art to which this technology disclosed herein pertains and which fall within the limits of the appended claims.

What is claimed is:

1. A clenching adapter, said clenching adapter having a mechanical support for mounting to an external fastener driving tool, said clenching adapter comprising:

(a) a first actuator that causes mechanical movement during a fastener firing sequence, said first actuator having a mounting location proximal to a mechanical support, and said first actuator having a first operating state and a second operating state;

(b) a movable extension arm which extends from said first actuator to a distal end of said extension arm; and (c) an anvil that is mounted proximal to said distal end of said movable extension arm;

(d) wherein:

(i) said anvil is sized and shaped to not contact a workpiece, if said first actuator is placed into said first operating state;

(ii) said anvil is sized and shaped to contact a distal side of said workpiece, if said first actuator is placed into said second operating state;

(iii) said movable extension arm is sized and shaped so as to position said anvil at a fastener receiving location on said distal side of said workpiece from where said mechanical support is positioned, such that when a fastener is fired, said fastener will penetrate through said workpiece and then impact against said anvil; and (iv) said anvil is movable between a first orientation and a second orientation, such that:

(A) if said first actuator is in said first operating state, then said anvil is maintained in said first orientation and exhibits a first cross-section footprint that is relatively small and allows said anvil to pass through a gap between two adjacent members of said workpiece; and (B) if said first actuator is in said second operating state, then said anvil is transitioned to said second orientation and now exhibits a second cross-section footprint that is larger and will not allow said anvil to pass through said gap, but when in said second orientation said anvil is sized and shaped to receive said fastener, and to cause said fastener to be curled, such that said workpiece becomes clenched after said fastener becomes curled; and (e) a second actuator subassembly that transitions said anvil from said first orientation to said second orientation, said second actuator subassembly causing said anvil to pivot;

wherein: said second actuator subassembly comprises one of: (i) an air-operated cylinder with a cam mechanism to convert linear motion to rotational motion for rotating said anvil;

(ii) a cable and return spring, with a cam mechanism to convert linear motion to rotational motion for rotating said anvil; (iii) a push-pull cable, with a cam mechanism to convert linear motion to rotational motion for rotating said anvil; and (iv) an air-operated cylinder that causes said anvil to rotate.

2. A clenching adapter, said clenching adapter having a mechanical support for mounting to an external fastener driving tool, said clenching adapter comprising:

(a) a first actuator that causes mechanical movement during a fastener firing sequence, said first actuator having a mounting location proximal to a mechanical support, and said first actuator having a first operating state and a second operating state;

(b) a movable extension arm which extends from said first actuator to a distal end of said extension arm; and (c) an anvil that is mounted proximal to said distal end of said movable extension arm;

(d) wherein:

(i) said anvil is sized and shaped to not contact a workpiece, if said first actuator is placed into said first operating state;

(ii) said anvil is sized and shaped to contact a distal side of said workpiece, if said first actuator is placed into said second operating state;

(iii) said movable extension arm is sized and shaped so as to position said anvil at a fastener receiving location on said distal side of said workpiece from where said mechanical support is positioned, such that when a fastener is fired, said fastener will penetrate through said workpiece and then impact against said anvil; and (iv) said anvil is movable between a first orientation and a second orientation, such that:

(A) if said first actuator is in said first operating state, then said anvil is maintained in said first orientation and exhibits a first cross-section footprint that is relatively small and allows said anvil to pass through a gap between two adjacent members of said workpiece; and (B) if said first actuator is in said second operating state, then said anvil is transitioned to said second orientation and now exhibits a second cross-section footprint that is larger and will not allow said anvil to pass through said gap, but when in said second orientation said anvil is sized and shaped to receive said fastener, and to cause said fastener to be curled, such that said workpiece becomes clenched after said fastener becomes curled; and (e) a second actuator subassembly that transitions said anvil from said first orientation to said second orientation, said second actuator subassembly causing said anvil to pivot;

wherein said second actuator subassembly comprises an air-operated valve that causes said anvil to rotate; and further comprising: at least one internal air passage that extends through at least a portion of said movable extension arm for supplying pressurized air to said air-operated valve that causes said anvil to rotate.

* * * * *